US007516800B1

(12) United States Patent
Silva, Jr. et al.

(10) Patent No.: US 7,516,800 B1
(45) Date of Patent: Apr. 14, 2009

(54) DRY SPRINKLER

(75) Inventors: Manuel R. Silva, Jr., Cranston, RI (US); Thomas E. Archibald, Providence, RI (US); Donald B. Pounder, North Kingston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 10/622,631

(22) Filed: Jul. 21, 2003

Related U.S. Application Data

(60) Provisional application No. 60/396,727, filed on Jul. 19, 2002, provisional application No. 60/427,214, filed on Nov. 19, 2002, provisional application No. 60/432,998, filed on Dec. 13, 2002, provisional application No. 60/432,994, filed on Dec. 13, 2002, provisional application No. 60/432,995, filed on Dec. 13, 2002, provisional application No. 60/432,996, filed on Dec. 13, 2002, provisional application No. 60/433,611, filed on Dec. 16, 2002, provisional application No. 60/432,999, filed on Dec. 13, 2002, provisional application No. 60/433,582, filed on Dec. 16, 2002, provisional application No. 60/432,997, filed on Dec. 13, 2002, provisional application No. 60/432,984, filed on Dec. 13, 2002, provisional application No. 60/432,985, filed on Dec. 13, 2002, provisional application No. 60/432,983, filed on Dec. 13, 2002, provisional application No. 60/432,982, filed on Dec. 13, 2002, provisional application No. 60/433,001, filed on Dec. 13, 2002, provisional application No. 60/433,004, filed on Dec. 13, 2002, provisional application No. 60/433,002, filed on Dec. 13, 2002, provisional application No. 60/433,003, filed on Dec. 13, 2002, provisional application No. 60/433,610, filed on Dec. 16, 2002, provisional application No. 60/433,599, filed on Dec. 16, 2002, provisional application No. 60/433,605, filed on Dec. 16, 2002, provisional application No. 60/433,612, filed on Dec. 16, 2002, provisional application No. 60/433,005, filed on Dec. 13, 2002.

(51) Int. Cl.
*A62C 37/08* (2006.01)
*A62C 35/00* (2006.01)
*A62C 35/62* (2006.01)

(52) U.S. Cl. ..... 169/37; 169/17; 169/41

(58) Field of Classification Search ..... 169/37, 169/17, 39–42, 56, 57
See application file for complete search history.

(56) References Cited

U.S. PATENT DOCUMENTS 1,338,469 A 4/1920 Waage et al.

(Continued)

OTHER PUBLICATIONS

Viking Corp., Technical Data, "Dry Pendent Sprinklers Model C" 4 sheets, Jan. 1987.

(Continued)

*Primary Examiner*—Darren W Gorman
(74) *Attorney, Agent, or Firm*—Proskauer Rose LLP

(57) ABSTRACT

A dry sprinkler for a fire protection system. The preferred dry sprinkler has a metallic disc annulus positionable within a passageway to skew a central axis of a face of the metallic disc annulus with respect to a longitudinal axis of the dry sprinkler so that an expected minimum flow rate based on a rated discharge coefficient is provided. The dry sprinkler operates to provide an expected flow rate over a range of start pressures. The expected flow rate is based on a K-factor rating. The dry sprinkler provides an acceptable level of fluid flow rate from the expected flow rate based on the K-factor for a range of start pressures.

55 Claims, 50 Drawing Sheets

U.S. PATENT DOCUMENTS

| | | | | |
|---|---|---|---|---|
| 1,903,150 | A | 3/1933 | Tyden | |
| 2,155,990 | A | 4/1939 | Hodgman, Jr. | |
| 2,180,258 | A | 11/1939 | Rowley | |
| 2,732,018 | A | 1/1956 | Grimes | |
| 2,768,696 | A | 10/1956 | Sherburne | |
| 2,871,953 | A | 2/1959 | Bray | |
| 3,007,528 | A | 11/1961 | Gloeckler | |
| 3,061,015 | A | 10/1962 | Cann, Jr. | |
| 3,080,000 | A | 3/1963 | Gloeckler | |
| 3,135,331 | A | 6/1964 | Lee | |
| 3,584,689 | A | 6/1971 | Willms | |
| 4,007,878 | A | 2/1977 | Anderson | |
| 4,091,872 | A | 5/1978 | Mountford | |
| 4,177,862 | A | 12/1979 | Bray | |
| 4,220,208 | A | 9/1980 | Jackson et al. | |
| 4,228,858 | A | 10/1980 | Sclafani | |
| 4,258,795 | A | 3/1981 | Hansen | |
| 4,417,626 | A | 11/1983 | Hansen | |
| 5,188,185 | A | 2/1993 | Mears | |
| 5,228,520 | A | 7/1993 | Gottschalk | |
| 5,775,431 | A | 7/1998 | Ondracek | |
| 5,967,240 | A | 10/1999 | Ondracek | |
| 6,152,236 | A | 11/2000 | Retzloff et al. | |
| 6,367,559 | B1 | 4/2002 | Winebrenner | |
| 6,554,077 | B2 | 4/2003 | Polan | |
| 6,851,482 | B2 * | 2/2005 | Dolan | 169/16 |
| 2002/0050531 | A1 | 5/2002 | Dolan | |
| 2003/0075343 | A1 | 4/2003 | Ballard | |
| 2006/0102362 | A1 | 5/2006 | Polan | |
| 2006/0113093 | A1 | 6/2006 | Silva | |
| 2007/0187116 | A1 | 8/2007 | Jackson et al. | |

OTHER PUBLICATIONS

Chemetron Fire Systems, "Model ME-1 Flush Type Dry Pendent", 4 sheets.
Total Walther Feuerschutz GmbH, "Hängender Trockensprinkler GHTS 15, Dry pendent sprinkler, Sprinkler anti-gel" Kenblatt-Nr. 4-044-03, 2 sheets, Jan. 1989.
Reliable, "Model G3 Dry Sprinkler", 4 sheets, Nov. 1987.
Victaulic, Models V3608 and V3607 Standard Spray Pendent and Recessed Pendent Standard and Quick Response, 4 sheets, Apr. 2001.
Victaulic, Models V3604 and V3603 "Dry type Upright—Standard and Quick Response", 4 sheets, Apr. 2001.
Globe Fire Sprinkler Corporation, "Automatic Sprinklers Model J Bulb Spray Series Dry Type Pendent Recessed Pendent", 8 sheets, Aug. 1990.
Globe Fire Sprinkler Corporation, "Dry Pendent Sprinklers Model F960 Designer, ½" Orifice", 4 sheets, Feb. 2001.
Central Sprinkler Corporation, "Dry Pendent Sprinklers Recessed, Flush and Extended Types Model "A-1"", 2 sheets, 1986.
Preussag Minimax, "Sprinkler-Teile/Parts Trockensprinkler dry sprinkler", 2 sheets, Jan. 1989.
First Sprinkler—Color Photo 01.
First Sprinkler—Color Photo 02.
First Sprinkler—Color Photo 03.
First Sprinkler—Color Photo 04.
First Sprinkler—Color Photo 05.
Second Sprinkler—Color Photo 06.
Second Sprinkler—Color Photo 07.
Second Sprinkler—Color Photo 08.
Dry Pendent Drop Sprinkler, Data Sheet AS.159, 2 pages.
Engineering drawings of the Dry Pendent Drop Sprinkler described in Data Sheet AS.159, 10 pages.
Response to Office Action , US 2007/0187116, Mar. 13, 2008, pp. 1-25.
Office Action, US 2007/0187116, Dec. 13, 2007, pp. 1-13.
Grinnell Corporation; Dry Sprinklers, Quick Response, Data Sheet of Model F960: Jun. 1998; 1 sheet.
Grinnell Corporation; Engineering drawings of Model F960 Dry Pendent Bulb Type Sprinkler Yoke; Rev. Jan. 3, 1991; 1 sheet.
Grinnell Corporation; Engineering drawings of Model F960 Dry Pendent Bulb-Type Sprinkler Assembly; Apr. 24, 1991; 1 sheet.
Viking Corp.; Technical Data, "Model M Quick Response Dry Pendent Sprinkler"; Apr. 9, 1998; 4 sheets.
Factory Mutual Research Corporation; "Approval Standard for Automatic Sprinklers for Fire Protection, Class Series 2000" (Sections 4.8 and 4.13); May 1998; 5 pages.
Underwriters Laboratories Inc.; "UL 199 Standard for Automatic Sprinklers for Fire-Protection Service" (Sections 20 and 29); Apr. 8, 1997; 4 pages.
James E. Golinveaux; "A Technical Analysis: The Use and Maintenance of Dry Type Sprinklers" (http://www.tyco-fire.com/TFP_common/DrySprinklers.pdf); Jun. 2002; 15 pages.
Victaulic; "Models V3606 and V3605 Dry Type Standard Spray Pendent and Recessed Pendent Standard and Quick Response"; 2002; 4 sheets.

* cited by examiner

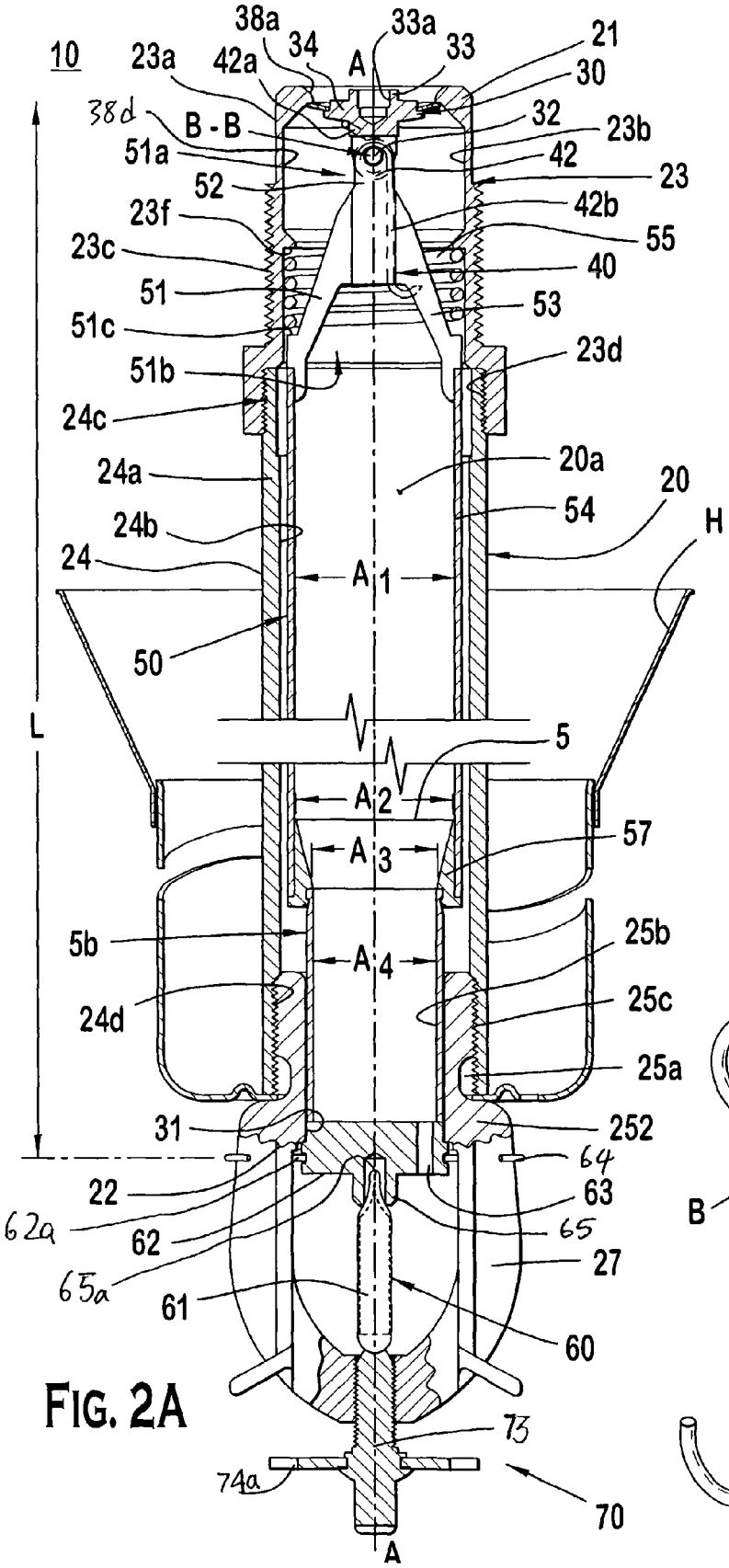
FIG. 2A
FIG. 2C
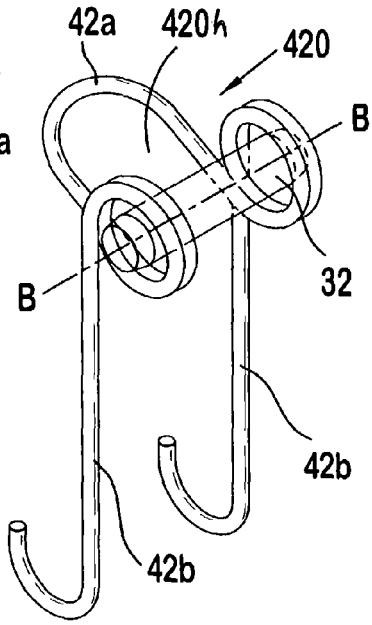

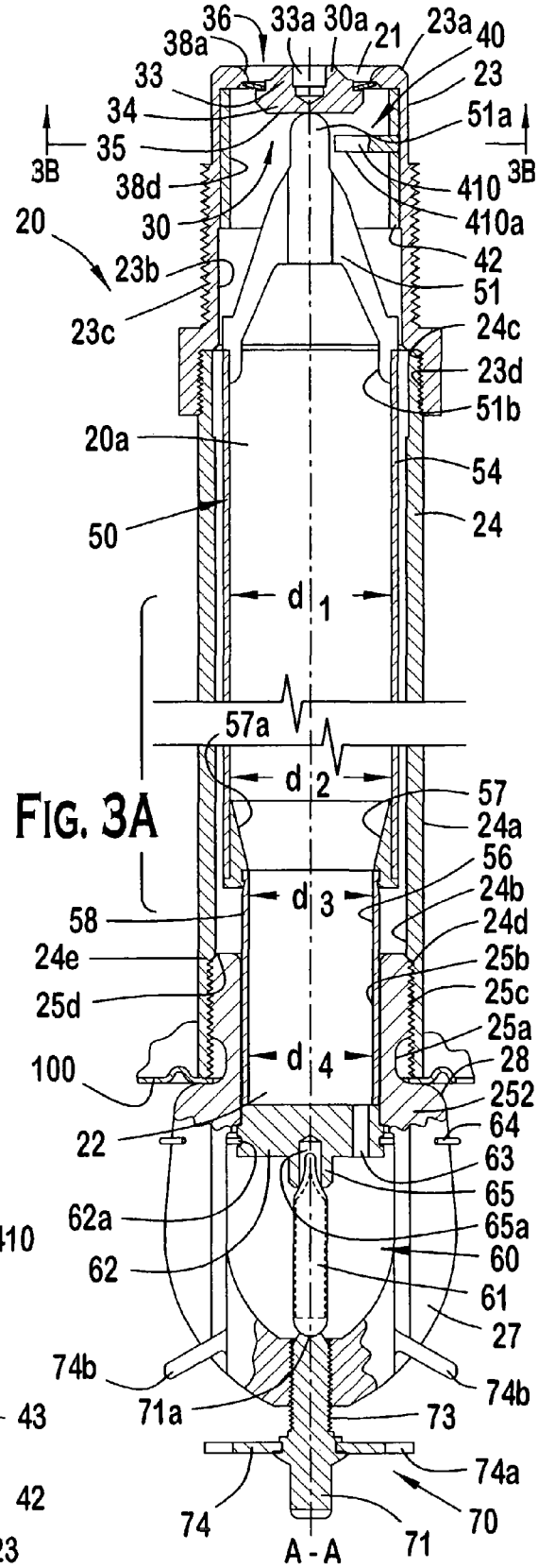
FIG. 3A
FIG. 3B
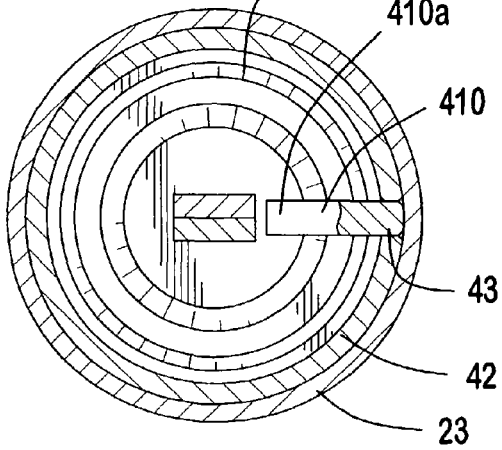

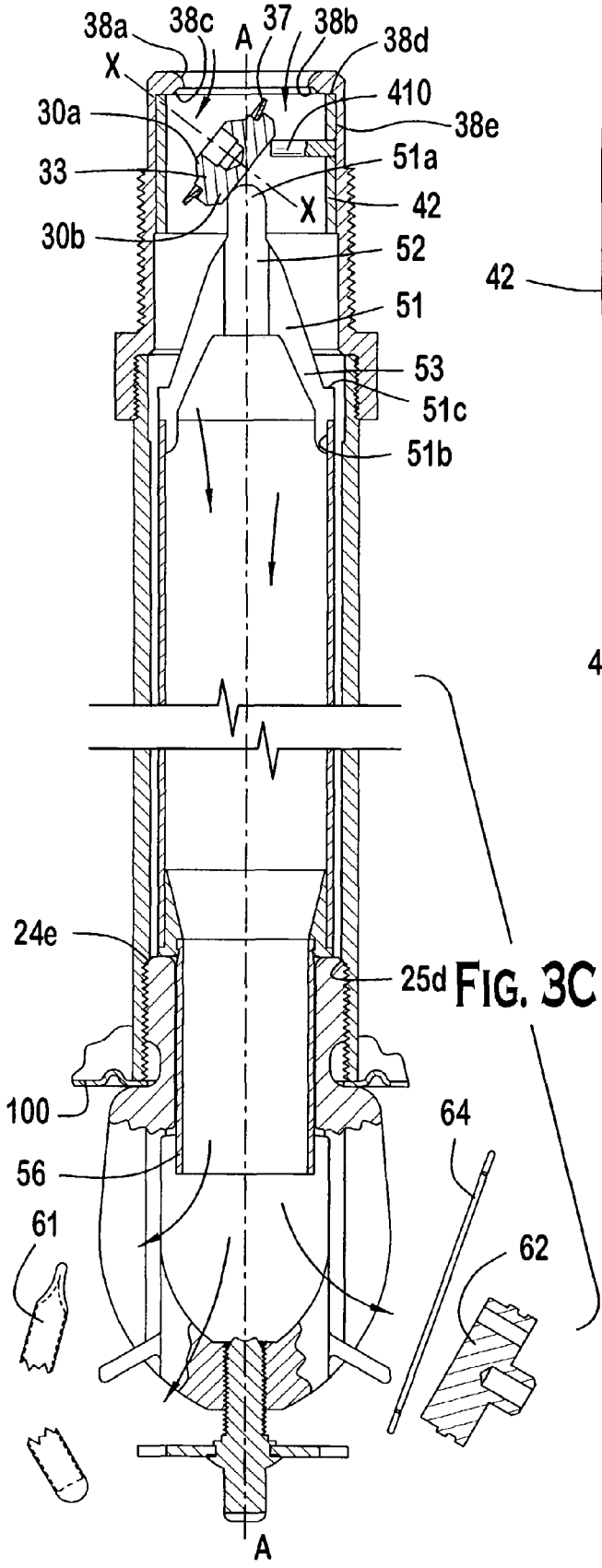
FIG. 3C
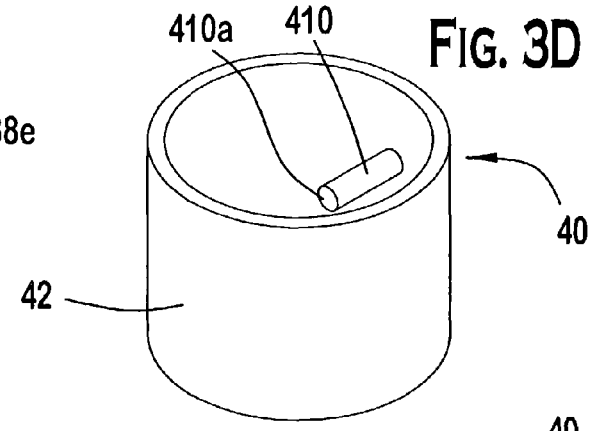
FIG. 3D
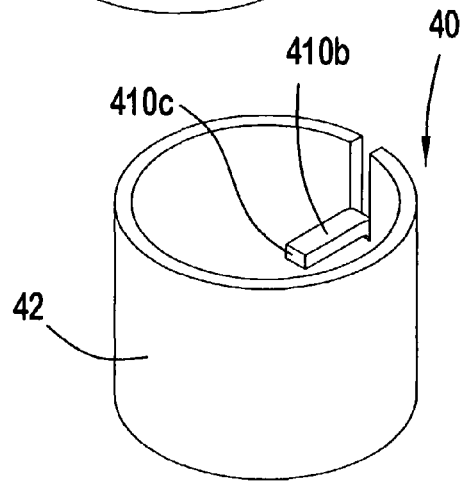
FIG. 3E
FIG. 3F
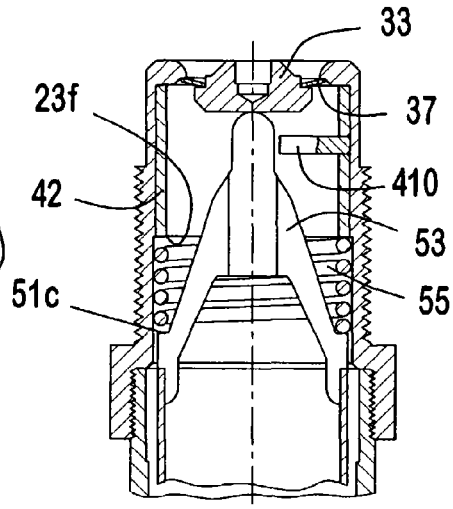

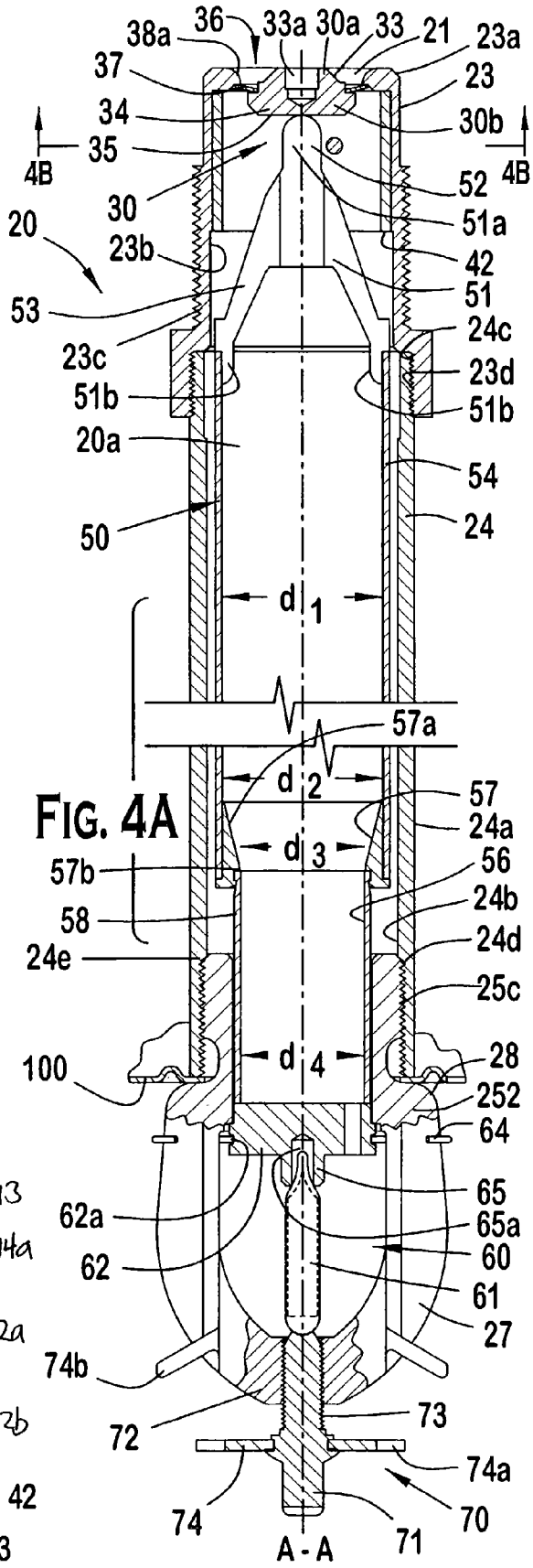
FIG. 4A
FIG. 4B
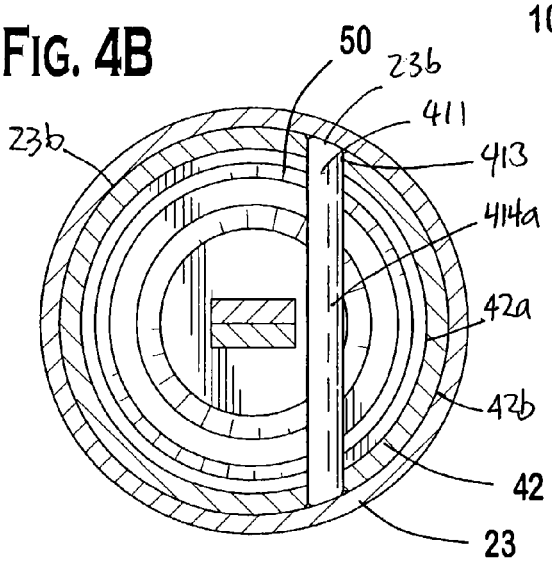

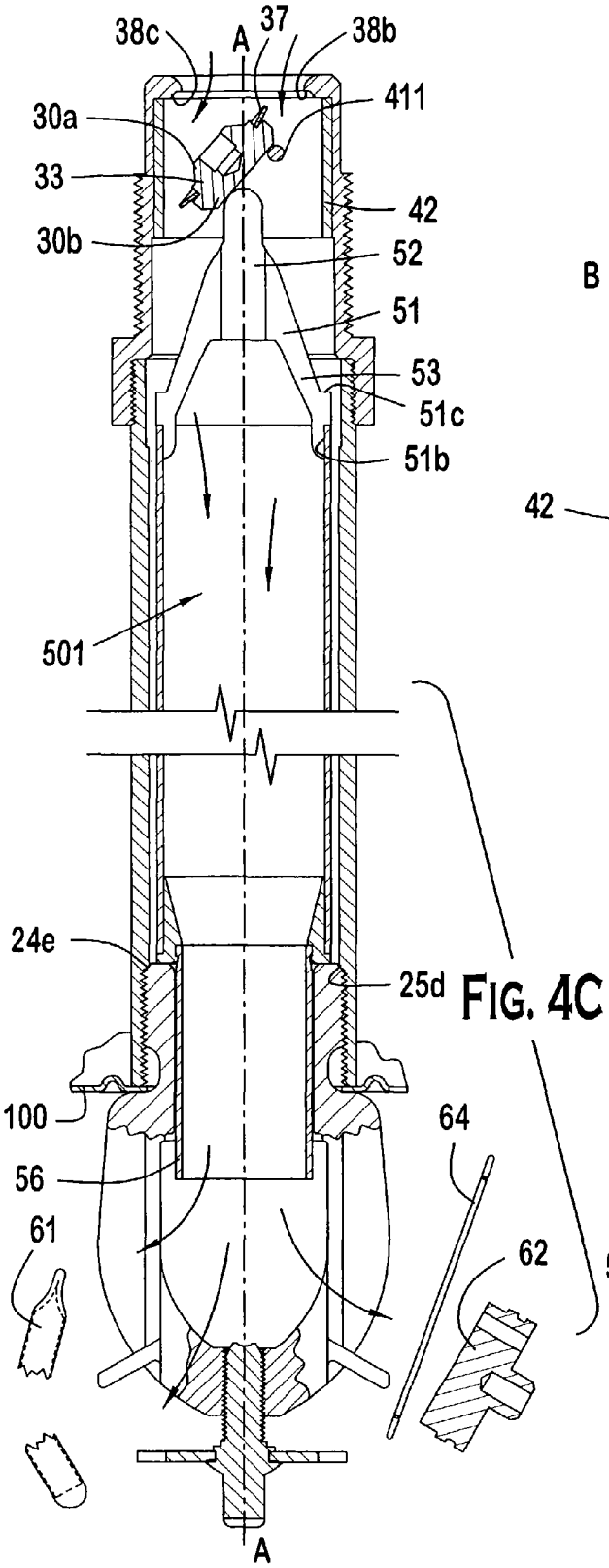
FIG. 4C
FIG. 4D
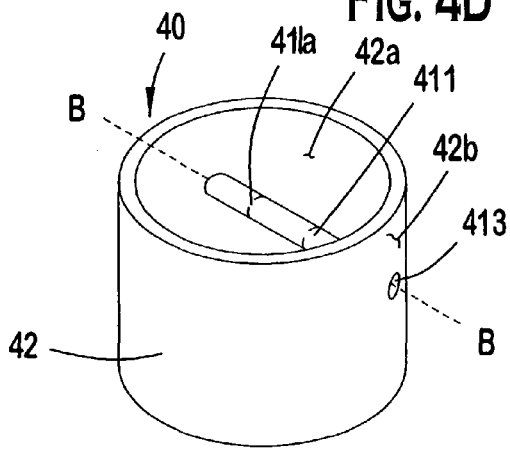
FIG. 4E
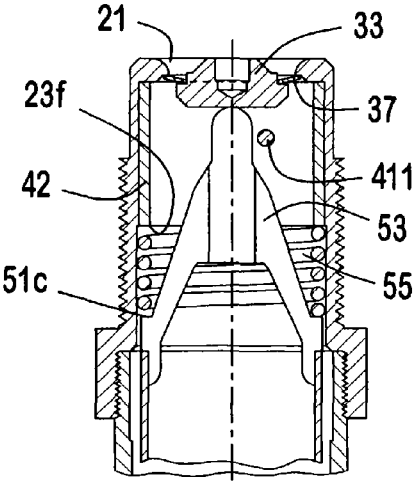

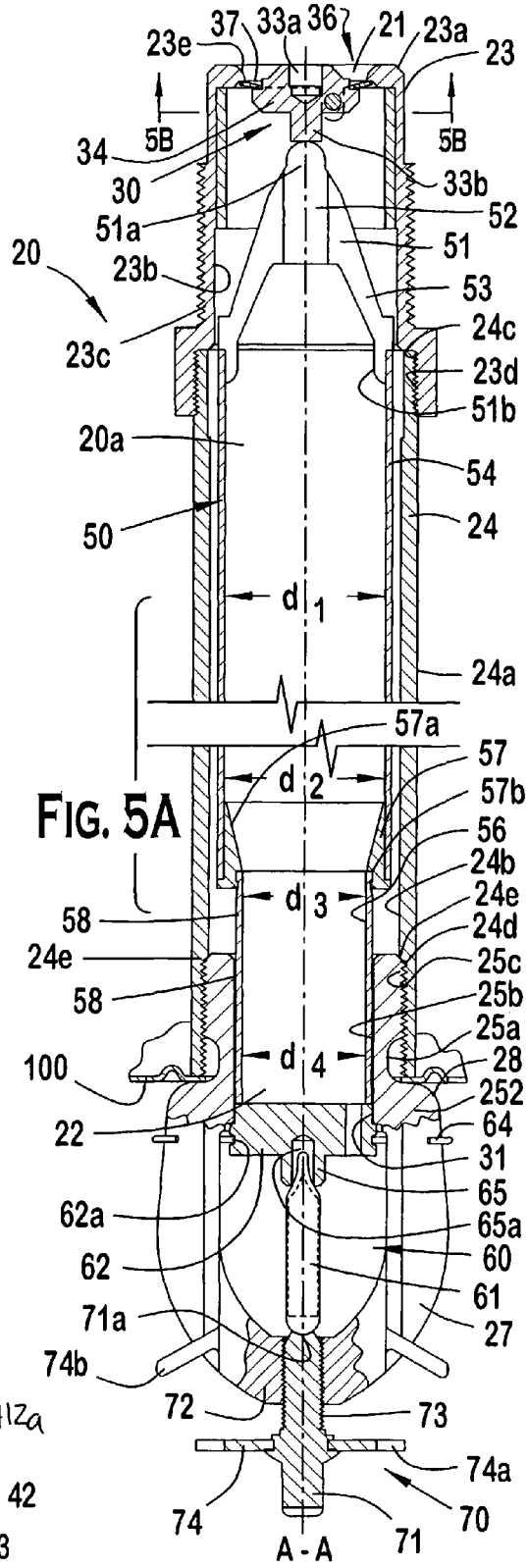
FIG. 5A
FIG. 5B
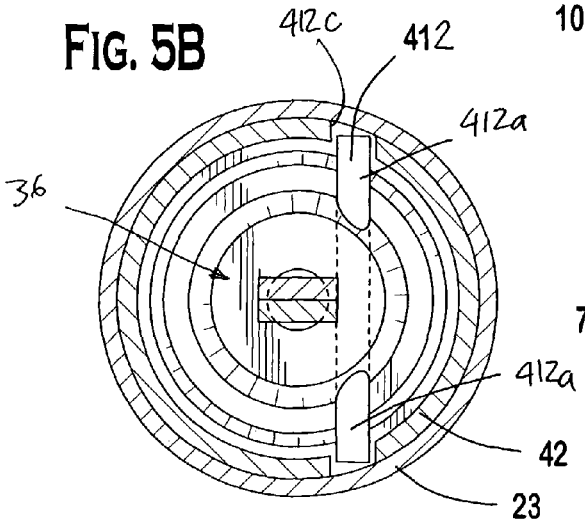

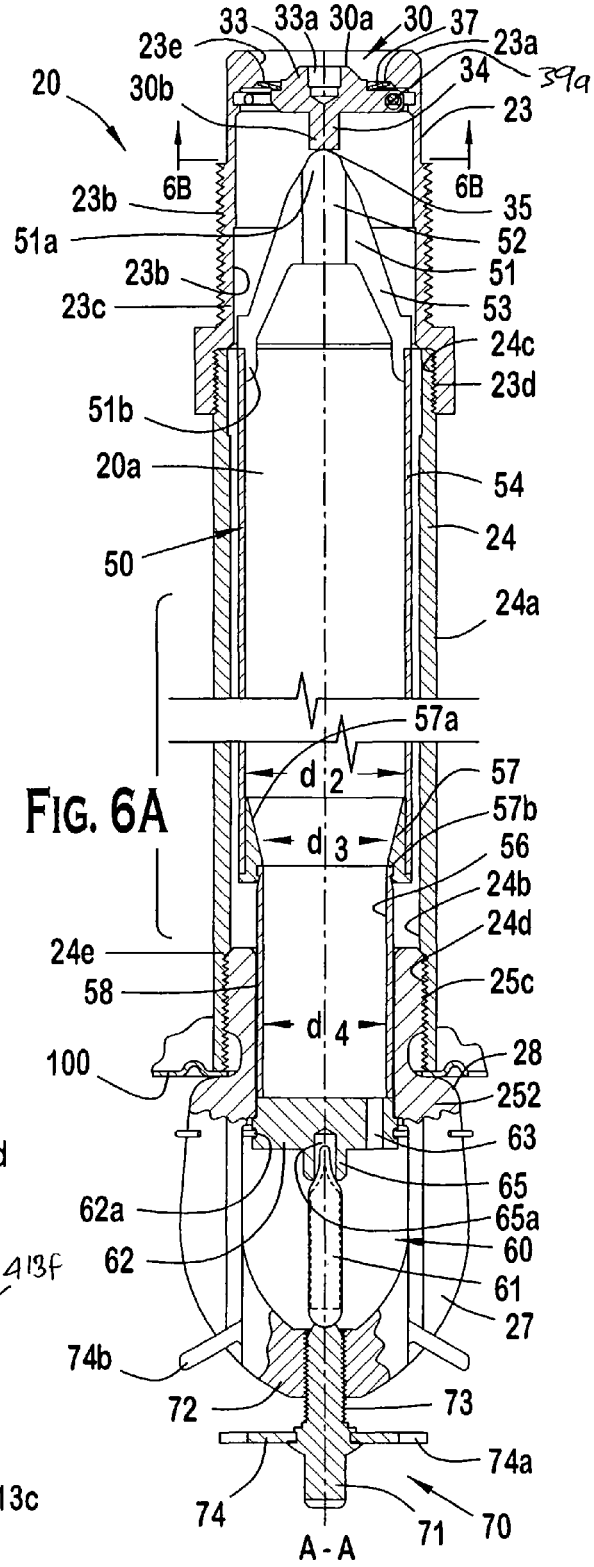
FIG. 6A
FIG. 6B
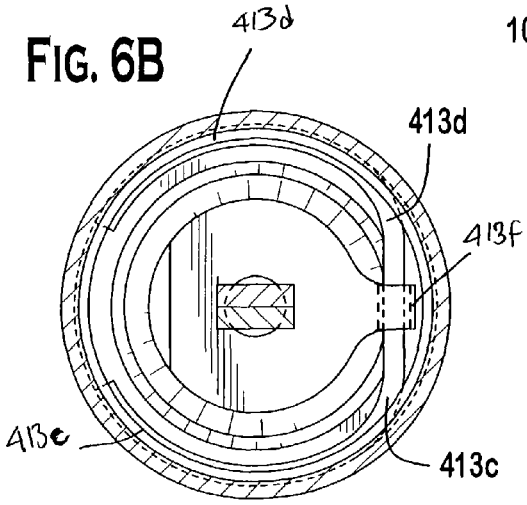

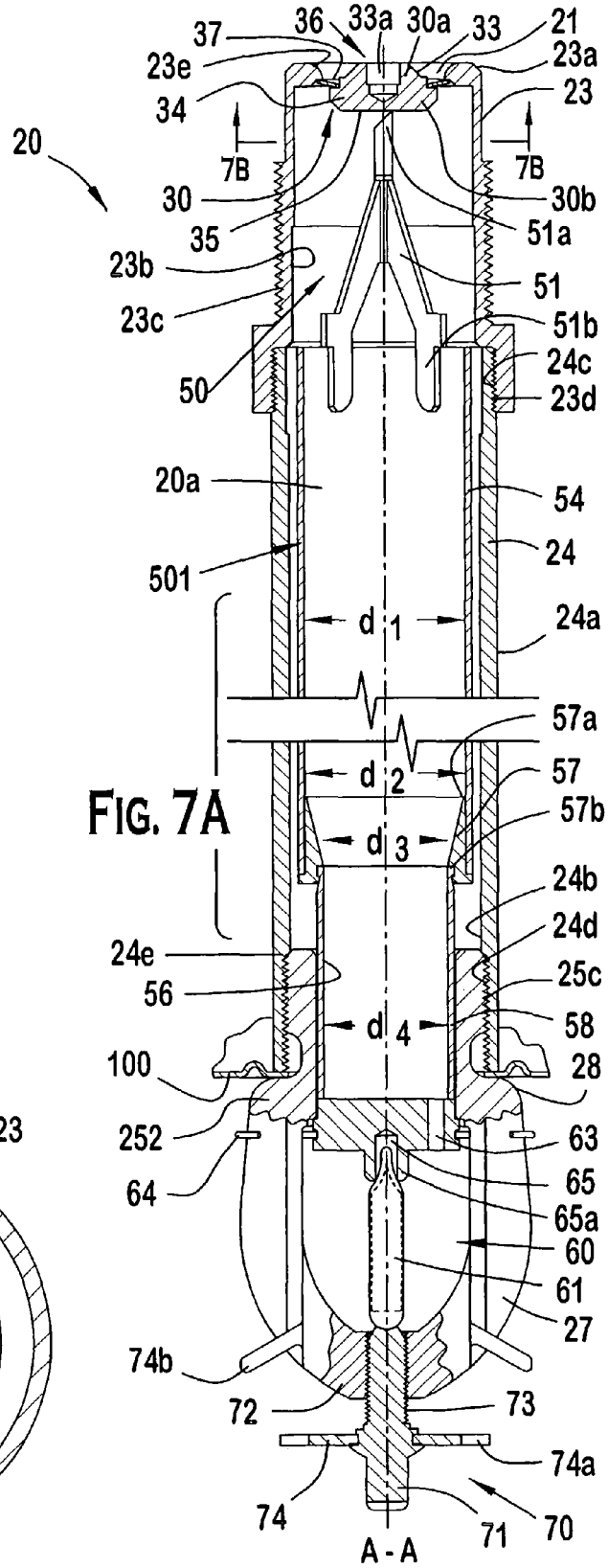
FIG. 7A
FIG. 7B
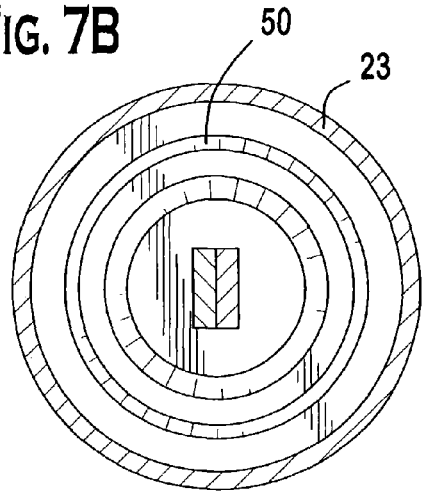

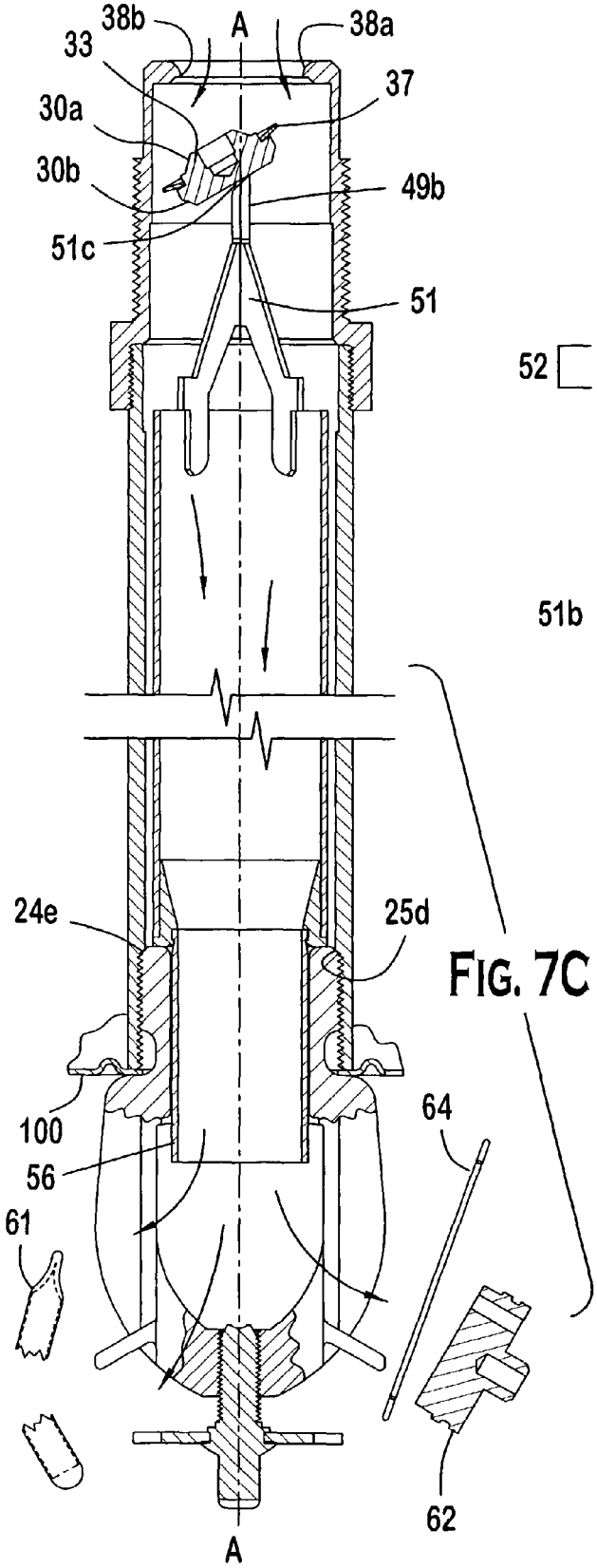
FIG. 7C
FIG. 7D
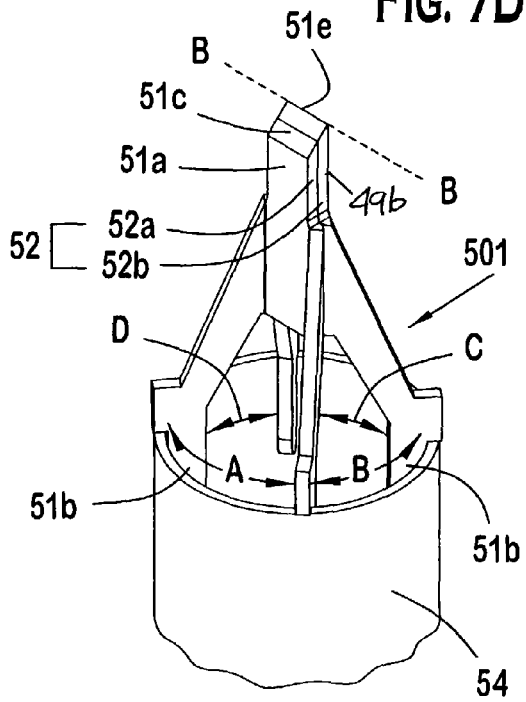
FIG. 7E
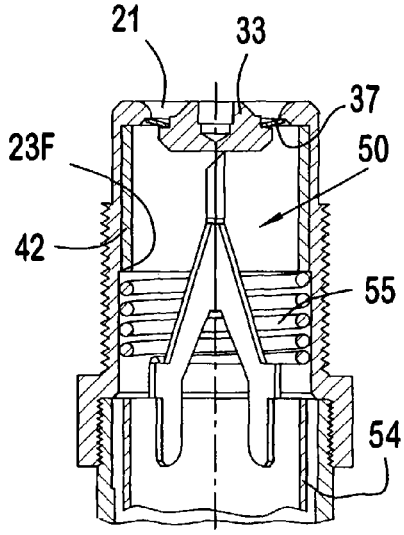

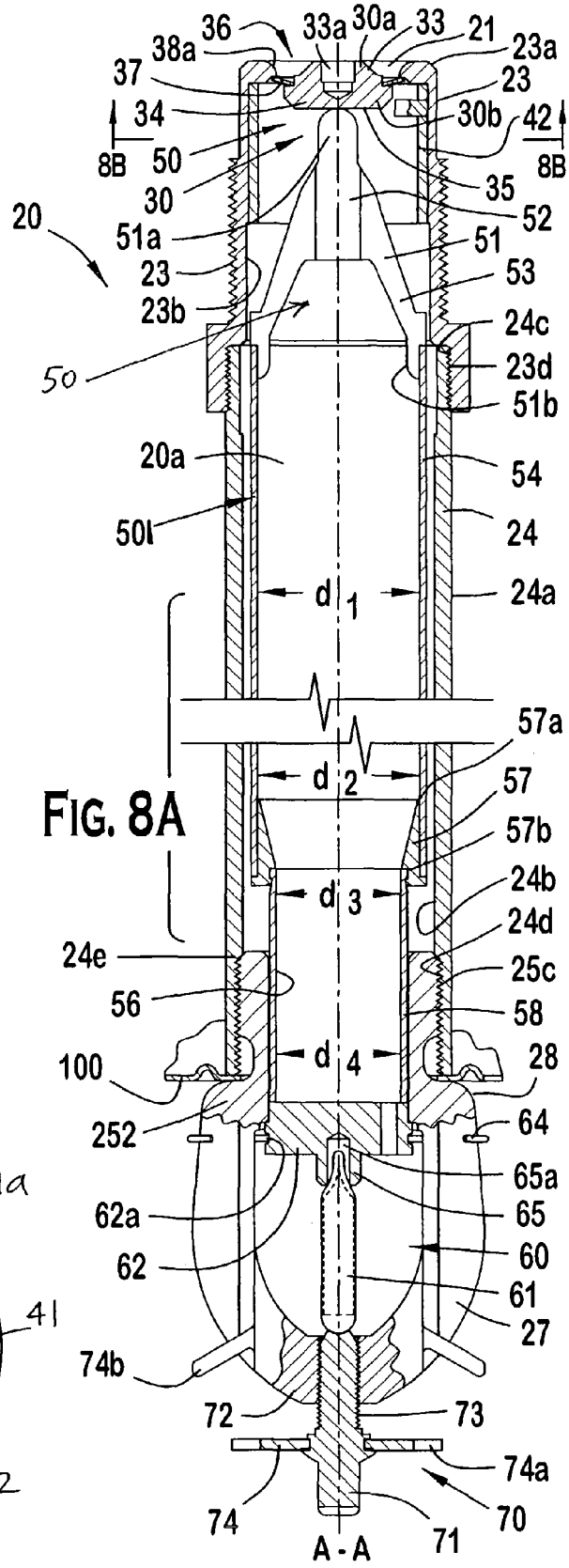
FIG. 8A
FIG. 8B
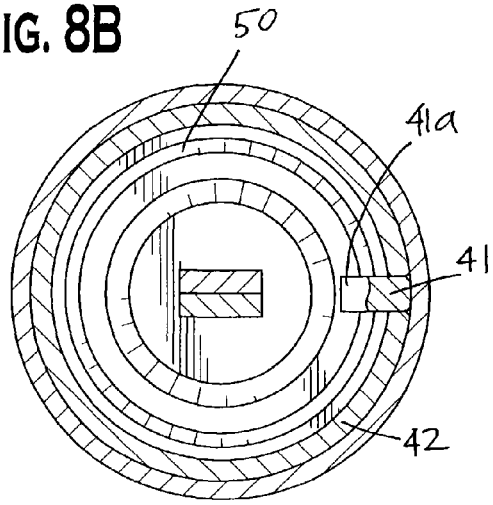

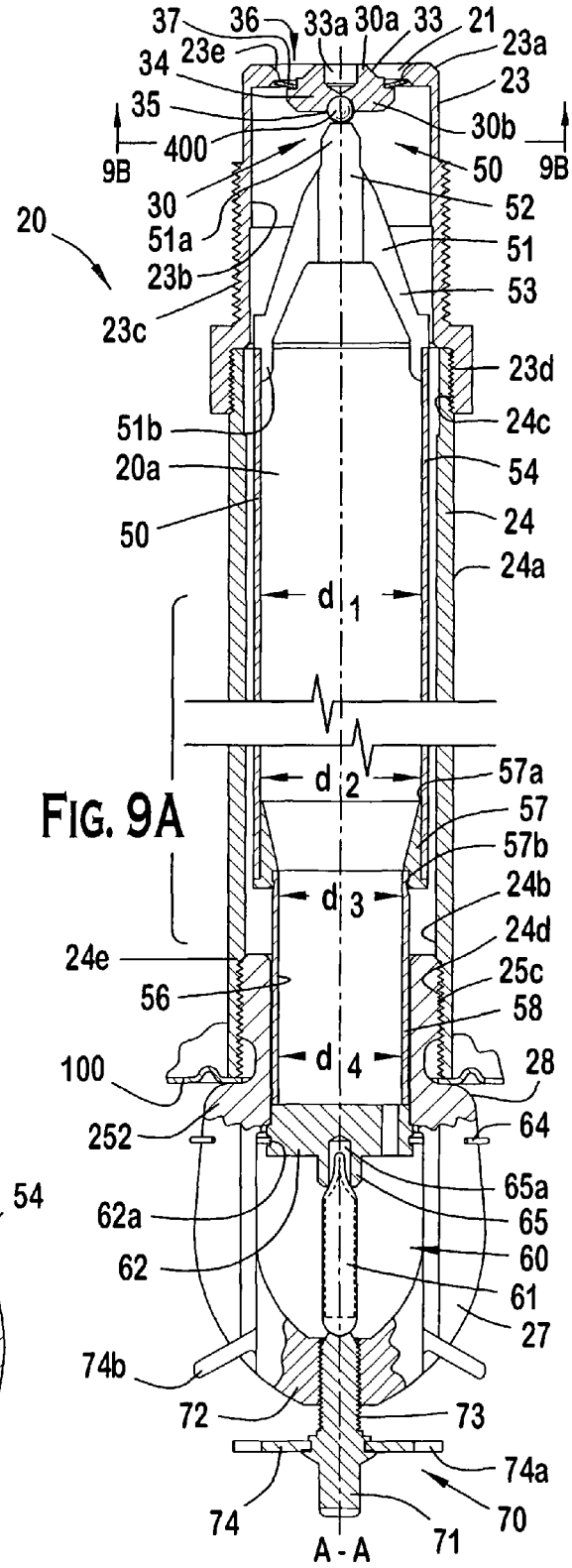
FIG. 9A
FIG. 9B
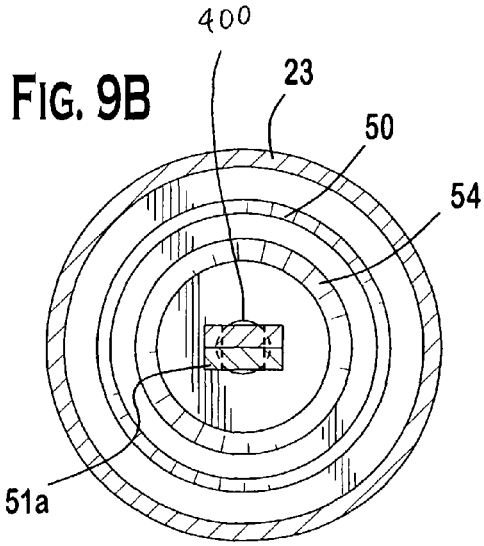

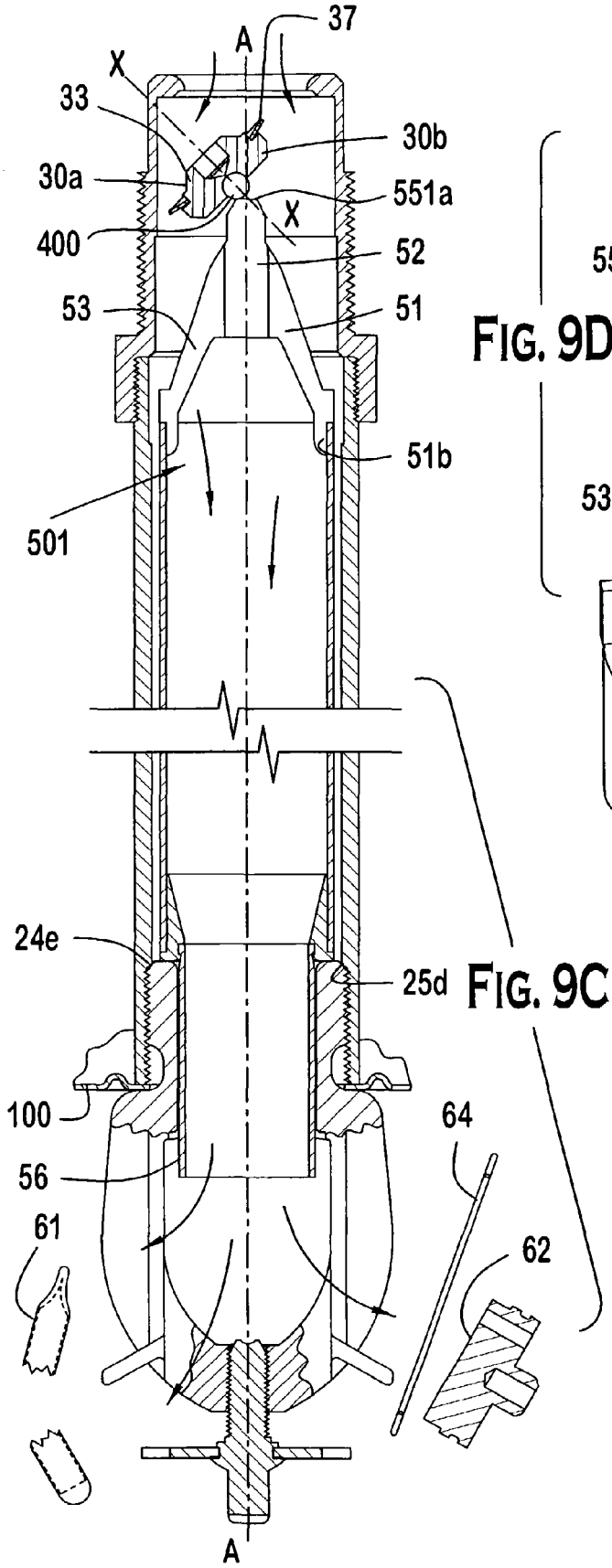
FIG. 9C
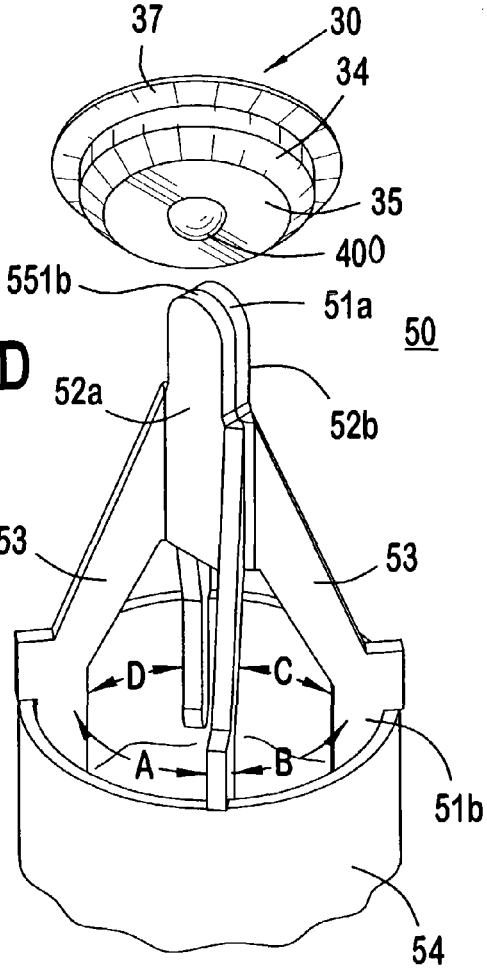
FIG. 9D
FIG. 9E
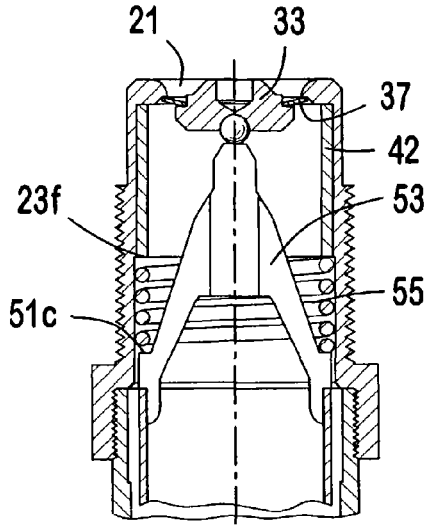

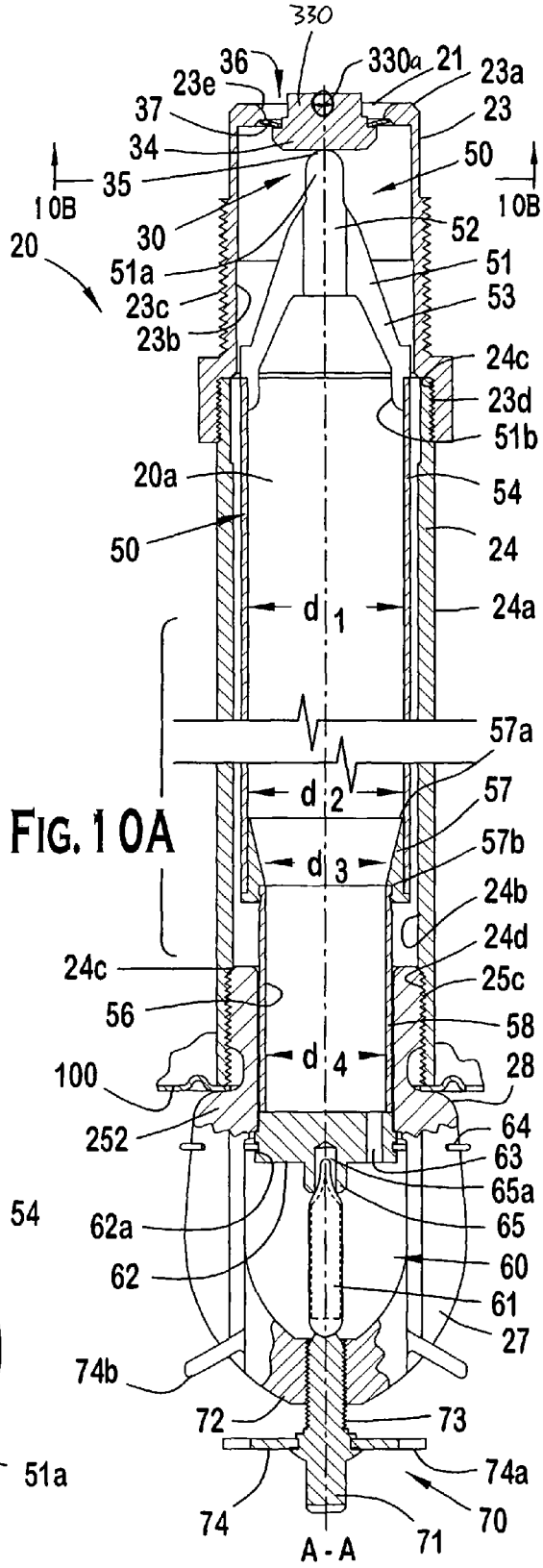
FIG. 10A
FIG. 10B
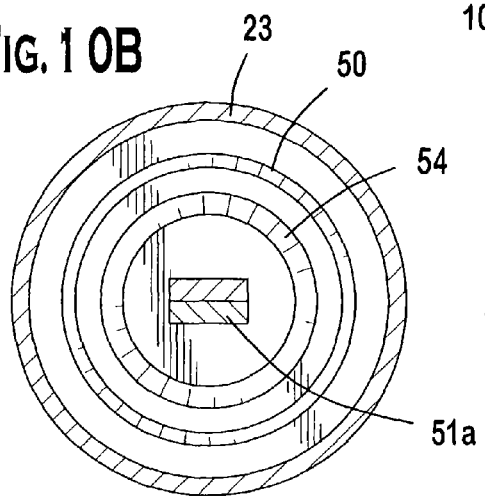

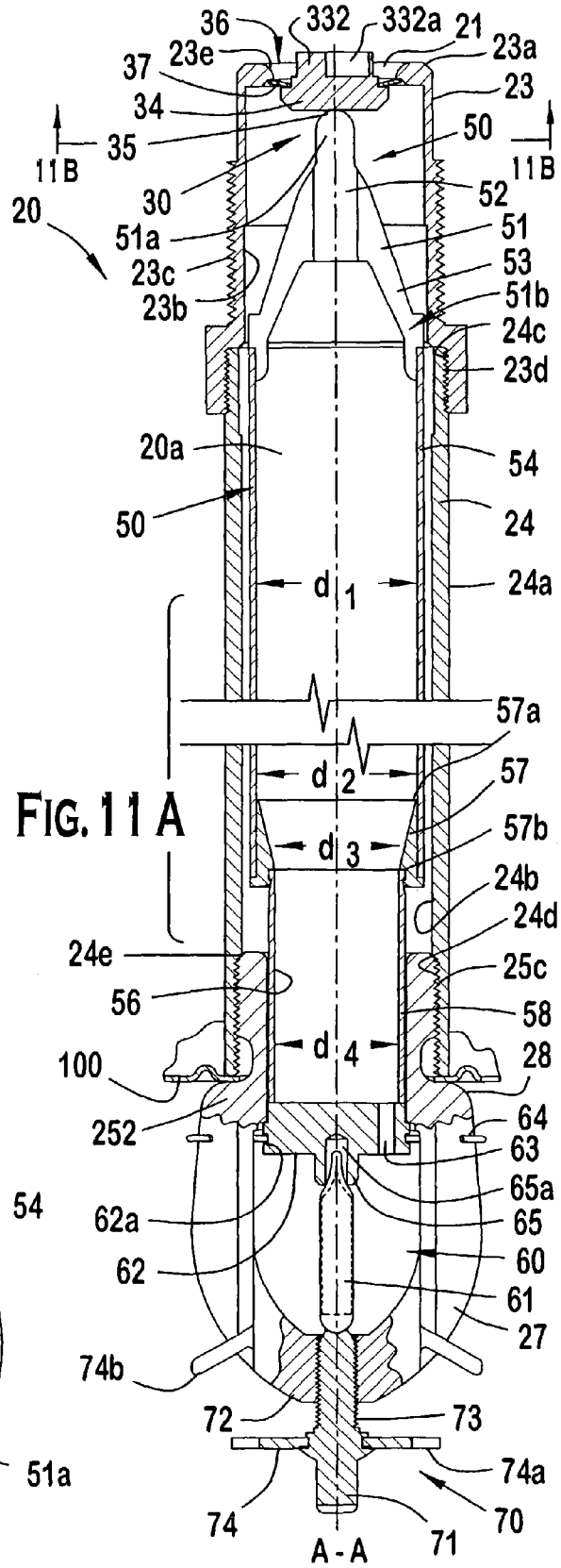
FIG. 11 A
FIG. 11 B
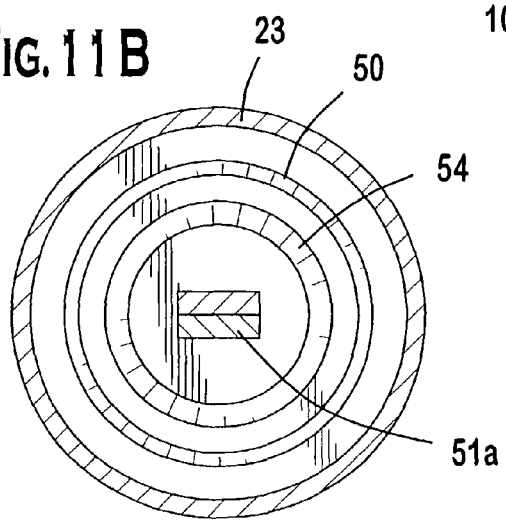

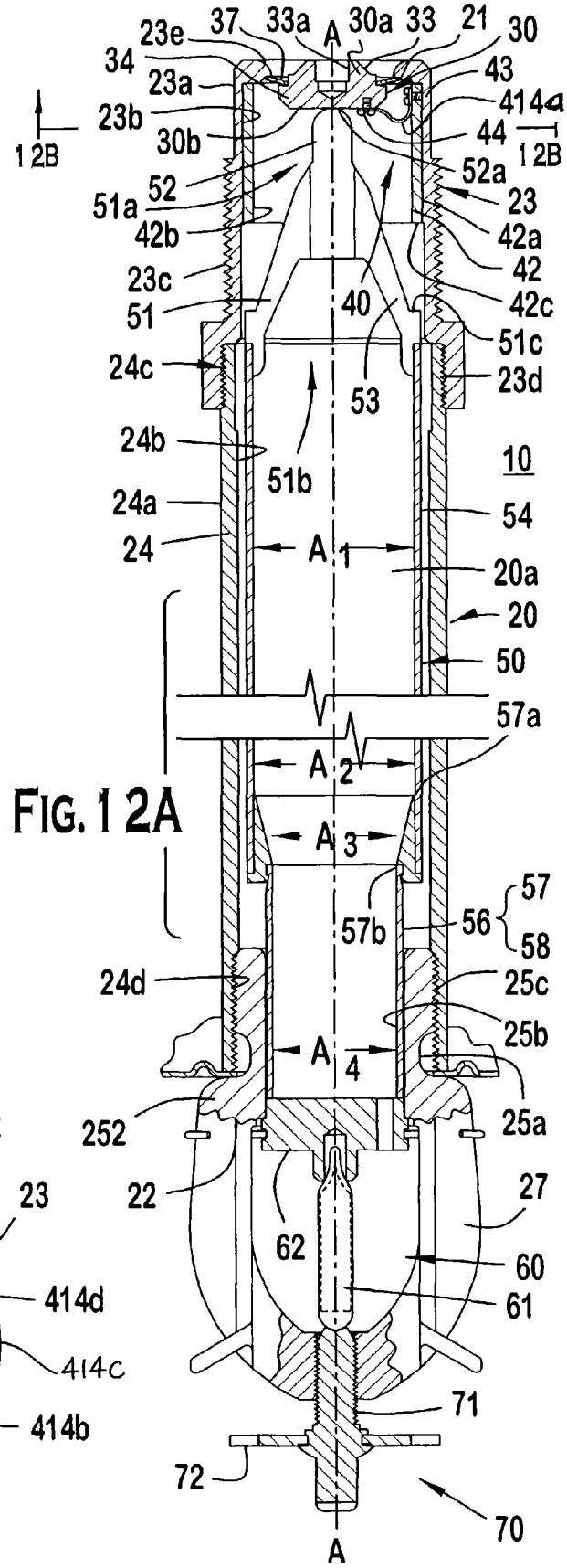
FIG. 12A
FIG. 12B
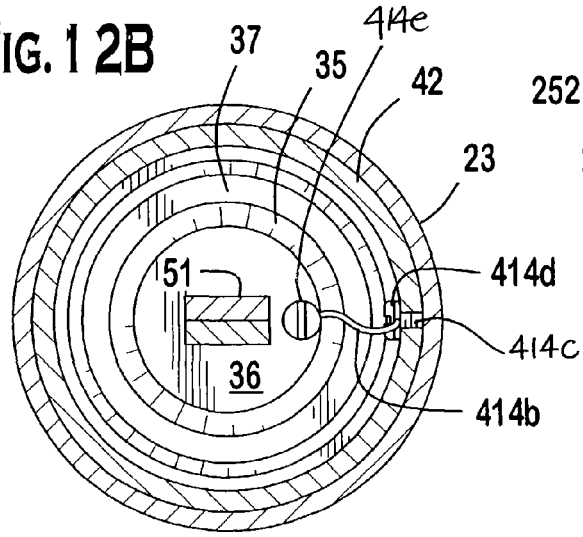

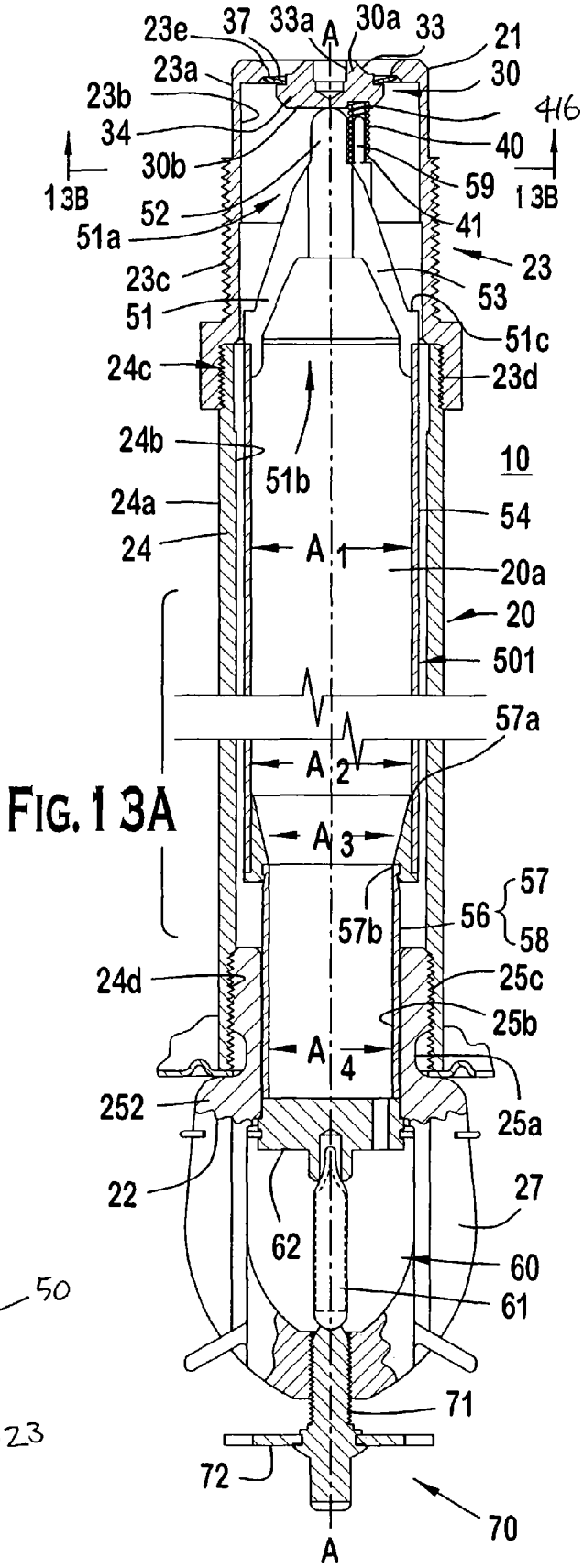
FIG. 13A
FIG. 13B
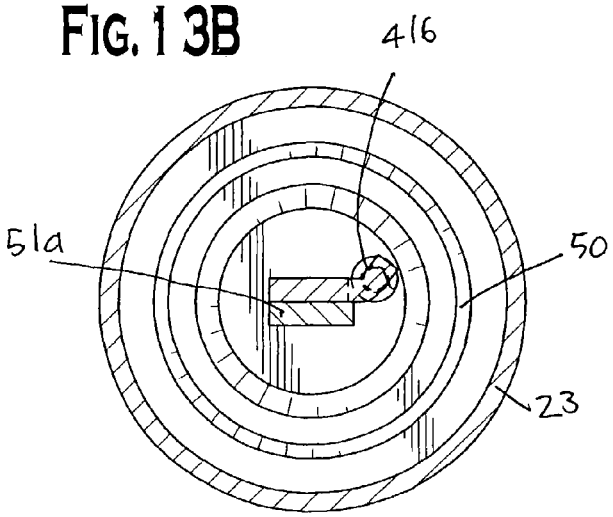

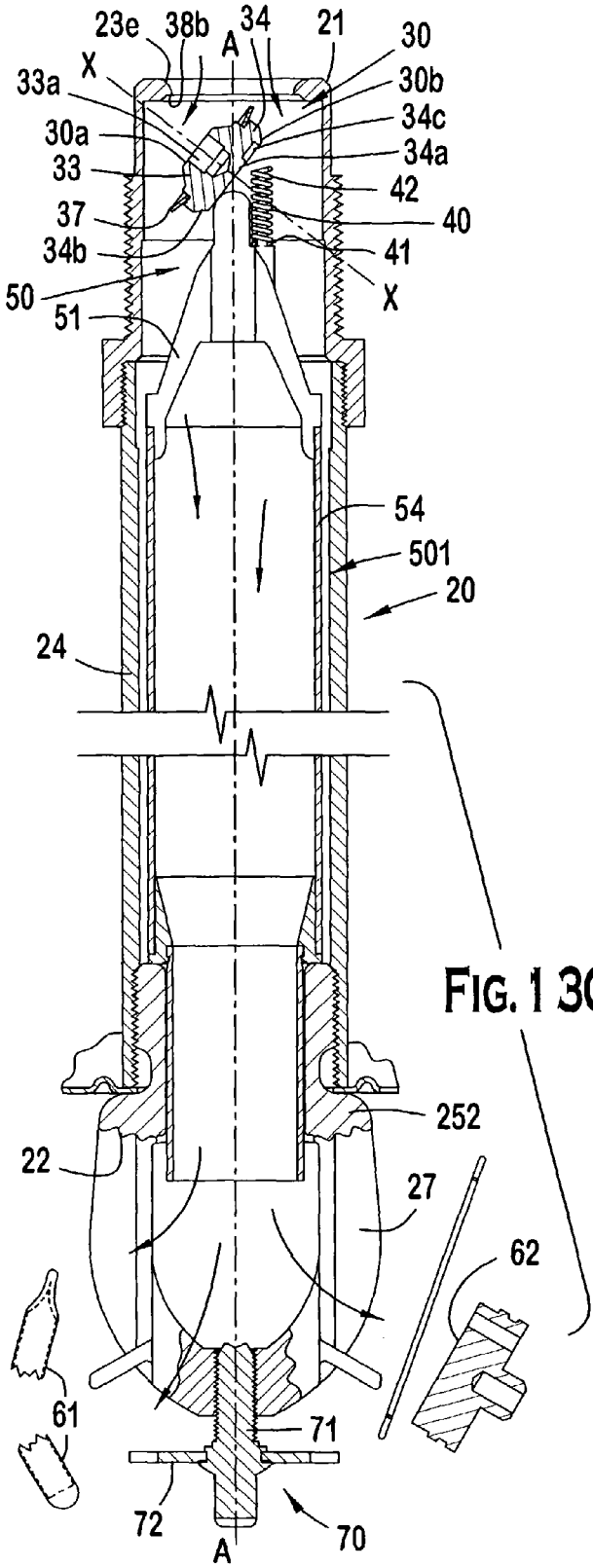
FIG. 13C
FIG. 13D
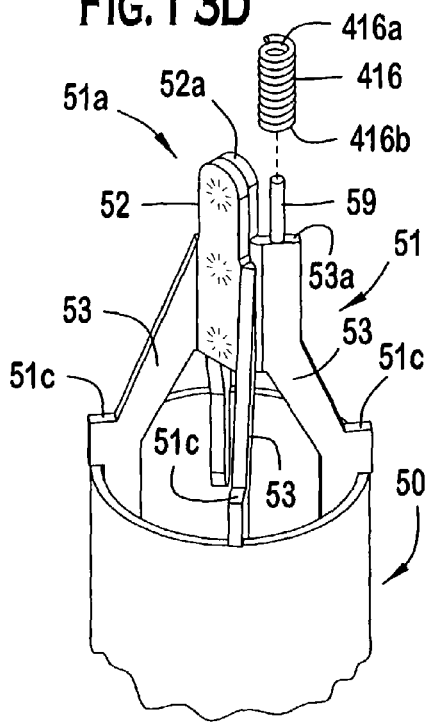
FIG. 13E
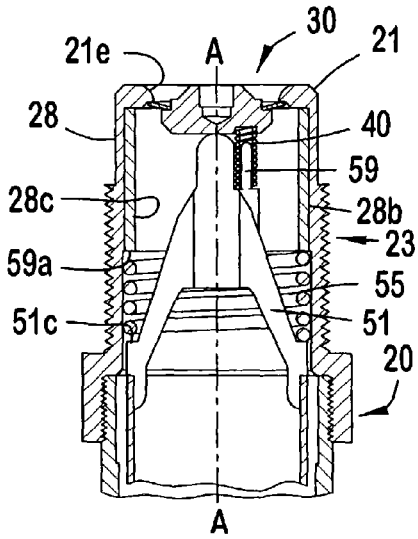

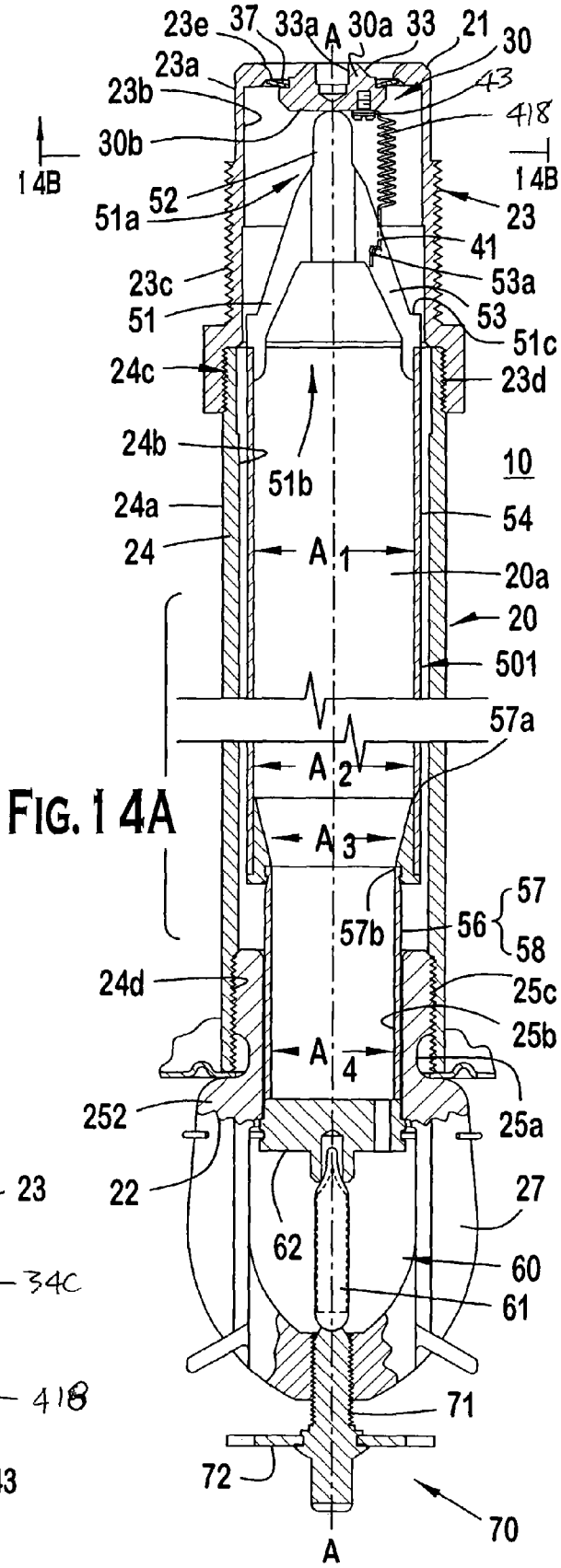
FIG. 14A
FIG. 14B
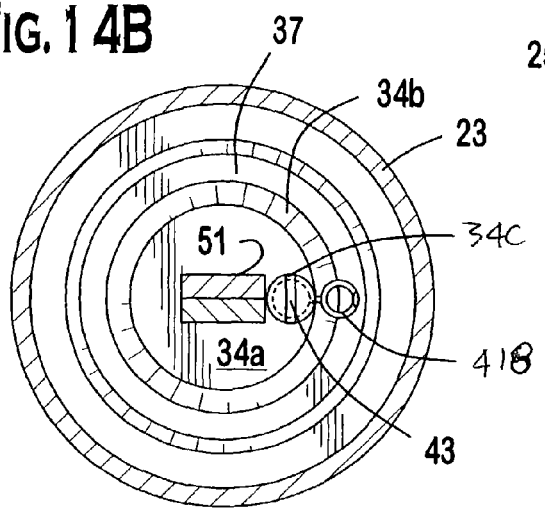

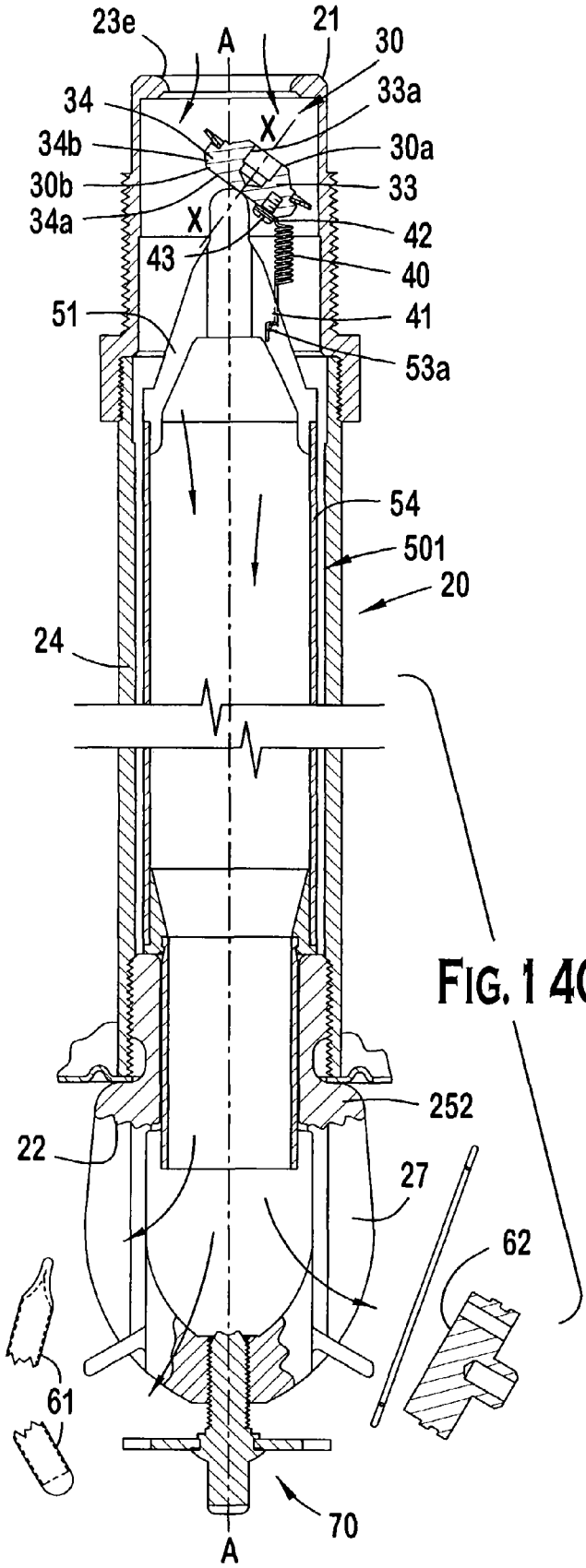
FIG. 14C
FIG. 14D
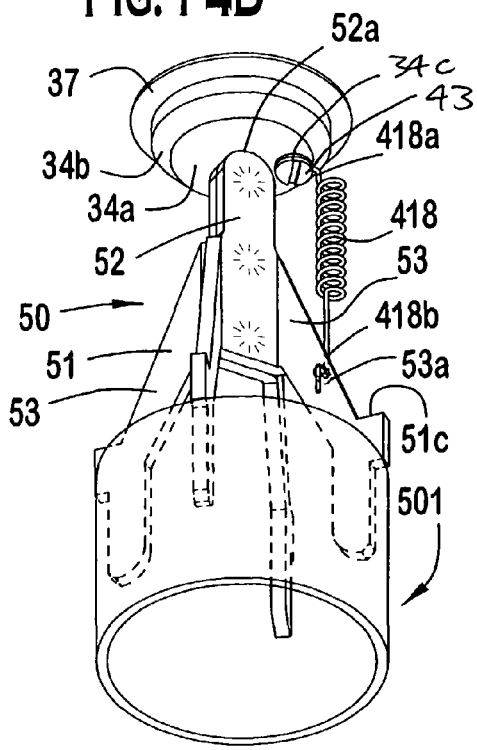
FIG. 14E
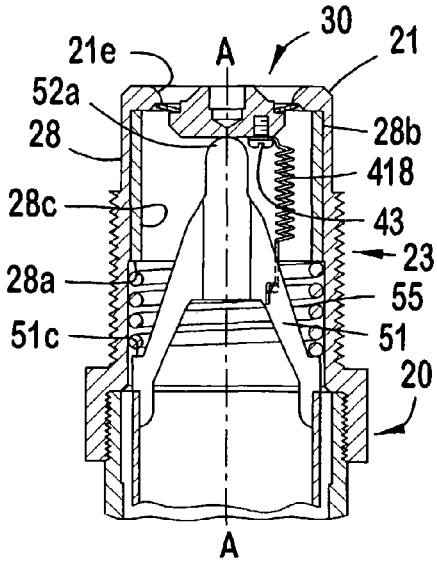

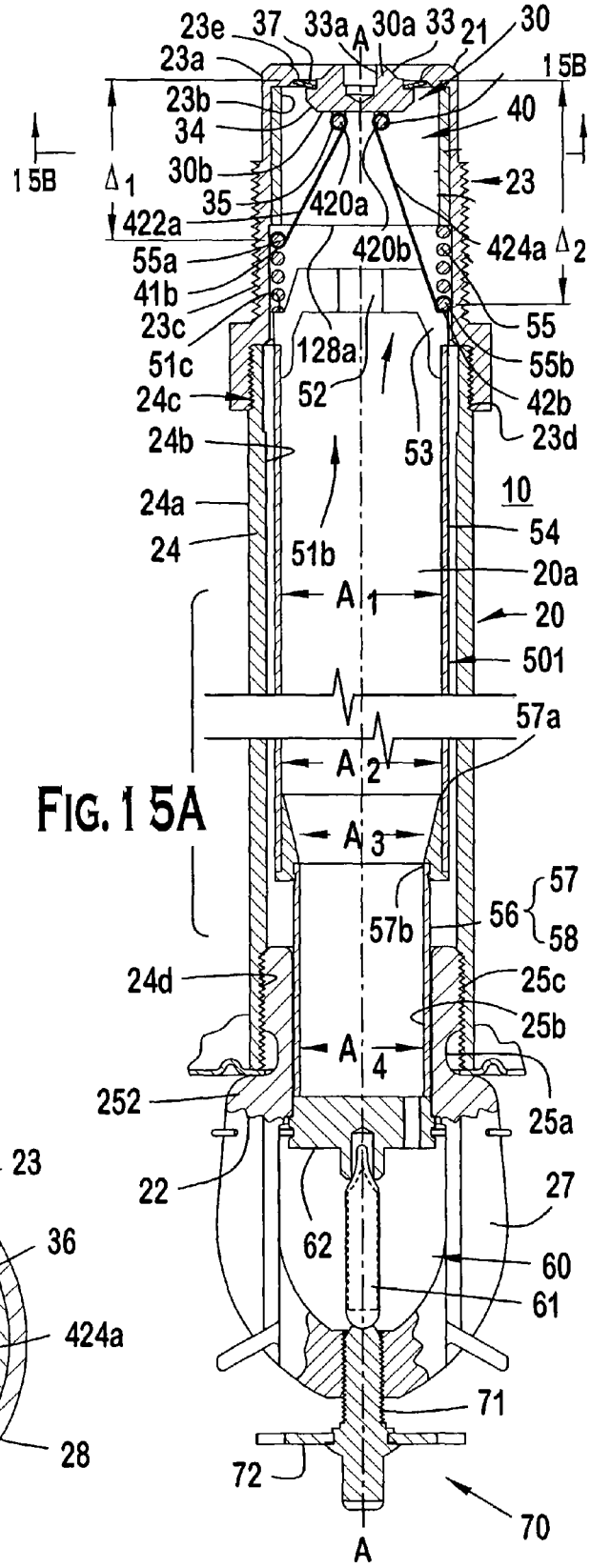
FIG. 15A
FIG. 15B
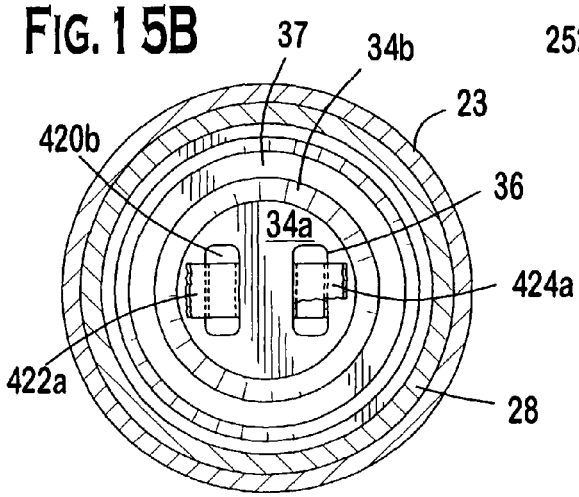

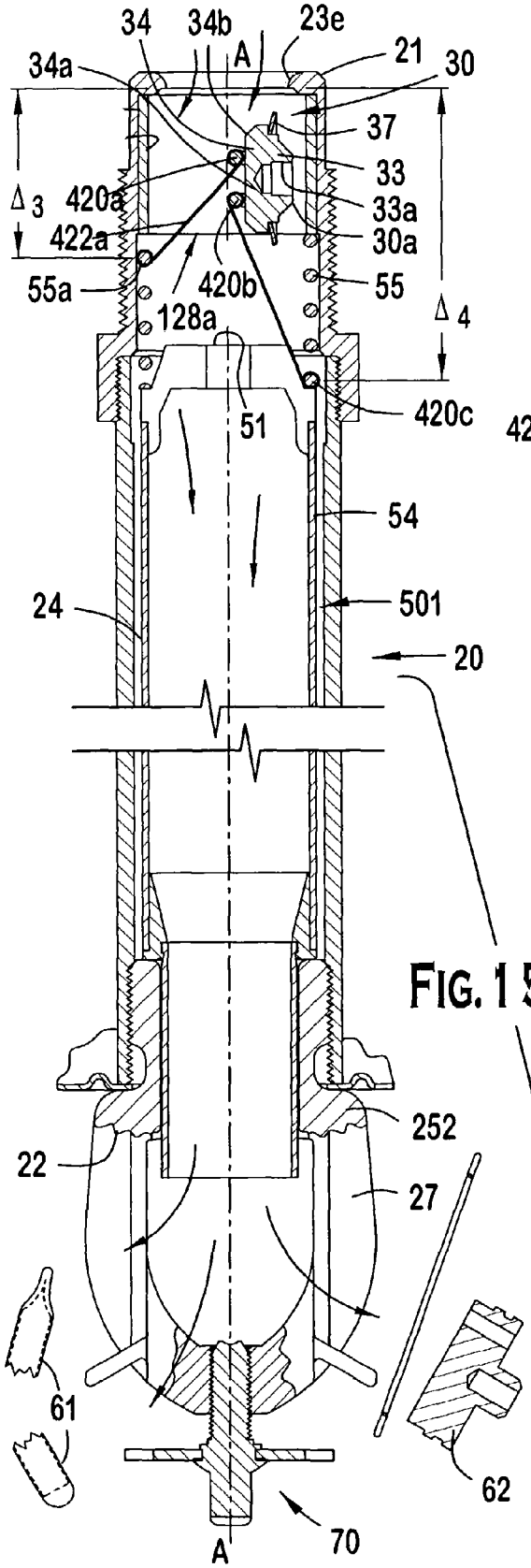
FIG. 15C
FIG. 15D
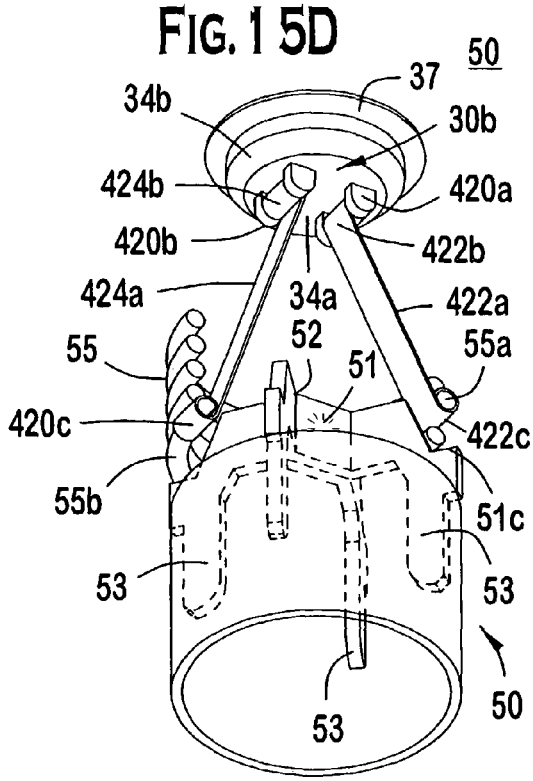
FIG. 15E
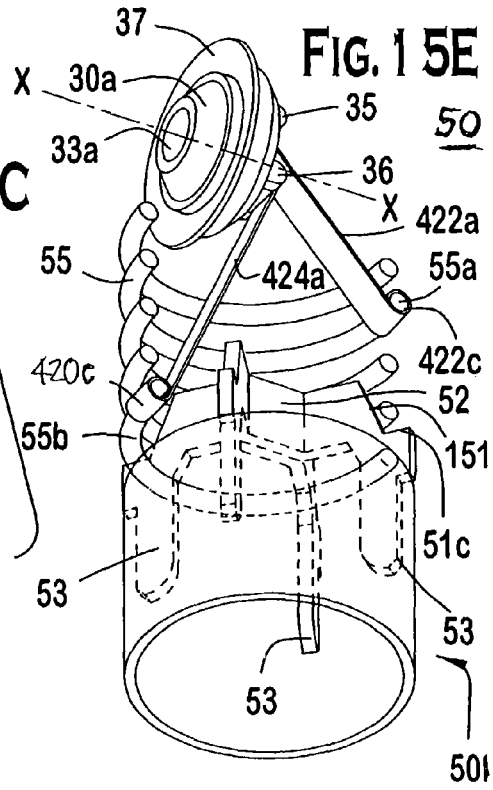

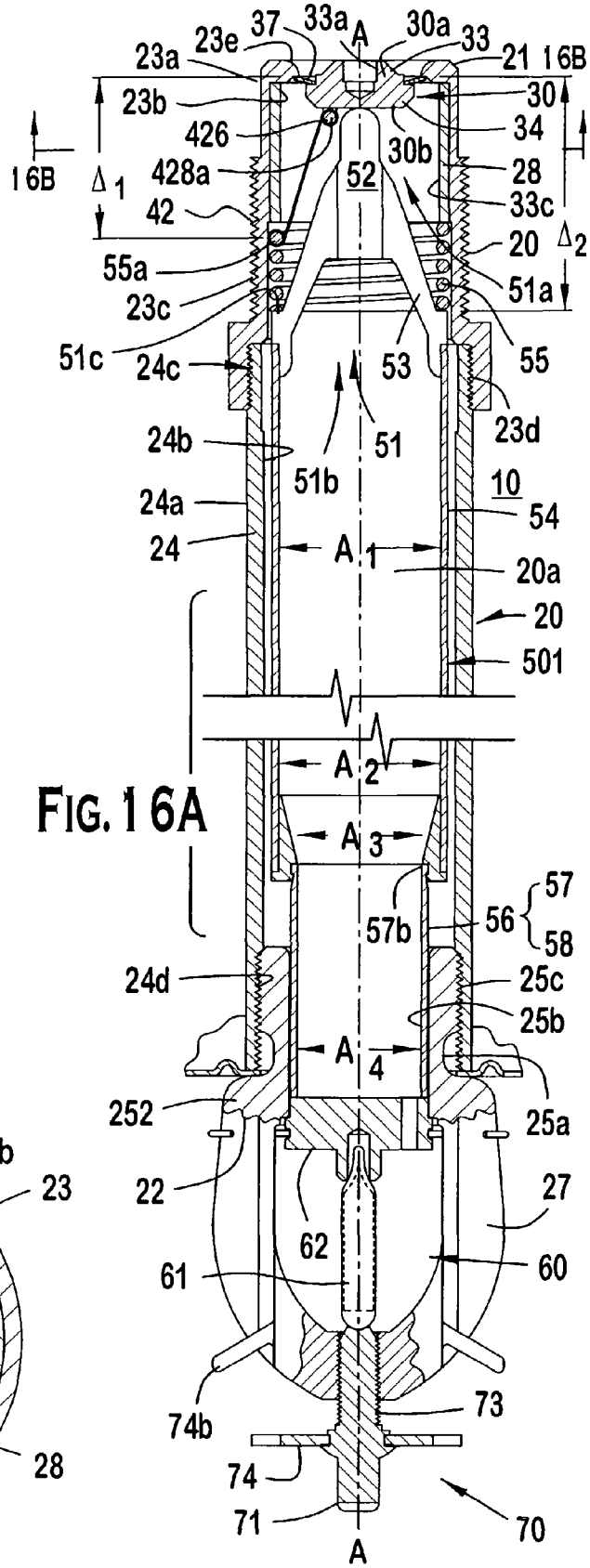
FIG. 16A
FIG. 16B
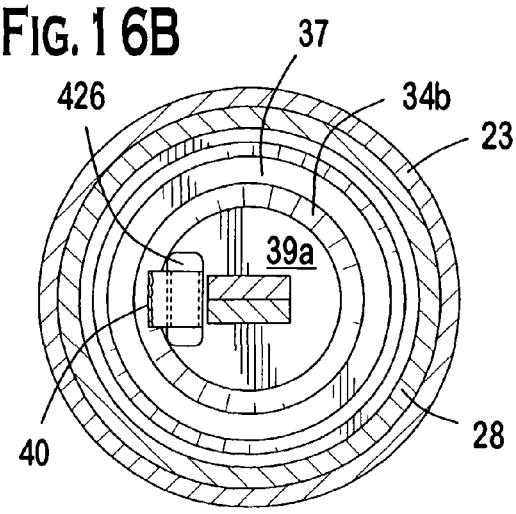

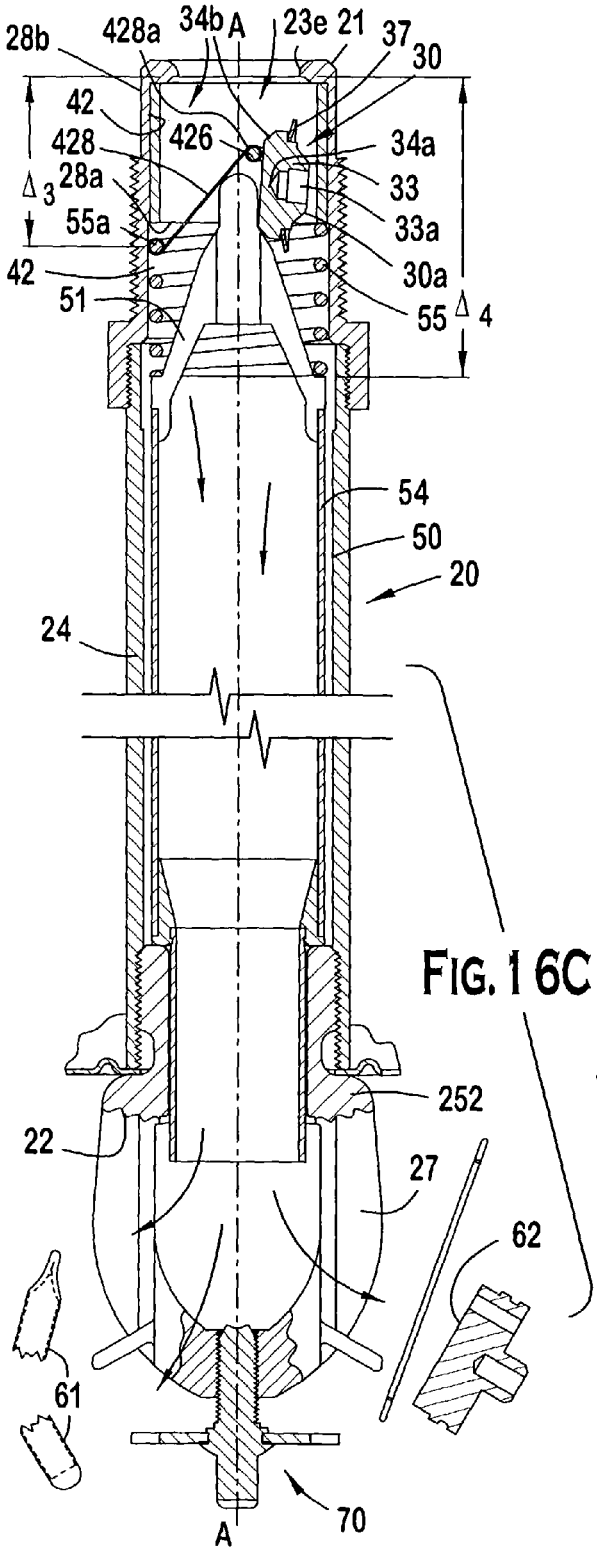
FIG. 16C
FIG. 16D
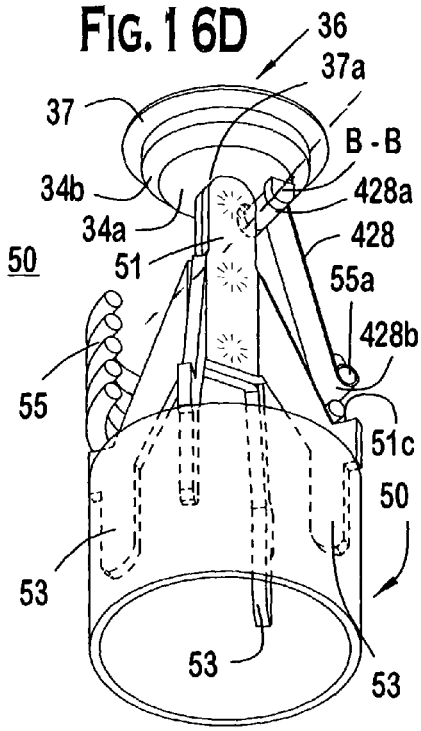
FIG. 16E
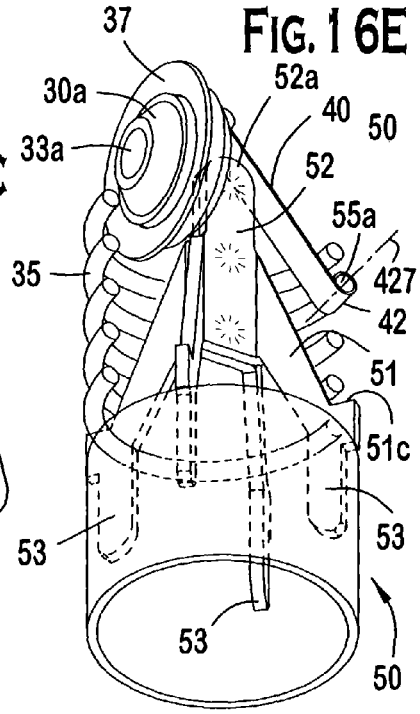

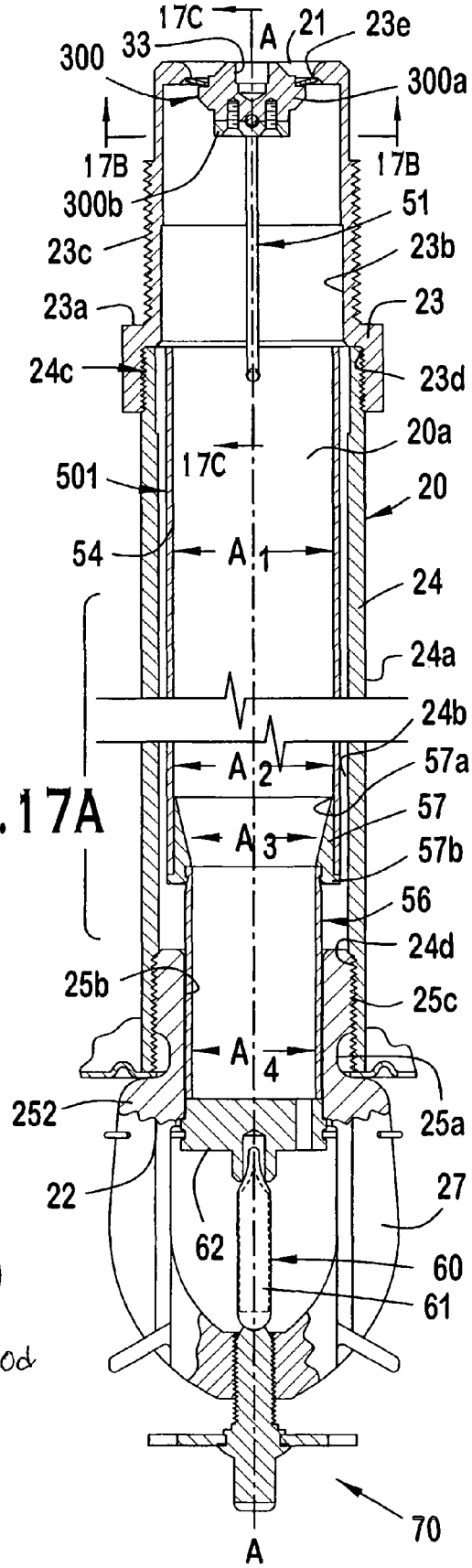
FIG. 17A
FIG. 17B
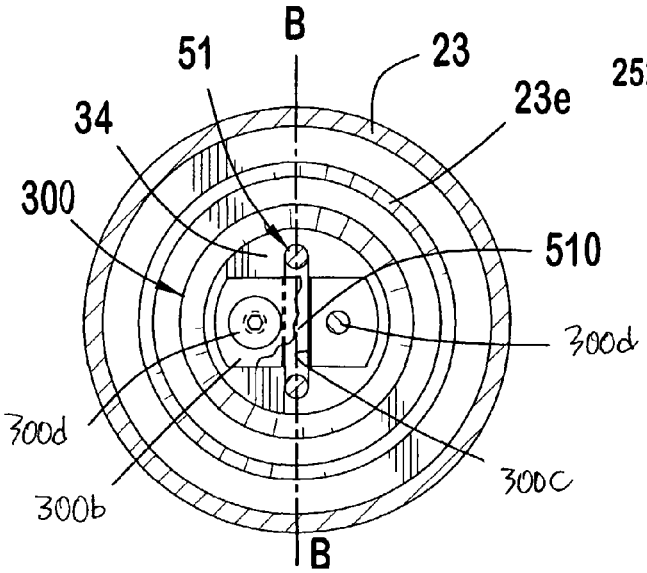

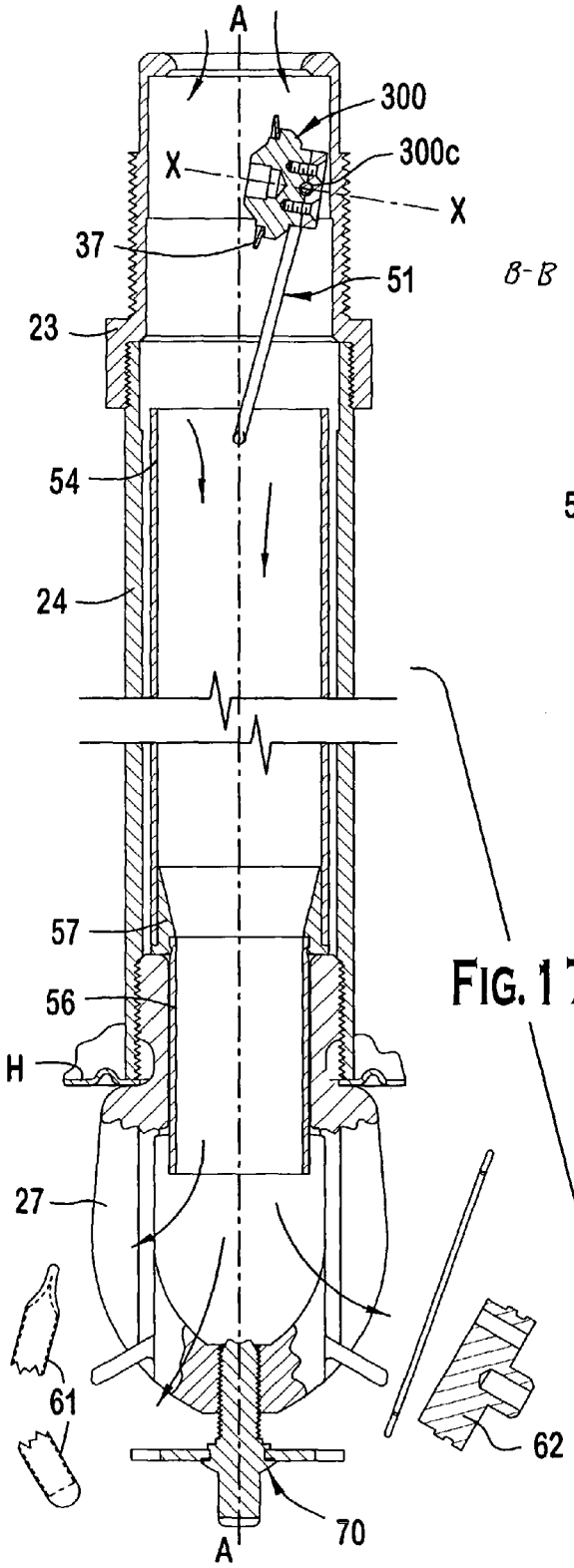
FIG. 17C
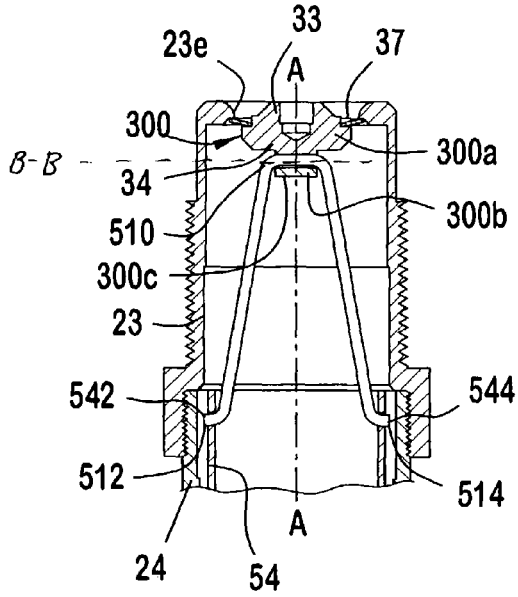
FIG. 17D
FIG. 17E
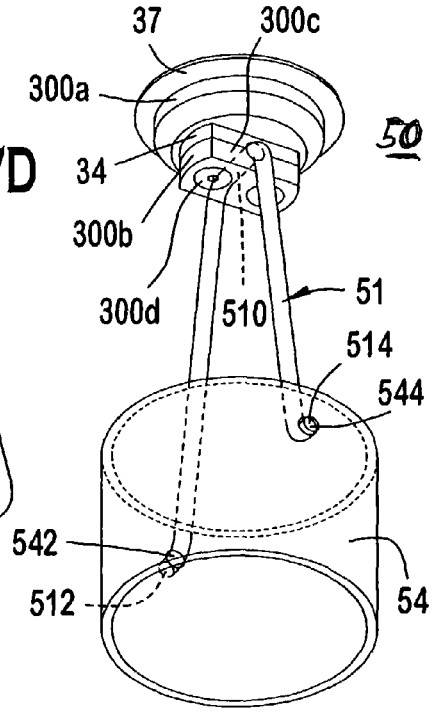

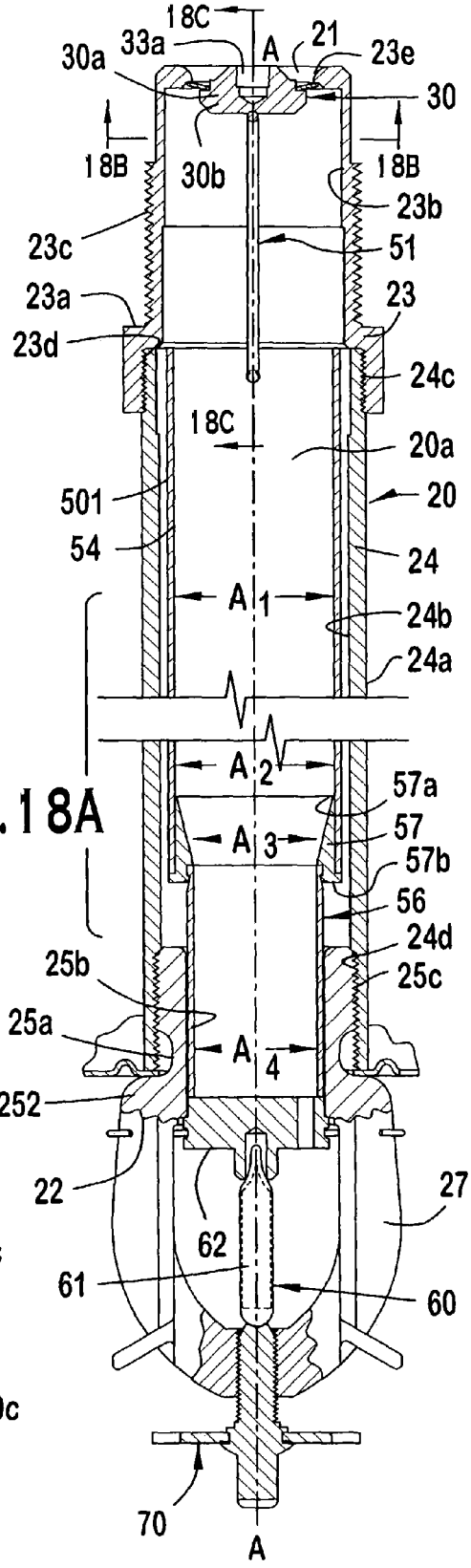
FIG. 18A
FIG. 18B
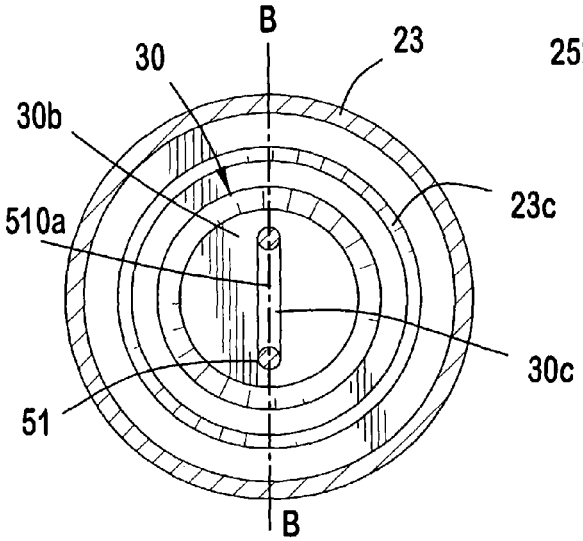

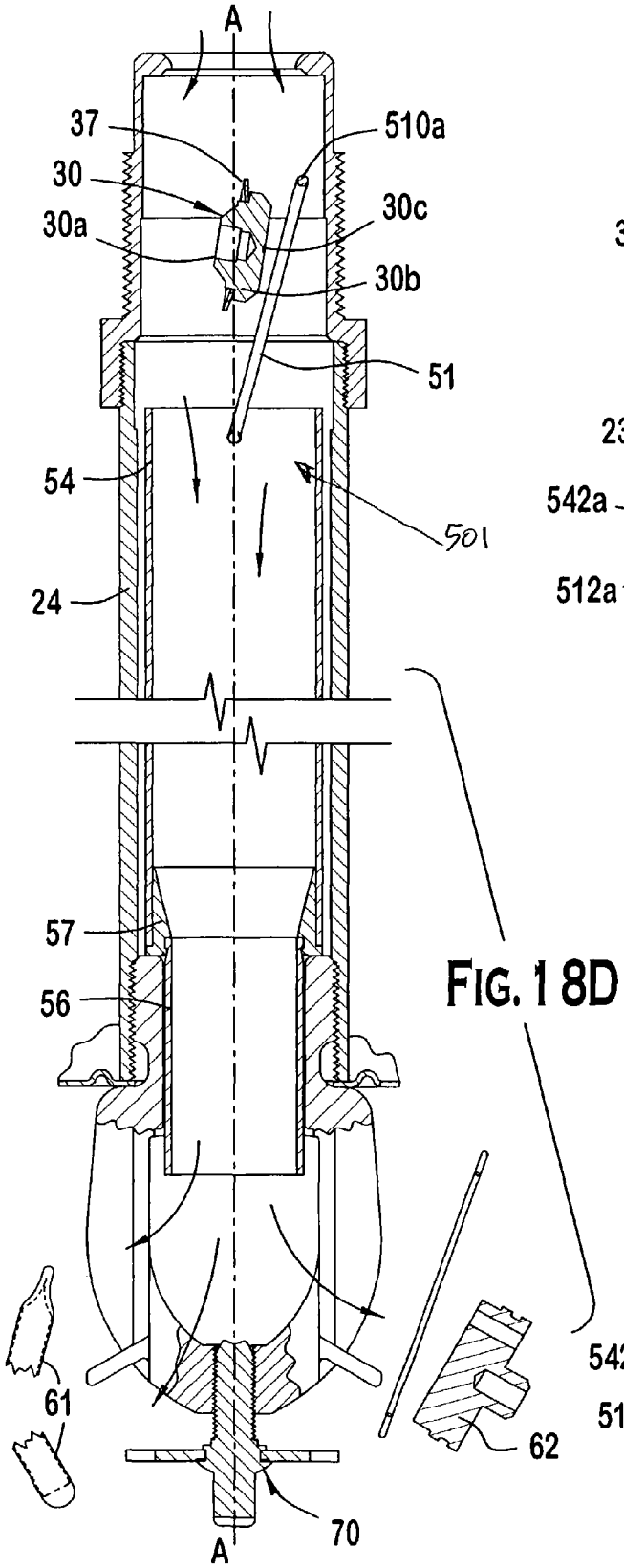
FIG. 18D
FIG. 18C
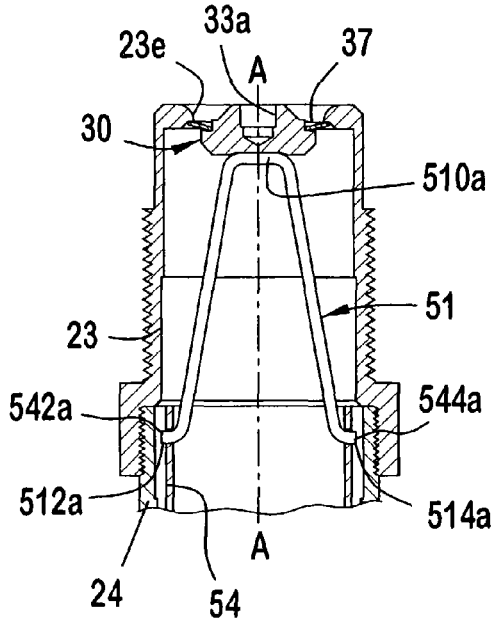
FIG. 18E
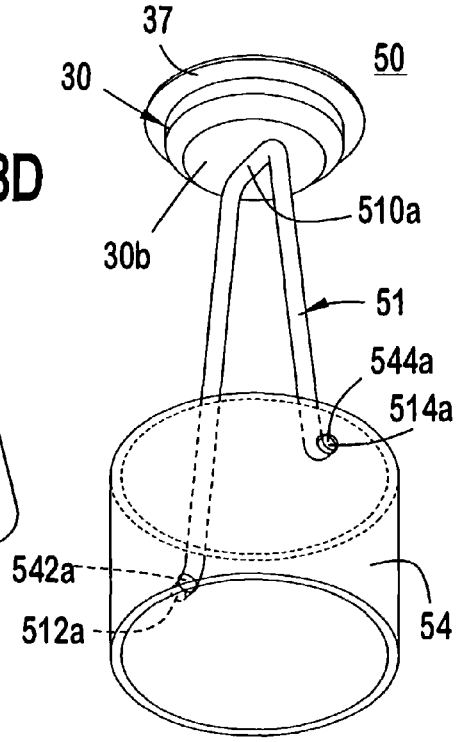

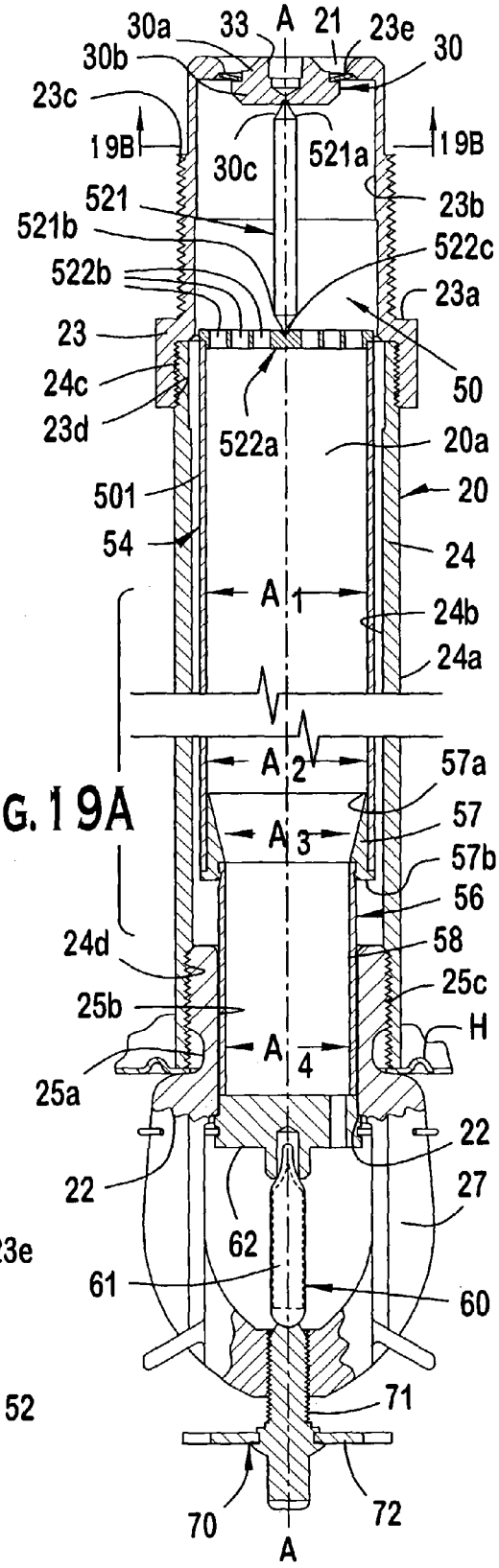
FIG. 19A
FIG. 19B
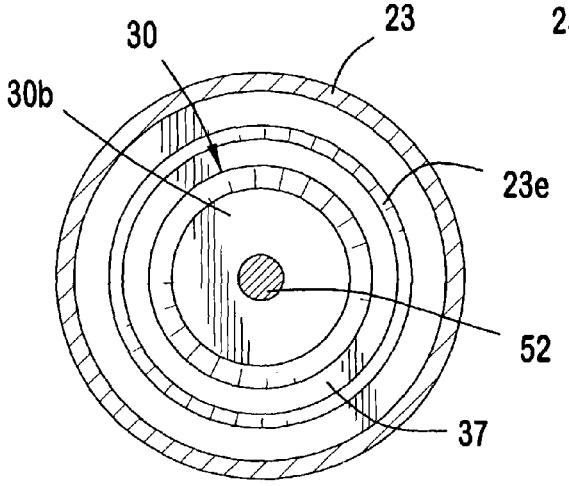

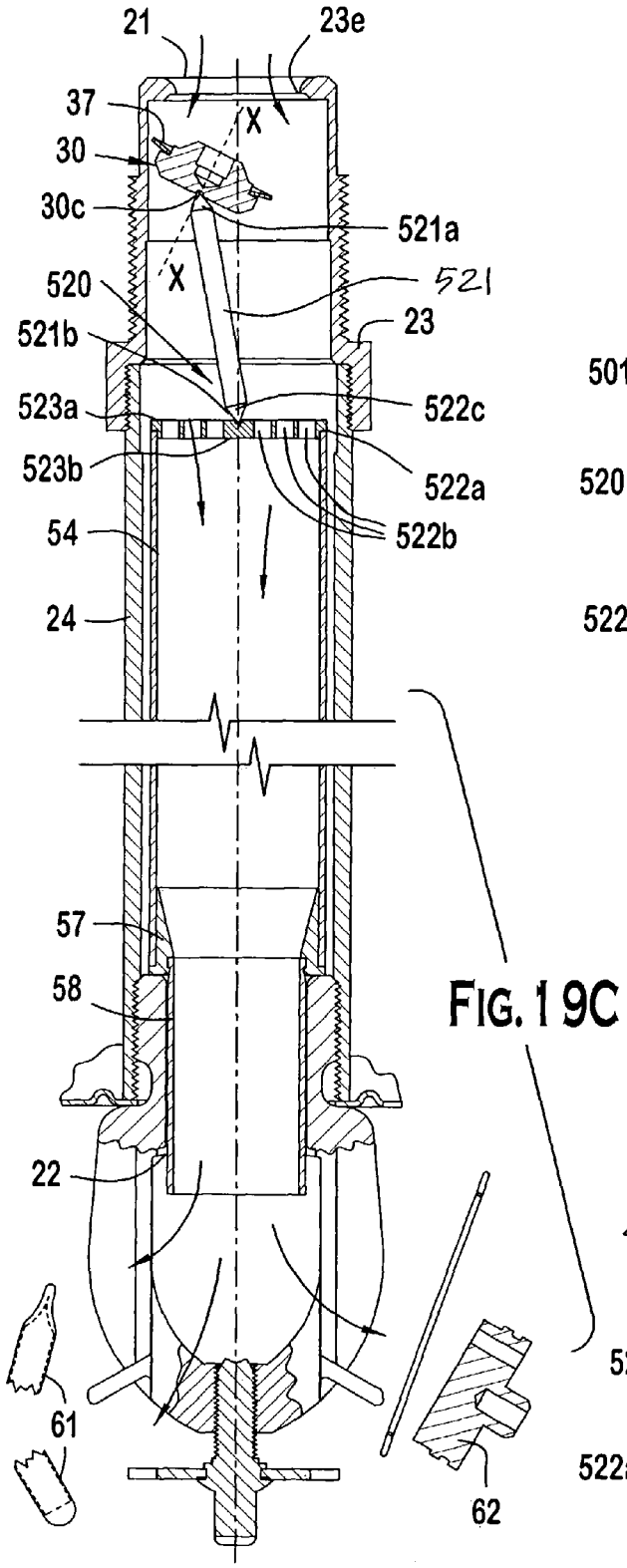
FIG. 19C
FIG. 19D
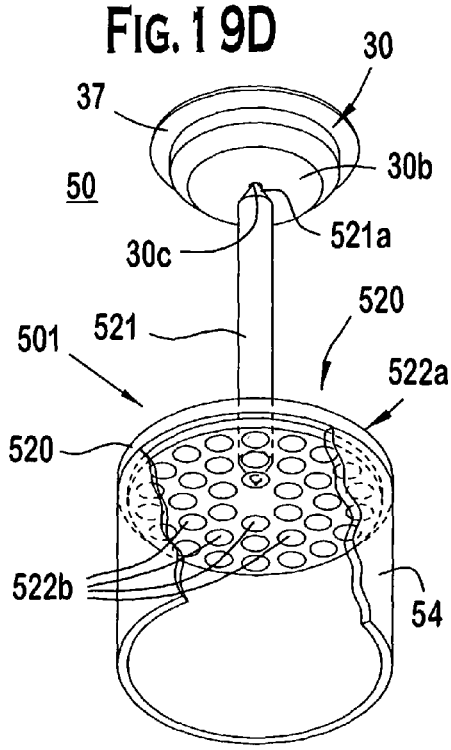
FIG. 19E
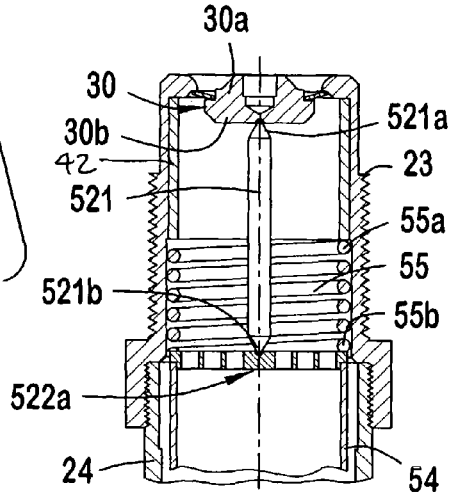

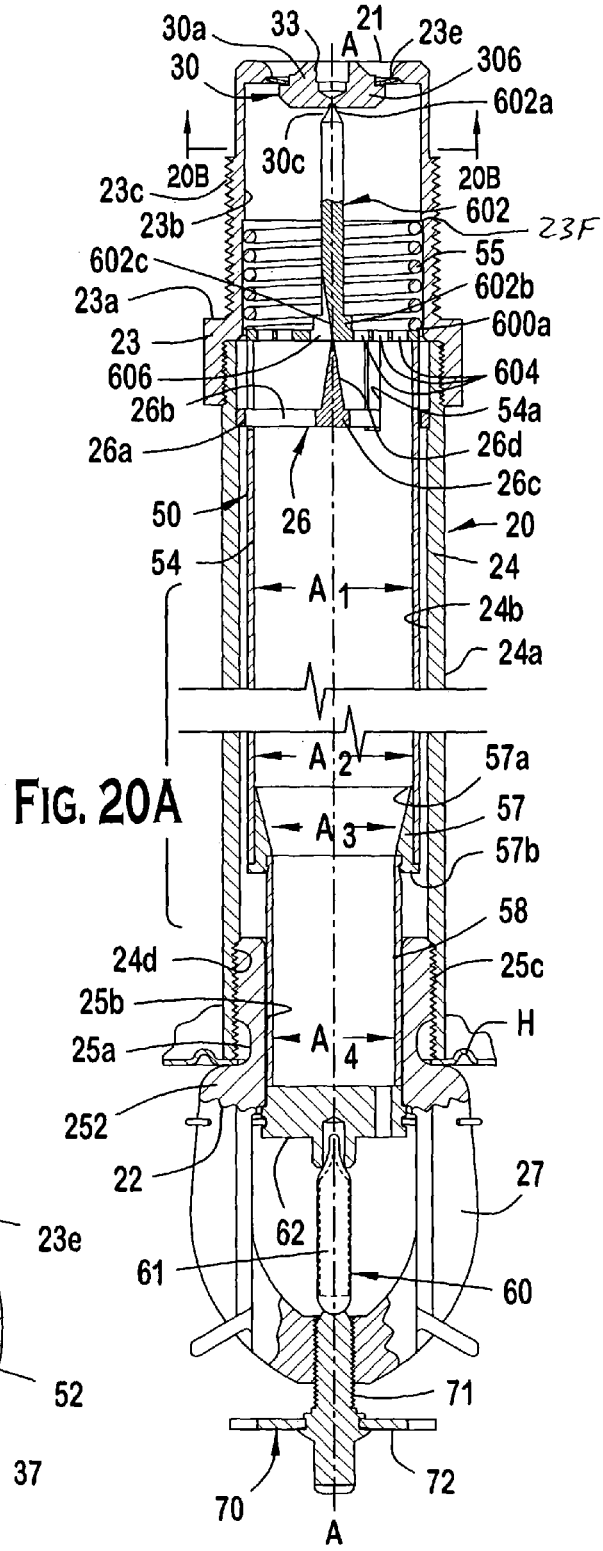
FIG. 20A
FIG. 20B
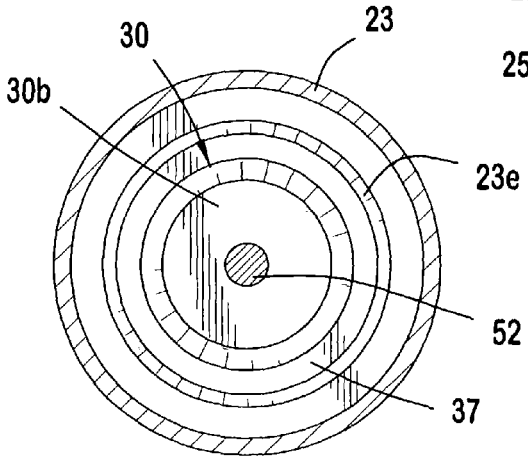

23e
21
30
602a
26d
602c
26a
26b
26c
54a
54
24
57
58
22
61
62
600a 606
600
604
600b
26d
26c
37
50
30
30c
30b
602a
602

600
604
606
600b
26a
26c
26b 602c
602a
30
33
602
30a
600a
602b
37
26b
26a
26c
54
54a

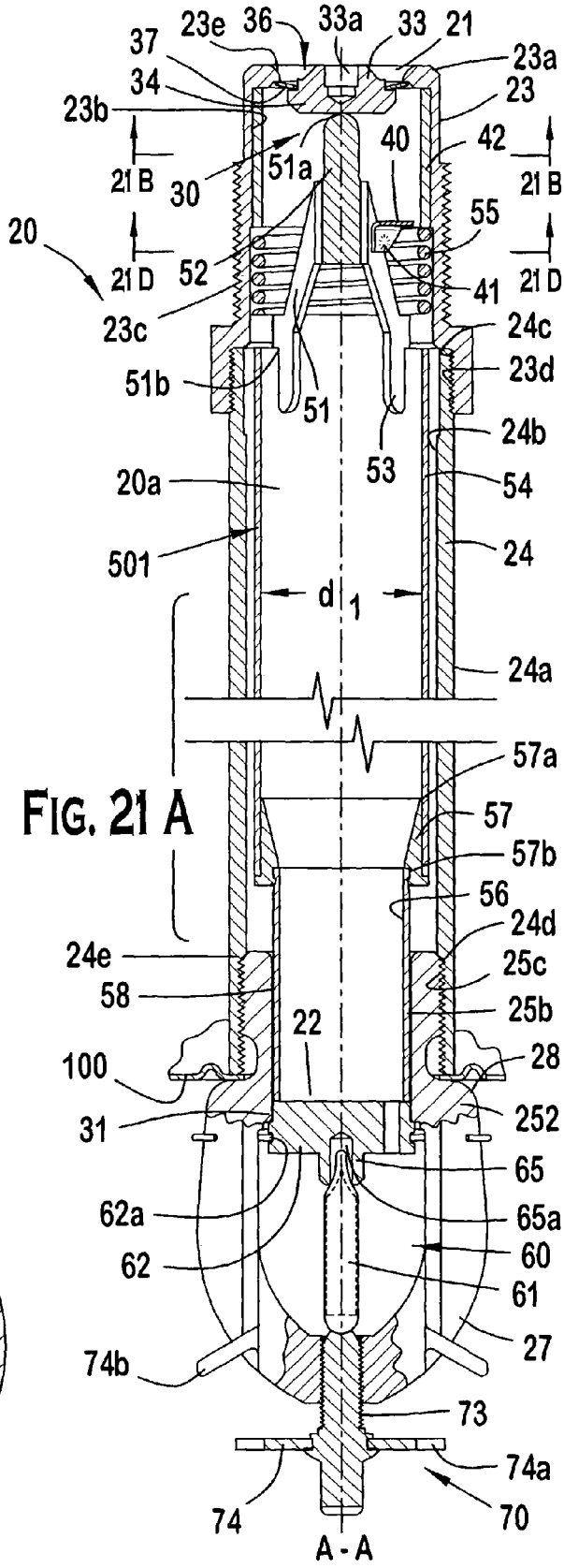
FIG. 21 A
FIG. 21 B
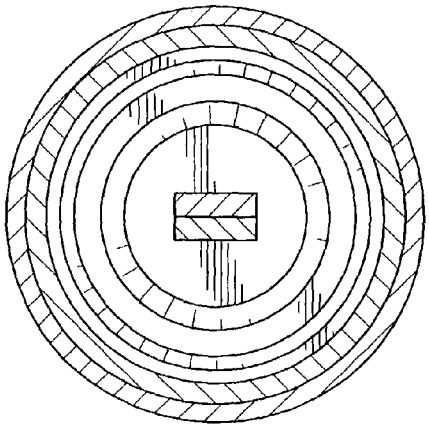

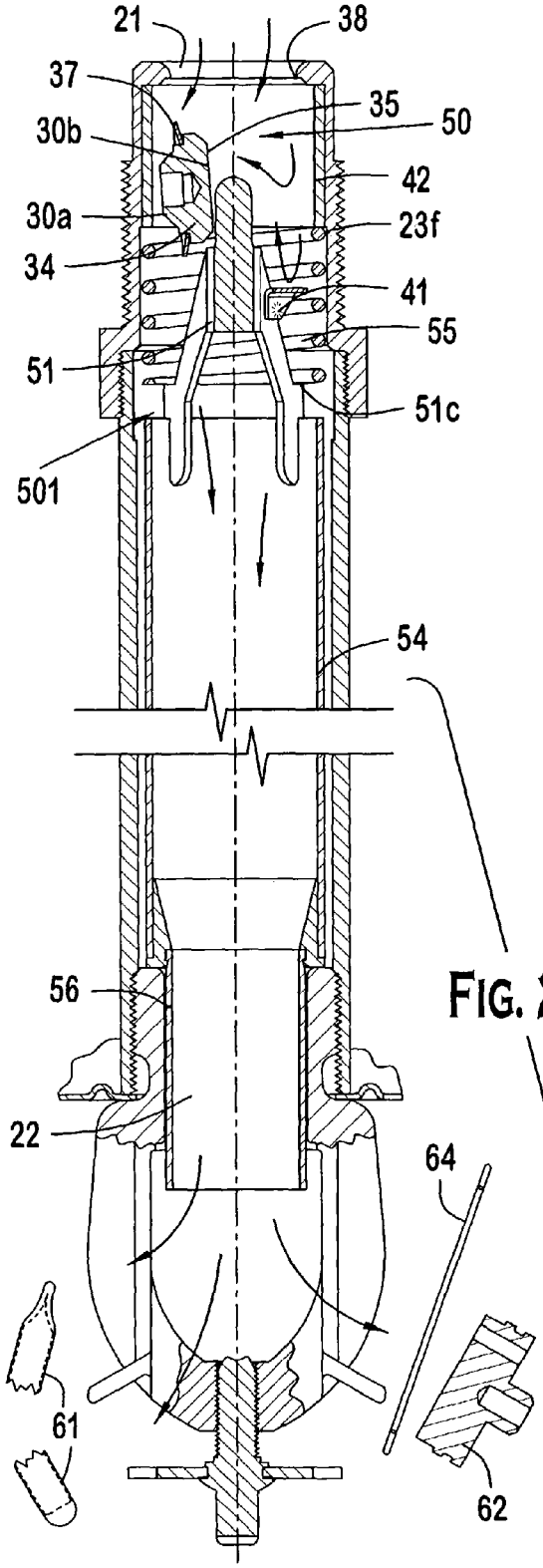
FIG. 21 C
FIG. 21 D
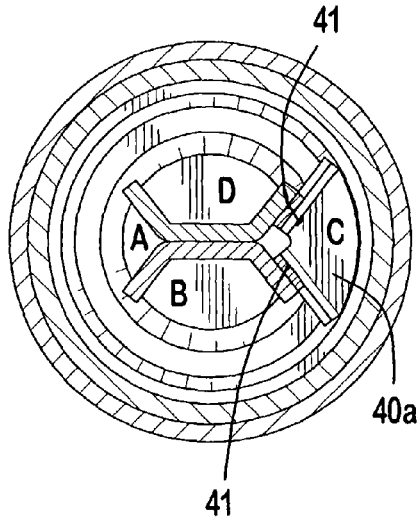
FIG. 21 E
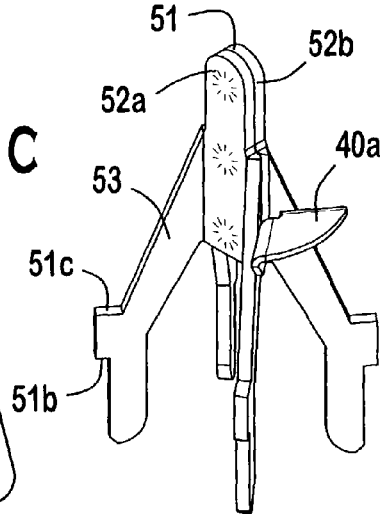

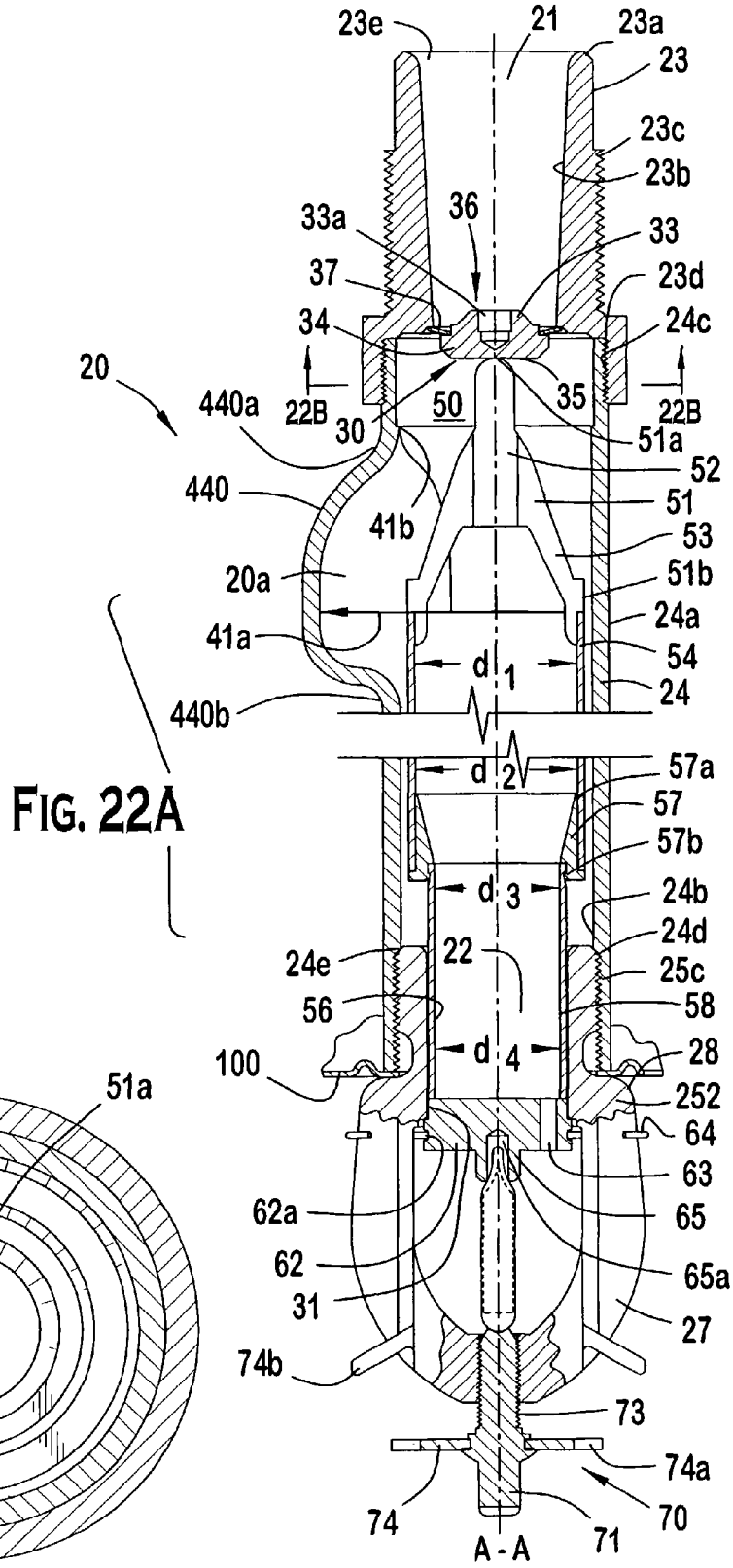
FIG. 22A
FIG. 22B
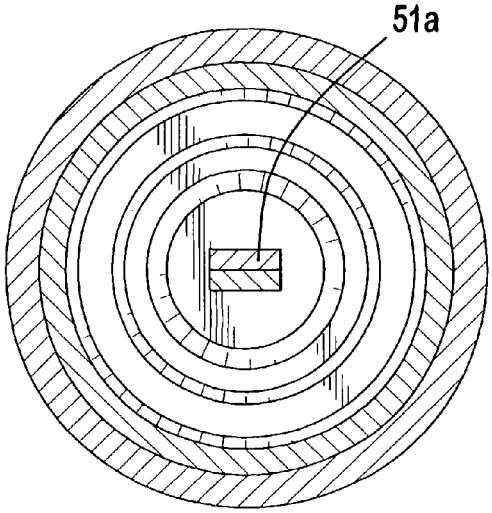

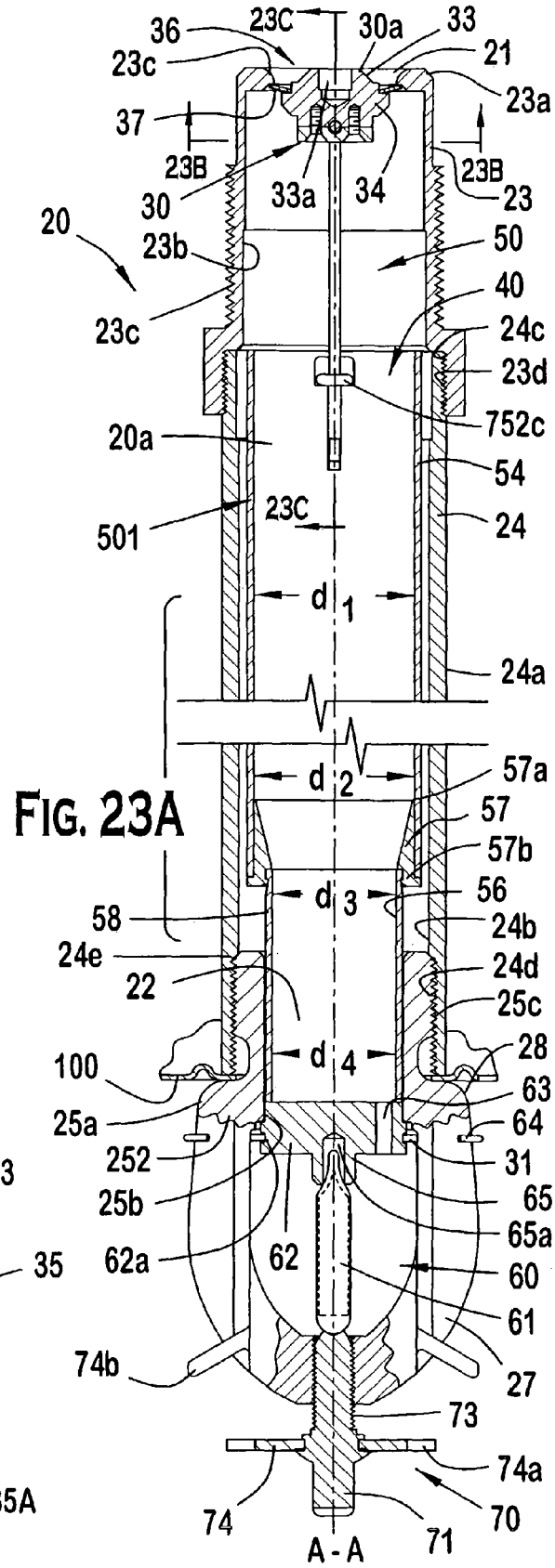
FIG. 23A
FIG. 23B
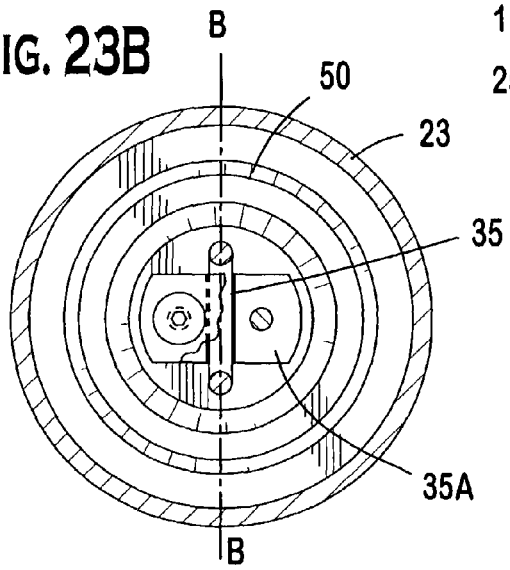

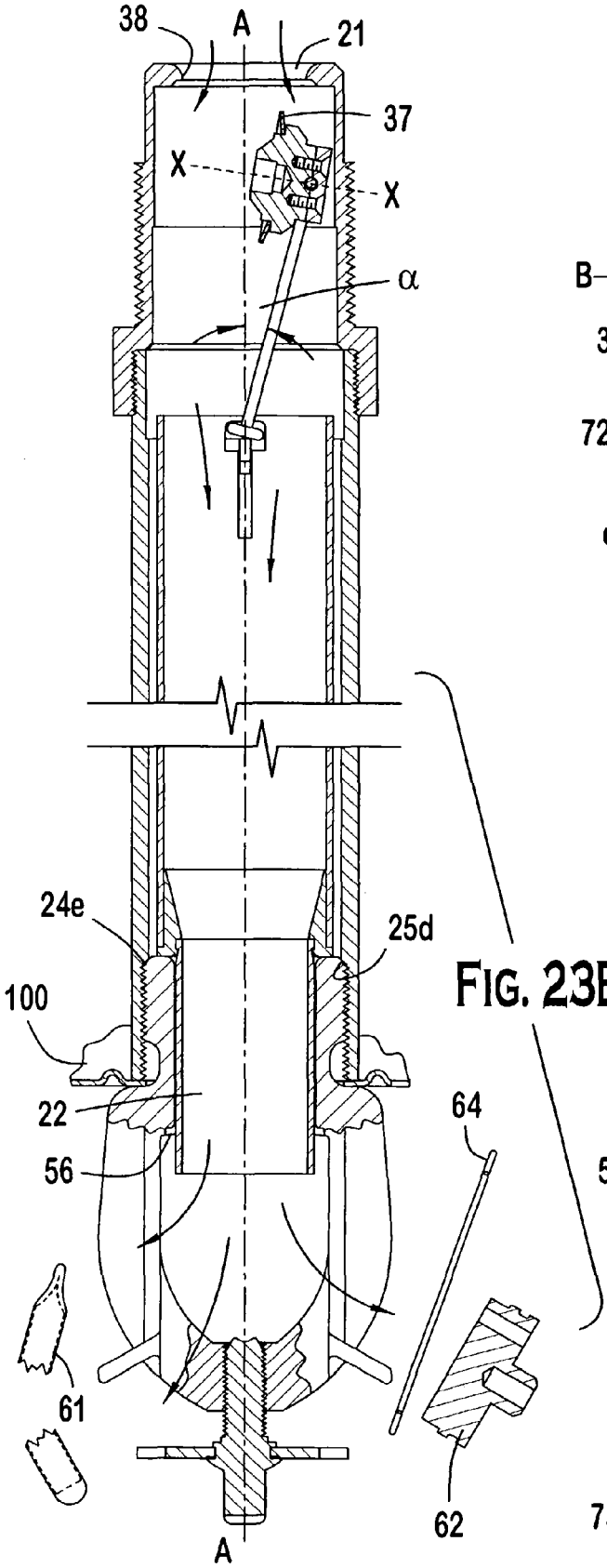
FIG. 23E
FIG. 23C
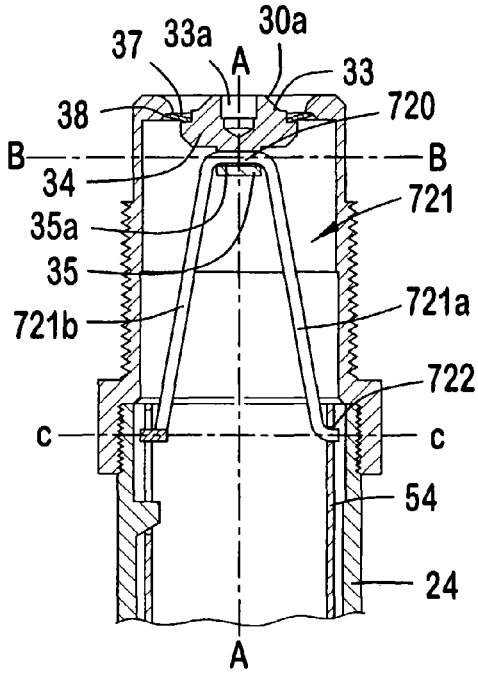
FIG. 23D
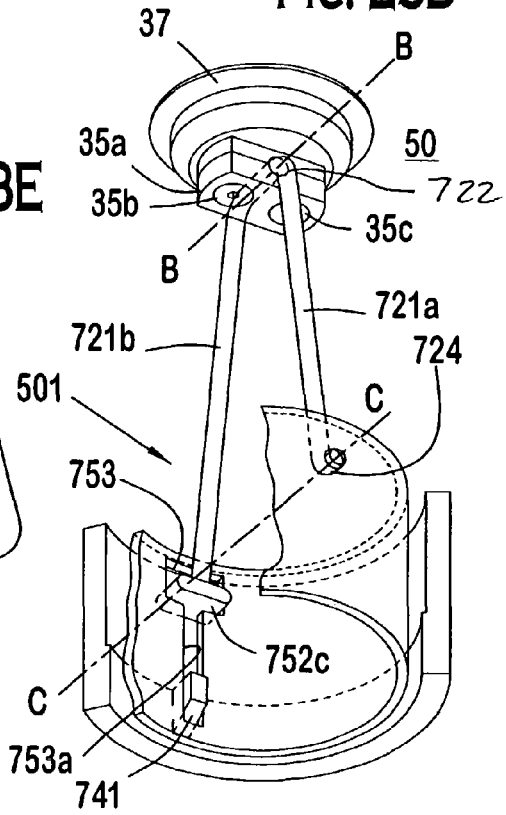

DRY SPRINKLER

PRIORITY

This application claims the benefits of priority under 35 U.S.C. § 119 of the following United States Provisional patent applications: Provisional Patent application Ser. No. 60/396,727 filed on 19 Jul. 2002, entitled, Dry Sprinkler; Provisional Patent application Ser. No. 60/427,214 filed on 19 Nov. 2002, entitled Dry Sprinkler With a Contact Member to Assist Movement of a Closure Member; Provisional Patent application Ser. No. 60/432,998 filed on 13 Dec. 2002, entitled Dry Sprinkler With a Contact Member to Assist Rotation of a Closure Assembly; Provisional Patent application Ser. No. 60/432,995 filed on 13 Dec. 2002, entitled Dry Sprinkler With a Contact Bar to Assist Rotation of a Closure Assembly; Provisional Patent application Ser. No. 60/432,996 filed on 13 Dec. 2002, entitled Dry Sprinkler with Bearing to Assist Rotation of a Closure Assembly; Provisional Patent application Ser. No. 60/433,611 filed on 13 Dec. 2002, entitled Dry Sprinkler With Resilient C-clip to Assist Rotation of a Closure Assembly; Provisional Patent application Ser. No. 60/432,999 filed on 13 Dec. 2002, entitled Dry Sprinkler With an Offset Contact Edge to Assist Rotation of a Closure Assembly; Provisional Patent application Ser. No. 60/433,582, filed on 13 Dec. 2002, entitled Dry Sprinkler With a Closure Assembly Having a Separable Seal; Provisional Patent application Ser. No. 60/432,997 filed on 13 Dec. 2002, entitled Dry Sprinkler With a Rolling Contact Member to Assist Rotation of a Closure Assembly; Provisional Patent application Ser. No. 60/432,984 filed on 13 Dec. 2002, entitled Dry Sprinkler With a Closure Assembly Having a High Center of Gravity to Assist Rotation of the Closure Assembly; Provisional Patent application Ser. No. 60/432,985 filed on 13 Dec. 2002, entitled Dry Sprinkler With a Closure Assembly Having an Off-Set High Center of Gravity to Assist Rotation of the Closure Assembly; Provisional Patent application Ser. No. 60/432,983 filed on 13 Dec. 2002, entitled Dry Sprinkler With a Cord to Assist Movement of A Closure Assembly; Provisional Patent application Ser. No. 60/432,982 filed on 13 Dec. 2002, entitled Dry Sprinkler With a Compression Spring to Assist Movement of a Closure Assembly; Provisional Patent application Ser. No. 60/433,001 filed on 13 Dec. 2002, entitled Dry Sprinkler With a Tension Spring to Assist Movement of a Closure Assembly; Provisional Patent application Ser. No. 60/433,004 filed on 13 Dec. 2002, entitled Dry Sprinkler With a Strap Assembly to Assist Movement of a Closure Assembly; Provisional Patent application Ser. No. 60/433,002 filed on 13 Dec. 2002, entitled Dry Sprinkler With a Strap to Assist Rotation of a Closure Assembly; Provisional Patent application Ser. No. 60/433,003 filed on 13 Dec. 2002, entitled Dry Sprinkler with a Pivotal Fixed Leg Member to Assist Rotation of a Closure Assembly; Provisional Patent Application Ser. No. 60/432,994 filed on 13 Dec. 2002, entitled A Dry Sprinkler With A Pivotal Non-Fixed Leg Member To Assist Rotation Of A Closure Assembly; Provisional Patent application Ser. No. 60/433,610 filed on 16 Dec. 2002, entitled Dry Sprinkler with a Pivotal Member to Assist Rotation of a Closure Assembly; Provisional Patent application Ser. No. 60/433,599 filed on 16 Dec. 2002, entitled Dry Sprinkler With a Kicker to Assist Rotation of a Closure Assembly; Provisional Patent application Ser. No. 60/433,605 filed on 16 Dec. 2002, entitled Dry Sprinkler with a Flow Obstruction Member to Assist Rotation of the Closure Assembly; Provisional Patent application Ser. No. 60/433,612 filed on 16 Dec. 2002, entitled Dry Sprinkler with an Offset Flow Path to Assist Rotation of the Closure Assembly; and Provisional Patent application Ser. No. 60/433,005 filed on 13 Dec. 2002, entitled Dry Sprinkler with a Movable Seal and Kicker to Assist Rotation of a Closure Assembly, which Provisional patent applications are incorporated by reference in their entireties into this application.

BACKGROUND OF THE INVENTION

An automatic sprinkler system is one of the most widely used devices for fire protection. These systems have sprinklers that are activated once the ambient temperature in an environment, such as a room or building exceeds a predetermined value. Once activated, the sprinklers distribute fire-extinguishing fluid, preferably water, in the room or building. A sprinkler system is considered effective if it extinguishes or prevents growth of a fire. Failures of such systems may occur when the system has been rendered inoperative during building alternation or disuse, or the occupancy hazard has been increased beyond initial system capability.

The water supply for a sprinkler system may be separate from that used by a fire department. An underground main for the sprinkler system enters the building to supply a riser. Connected at the riser are valves, meters, and, preferably, an alarm to sound when water flow within the system exceeds a predetermined minimum. At the top of a vertical riser, a horizontally disposed array of pipes extends throughout the fire compartment in the building. Other risers may feed distribution networks to systems in adjacent fire compartments. Compartmentalization can divide a large building horizontally, on a single floor, and, vertically, floor to floor. Thus, several sprinkler systems may serve one building.

In the piping distribution network, branch lines carry the sprinklers. A sprinkler may extend up from a branch line, placing the sprinkler relatively close to the ceiling, or a sprinkler can be pendant below the branch line. For use with concealed piping, a flush-mounted pendant sprinkler may extend only slightly below the ceiling.

Water for fighting a fire can be provided to the sprinklers in various configurations. In a wet-pipe system, for buildings having heated spaces for piping branch lines, all the system pipes contain water for immediate release through any sprinkler that is activated. In a dry-pipe system, which may include pipes, risers, and feed mains, disposed in unheated open areas, cold rooms, passageways, or other areas exposed to freezing temperatures, such as unheated buildings in freezing climates or cold-storage rooms, branch lines and other distribution pipes may contain a dry gas (air or nitrogen) under pressure. This pressure of gas holds closed a dry pipe valve at the riser. When heat from a fire activates a sprinkler, the gas escapes and the dry-pipe valve trips, water enters branch lines, and fire fighting begins as the sprinkler distributes the water.

Dry sprinklers are used where the sprinklers may be exposed to freezing temperatures. A dry sprinkler may include a threaded inlet containing a closure assembly, some length of tubing connected to the threaded inlet, and a fluid deflecting structure located at the other end of the tubing. There may also be a mechanism that connects the thermally responsive component to the closure assembly. The threaded inlet is preferably secured to a branch line. Depending on the particular installation, the branch line may be filled with fluid (wet pipe system) or be filled with a gas (dry pipe system). In either installation, the medium within the branch line is generally excluded from the tubing of the dry sprinkler via the closure assembly until activation of the thermally responsive component. In some dry sprinklers, when the thermally responsive component releases, the closure assembly or portions of the mechanism may be expelled from the tubing of the dry sprinkler by water pressure and gravity. In other types of dry sprinklers, the closure assembly is pivotally mounted to a movable mechanism that is a tube structure, and the closure assembly is designed to pivot on a pin pivot axis transverse to the longitudinal axis of the dry sprinkler, while the tube structure is maintained within the tubing of the dry sprinkler.

In known dry sprinklers, a metallic disc annulus has been provided as a component of a closure assembly to seal the inlet of the dry sprinkler. The metallic disc annulus has a face disposed about a central axis between an inner perimeter and outer perimeter. When the dry sprinkler is in an unactuated condition, the central axis of the metallic disc annulus is generally parallel and aligned with the longitudinal axis of the tubing. Upon actuation of the dry sprinkler, the metallic disc annulus provides an axial thrust force to assist in the movement of the closure assembly along the longitudinal axis of the tubing.

In order to utilize the metallic disc annulus, an arrangement of components is provided within the known dry sprinklers. This arrangement of components positions the metallic disc annulus within the passageway defined by the tube structure to prohibit and allow fluid flow through the dry sprinkler. The metallic disc annulus is positioned at the inlet to provide a seal of the inlet, and within the passageway to permit flow through the dry sprinkler. When the metallic disc annulus is positioned to occlude the inlet, the arrangement of components orients the central axis of the metallic disc annulus generally parallel to and aligned with the longitudinal axis. When the metallic disc annulus is positioned within the passage to allow flow through the outlet of the dry sprinkler, the arrangement of components translates the metallic disc annulus along the passageway.

Although the known dry sprinklers have employed a metallic disc annulus to utilize the axial thrust that it creates to translate the closure assembly within the passageway, the arrangement of components, including the metallic disc annulus, has been found to be inadequate for the performance of the dry sprinkler. Specifically, the inventors have discovered that the known arrangements of components translate the metallic disc annulus along the passageway, however, these arrangements of components appear to maintain an orientation of the central axis of the metallic disc annulus along the longitudinal axis of the dry sprinkler such that the known dry sprinklers fail to achieve their expected performance.

In particular, the inventors have discovered that the known dry sprinklers fail to provide a flow rate at an expected level of tolerance based on the discharge coefficient for which the known sprinklers purport to provide at various pressures provided to the inlet prior to actuation of the dry sprinkler (i.e., start pressures) between 0 and 175 psig. That is, as these known dry sprinklers are rated for a particular discharge coefficient, which is specified as a rated K-factor, the known dry sprinklers should provide an expected flow rate based on the rated K-factor. Here, the rated K-factor defines the expected flow of fluid in gallons per minute from an outlet of the dry sprinkler divided by the square root of the pressure of the flow of fluid fed into the inlet of the dry sprinkler in pounds per square inch gauge. Based on the rated K-factor, the known dry sprinklers should provide the expected flow rate from an outlet of the known dry sprinklers within an acceptable tolerance level when a specified pressure of fluid flow is applied to the inlet of the known dry sprinklers. The known dry sprinklers, however, provide an actual flow rate from the outlet at less than an acceptable tolerance level. Thus, the known dry sprinklers fail to provide an arrangement of components that allow for the metallic disc annulus to translate along the passageway into an orientation where the central axis of the metallic disc annulus is skewed to the longitudinal axis within the passageway so that a flow of fluid in gallons per minute from the outlet of the structure is at an acceptable level, such as at least 95 percent of the rated K-factor multiplied by the square root of the pressure of the flow of fluid fed into the inlet of the structure in pounds per square inch gauge.

SUMMARY OF THE INVENTION

The present invention provides a dry sprinkler for a fire protection system. The present invention allows a dry sprinkler to operate over a range of start pressures for a rated K-factor. The present invention provides an operative dry sprinkler by maintaining a positive seal while the dry sprinkler is in a standby, i.e., unactuated mode, and by changing an orientation of a metallic disc annulus when a heat responsive trigger actuates the dry sprinkler.

According to another preferred embodiment, the present invention provides a dry sprinkler that includes a structure, a fluid deflecting structure, a locator and a metallic disc annulus. The structure defines a passageway extending along a longitudinal axis between an inlet and an outlet. The structure has a rated K-factor. The rated K-factor defines an expected flow of fluid in gallons per minute from the outlet divided by the square root of the pressure of the flow of fluid fed into the inlet of the passageway in pounds per square inch gauge. The fluid deflecting assembly is disposed proximate the outlet. The locator is movable along the longitudinal axis between a first position and a second position. The metallic disc annulus has a face disposed about a central axis between an inner perimeter and an outer perimeter. The outer perimeter contacts the structure so that the face occludes a flow of fluid through the passageway when the locator is proximate the first position. The metallic disc annulus is arranged with the central axis of the face being skewed from the longitudinal axis within the passageway when the locator is proximate the second position so that a flow of fluid in gallons per minute from the outlet of the structure is at least 95 percent of the rated K-factor multiplied by the square root of the pressure of the flow of fluid fed into the inlet of the structure in pounds per square inch gauge.

According to another preferred embodiment, the present invention provides a dry sprinkler with a locator. The locator includes a closure body having a base portion connected to a yoke. The yoke has first, second and third wall portions. The first and second wall portions are symmetric to a yoke axis. The third wall portion has a surface with a radius of curvature connecting the first and second wall portions such that the yoke axis is offset to the longitudinal axis when the locator is in the second position to permit fluid flow through the dry sprinkler.

According to another preferred embodiment, the present invention provides a dry sprinkler with a structure having a passageway extending along a longitudinal axis between an inlet and an outlet. The dry sprinkler includes a locator and a member. The member contacts at least one of the locator and a metallic disc annulus to translate a face of the metallic disc annulus to a side of the longitudinal axis when the locator moves from a first position toward a second position in the passageway. The member can be one of a torsion spring, helical coil spring, tension spring, tether, or crank arm.

According to another preferred embodiment, the present invention provides a dry sprinkler with a structure having a passageway extending along a longitudinal axis between an inlet and an outlet. The dry sprinkler includes a locator and a projection extending from the inner surface of the structure. The projection has a free end located in the passageway. The free end contacts at least one of the locator and metallic disc annulus to translate a face of a metallic disc annulus to a side of the longitudinal axis when the locator moves from a first position towards a second position so as to permit a flow of fluid through the passageway between the inlet and outlet.

According to another preferred embodiment, the present invention provides a dry sprinkler with a structure having a passageway extending along a longitudinal axis between an inlet and an outlet. The dry sprinkler includes a locator and a member. The member extends across the passageway and connects to the inner surface of the structure at a plurality of points of the inner surface of the structure. The member contacts at least one of the locator and a metallic disc annulus to translate a face of the annulus to a side of the longitudinal axis when the locator moves from a first position towards a second position in the passageway.

According to another preferred embodiment, the present invention provides a dry sprinkler with a structure having a passageway extending along a longitudinal axis between an inlet and an outlet. The dry sprinkler includes a locator disposed in the passageway. The structure includes a tubular member disposed about the longitudinal axis. The tubular member has an inner surface and an outer surface surrounding the inner surface. The tubular member includes a pair of bearings disposed between spaced points on the tubular member. Each of the bearings has a bearing surface extending along the longitudinal axis between the inner and outer surfaces. The dry sprinkler also has a member extending through a portion of the locator proximate the inlet. The member is movable along the longitudinal axis on the bearing surface of the structure to translate a face of a metallic disc annulus to a side of the longitudinal axis when the locator moves from a first position towards a second position in the passageway.

According to another preferred embodiment, the present invention provides a dry sprinkler with a structure having a passageway extending along a longitudinal axis between an inlet and an outlet. The dry sprinkler includes a locator disposed in the passageway. The structure includes a groove formed in the inner surface of the passageway about the longitudinal axis proximate the inlet. The dry sprinkler also has a resilient arcuate member that connects to the groove to form a pivot so that a face of a metallic disc annulus is movable about the longitudinal axis to permit a flow of fluid through the passageway between the inlet and outlet when the locator moves from a first position towards a second position in the passageway.

According to another preferred embodiment, the present invention provides a dry sprinkler with a locator. The locator includes an elongate member and a closure body configured to support the metallic disc annulus. The elongate member has an edge proximate the inlet. The edge supports the closure body on a line contact offset to the longitudinal axis such that the face of the metallic disc annulus translates to a position on a side of the longitudinal axis when the locator moves between the first and second position.

According to another preferred embodiment, the present invention provides a dry sprinkler with a structure having a passageway extending along a longitudinal axis between an inlet and an outlet. The dry sprinkler includes a locator disposed in the passageway. The locator includes a closure body having a disc support surface supporting the metallic disc annulus. The dry sprinkler has a structure that includes a projection extending from the inner surface of the structure towards the longitudinal axis in a passageway extending between the inlet and outlet. The projection has a free end located in the passageway. The free end contacts the metallic disc annulus to separate the metallic disc annulus from the closure body such that the closure body falls in the passageway proximate the outlet when the locator moves from a first position towards a second position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a closure body and an elongate member extending along a longitudinal axis. The closure body has a first surface provided with a first radius of curvature facing the outlet of the dry sprinkler. The elongate member has a second surface providing a second radius of curvature, which faces the inlet of the dry sprinkler and supports the first surface so that the first surface rotates on the second surface when the locator moves from a first position towards a second position in the dry sprinkler.

According to another preferred embodiment, the present invention provides a dry sprinkler with a structure having a passageway extending along a longitudinal axis between an inlet and an outlet. The dry sprinkler includes a locator disposed in the passageway. The inlet includes a sealing surface disposed about the longitudinal axis proximate the inlet. The locator includes a top portion extending toward the inlet past the sealing surface with a center of mass of the locator in a first position relative to the structure of the sprinkler. The center of mass is movable by fluid flowing through the inlet so that a face of a metallic disc annulus is moved to a side of the longitudinal axis when the locator moves from the first position towards a second position within the structure.

According to another preferred embodiment, the present invention provides a dry sprinkler with a structure having a passageway extending along a longitudinal axis between an inlet and an outlet. The dry sprinkler includes a locator disposed in the passageway. The inlet includes a sealing surface disposed about the longitudinal axis proximate the inlet. The locator includes a top portion having a chamber extending toward the inlet past the sealing surface in the first position of the locator within the passageway. The chamber can be filled with fluid flowing through the inlet so that the face is moved to a side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The structure includes a cord connected to the structure by a first attachment device and connected to the locator by a second attachment device such that the cord tethers the locator to the structure to move a face of a metallic disc annulus to a side of the longitudinal axis in the passageway when the locator moves from the first position towards the second position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a compression spring extending between a portion of the locator disposed between the inlet and the outlet. The compression spring moves a face of a metallic disc annulus to a side of the longitudinal axis when the locator moves from the first position towards the second position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a tension spring extending between a portion of the locator disposed between the inlet and the outlet. The tension spring moves a face of a metallic disc annulus to a side of the longitudinal axis when the locator moves from the first position towards the second position in the passageway.

According to another preferred embodiment, the present invention provides a dry sprinkler with a structure having a passageway extending along a longitudinal axis between an inlet and an outlet. The dry sprinkler includes a locator disposed in the passageway. The structure includes a spring seat and a compression spring disposed within the passageway proximate the inlet. The spring biases the locator to move along the longitudinal axis relative to the structure. The locator includes a closure body having a first pivot and a second pivot spaced from the first pivot with a first strap and a second strap. The first strap has a first length connected to the first pivot and first end of the spring. The second strap has a second length greater than the first length connected to the second pivot and second end of the spring. The second strap cooperates with the first strap to move the face of the annulus to a side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The structure includes a compression spring disposed in the passageway proximate the inlet. The locator includes at least one elongate member supporting a closure body. The closure body has a pivot with a strap connected to the pivot and a coil of the compression spring. The strap is movable between a first strap position where the strap is spaced from the at least one elongate member and a second strap position where the strap engages the at least one elongate member to move the face of the annulus to a first side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The locator includes first, second, and third bearings. The first and second bearings are formed on a tubular member of the locator and the third bearing is formed on a portion of the locator proximate the inlet. The portion of the locator includes a throw journal located between first and second main journals. The first main journal is disposed within the first bearing, the second main journal is disposed within the second bearing, and the throw journal is disposed within the third bearing. The portion of the locator cooperates with the tubular member and with the metallic disc annulus to move a face of a metallic disc annulus to a side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The locator includes first, second, and third bearings. The first and second bearings are formed on a tubular member of the locator and the third bearing is formed on a portion of the locator proximate the inlet. The portion includes a throw journal located between first and second main journals. The first main journal is disposed within the first bearing, the second main journal is disposed within the second bearing, and the throw journal is in contiguous engagement with a surface of the portion facing the outlet when the locator is proximate the first position. The portion cooperates with the tubular member to move a face of a metallic disc annulus to a side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The locator includes a support member having a plurality of apertures and a first contact area generally orthogonal to the longitudinal axis. The plurality of apertures perforates the support member is spaced from the longitudinal axis. The first contact area is coincident with the longitudinal axis. A bar is provided between a first end engaging the first contact area of the support member and a second end engaging a portion of the locator proximate the inlet when the locator is proximate the first position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a dislodgment member and a support member generally orthogonal to the longitudinal axis. The support member has a contact surface, a post, and a dislodgment aperture. The support member is spaced from the longitudinal axis and the contact surface being coincident with the longitudinal axis. The support member supports the post and a portion of the locator proximate the inlet. The dislodgment member includes a base and a projection. The base is supported by the inner surface of the structure with a projection extending from the base toward the inlet. The projection is aligned with and spaced from the dislodgment aperture when the locator is proximate the first position. The projection penetrates the dislodgment aperture and displaces the post when the locator moves from the first position towards the second position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a projection extending away from the longitudinal axis in the passageway so that the projection obstructs a flow of fluid on one side of the longitudinal axis in the passageway. The obstruction of flow translates a face of a metallic disc annulus to a side of the longitudinal axis via fluid flowing around the projection when the locator is moving from a first position to a second position in the passageway.

According to another preferred embodiment, the present invention provides a dry sprinkler with a structure having a passageway extending along a longitudinal axis between an inlet and an outlet. The structure includes a first fluid flow area symmetrical about the longitudinal axis proximate the inlet and a second fluid flow area asymmetrical about the longitudinal axis spaced between the first flow area and the outlet. The second fluid flow area being greater than the first fluid flow area such that when a pressure differential between the first flow area and the second flow area is provided, a metallic disc annulus is translated proximate the asymmetrical flow area.

According to another preferred embodiment, the present invention provides a dry sprinkler with a structure having a passageway extending along a longitudinal axis between an inlet and an outlet. The dry sprinkler includes a locator disposed in the passageway. The structure includes a tubular outer structure surrounding a tubular member of the locator. The tubular outer structure has a projection extending toward the longitudinal axis. The projection includes a first bearing diametrically spaced apart from an aperture extending through a surface of the tubular member of the locator. The aperture has a groove extending along the longitudinal axis so that the locator is guided by the projection of the tubular outer structure along the longitudinal axis. The locator includes a closure body having a central journal located between a main journal and an impact shoe. The main journal is disposed within the first bearing, the central journal is located in a second bearing of the closure body, and the impact shoe is disposed within the aperture. The impact shoe of the closure body cooperates with the projection to move a portion of a face of a metallic disc annulus to a side of the longitudinal axis when the locator moves from the first position towards the second position in the passageway.

According to another preferred embodiment, the present invention provides a dry sprinkler that includes a structure, fluid deflecting structure, metallic disc annulus, and means for repositioning the metallic disc annulus. The means reposition the metallic disc annulus from a position that prevents flow to another position that prohibits flow therethrough. The structure defines a passageway extending along a longitudinal axis between an inlet and an outlet. The structure has a rated K-factor. The rated K-factor defines an expected flow of fluid in gallons per minute from the outlet divided by the square root of the pressure of the flow of fluid fed into the inlet of the passageway in pounds per square inch gauge. The fluid deflecting assembly is disposed proximate the outlet. The metallic disc annulus has a face disposed about a central axis between an inner perimeter and an outer perimeter. The outer perimeter contacts the structure so that the face occludes a flow of fluid through the passageway when the locator is proximate the first position. The means reposition the central axis of the face to be skewed to the longitudinal axis within the passageway so that a flow of fluid in gallons per minute from the outlet of the structure is at least 95 percent of the rated K-factor multiplied by the square root of the pressure of the flow of fluid fed into the inlet of the structure in pounds per square inch gauge.

A method of operating a dry sprinkler is also provided. The dry sprinkler has a structure extending along a longitudinal axis between an inlet and an outlet. The structure includes a rated K-factor representing a flow of fluid from the outlet of the structure in gallons per minute divided by the square root of the pressure of the fluid fed into the inlet of the structure in pounds per square inch gauge. The method can be achieved by locating a metallic disc annulus so that its central axis is skewed with respect to the longitudinal axis; and verifying that a rate of water flow from the outlet is approximately equal to 95 percent of the rated K-factor of the structure multiplied by the square root of the pressure of water in psig fed to the inlet of the structure for each start pressure provided to the inlet prior to an actuation of the dry sprinkler at between approximately 0 to 175 psig.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

FIGS. 2A-2D illustrate a second preferred embodiment of the dry sprinkler.

FIGS. 3A-3F illustrate a third preferred embodiment of the dry sprinkler.

FIGS. 4A-4E illustrate a fourth preferred embodiment of the dry sprinkler.

FIGS. 5A-5F illustrate a fifth preferred embodiment of the dry sprinkler.

FIGS. 6A-6F illustrate a sixth preferred embodiment of the dry sprinkler.

FIGS. 7A-7E illustrate a seventh preferred embodiment of the dry sprinkler.

FIGS. 8A-8F illustrate an eighth preferred embodiment of the dry sprinkler.

FIGS. 9A-9E illustrate a ninth preferred embodiment of the dry sprinkler.

FIGS. 10A-10E illustrate a tenth preferred embodiment of the dry sprinkler.

FIGS. 11A-11E illustrate an eleventh preferred embodiment of the dry sprinkler.

FIGS. 12A-12E illustrate a twelfth preferred embodiment of the dry sprinkler.

FIGS. 13A-13E illustrate a thirteenth preferred embodiment of the dry sprinkler.

FIGS. 14A-14E illustrate a fourteenth preferred embodiment of the dry sprinkler.

FIGS. 15A-15E illustrate a fifteenth preferred embodiment of the dry sprinkler.

FIGS. 16A-16E illustrate a sixteenth preferred embodiment of the dry sprinkler.

FIGS. 17A-17I illustrate a seventeenth preferred embodiment of the dry sprinkler.

FIGS. 18A-18I illustrate an eighteenth preferred embodiment of the dry sprinkler.

FIGS. 19A-19E illustrate a nineteenth preferred embodiment of the dry sprinkler.

FIGS. 20A-20F illustrate a twentieth preferred embodiment of the dry sprinkler.

FIGS. 21A-21I illustrate a twenty-first preferred embodiment of the dry sprinkler.

FIGS. 22A-22E illustrate a twenty-second preferred embodiment of the dry sprinkler.

FIGS. 23A-23I illustrate a twenty-third preferred embodiment of the dry sprinkler.

DETAILED DESCRIPTION OF THE PREFERRED EMBODIMENTS

Figure 1A:
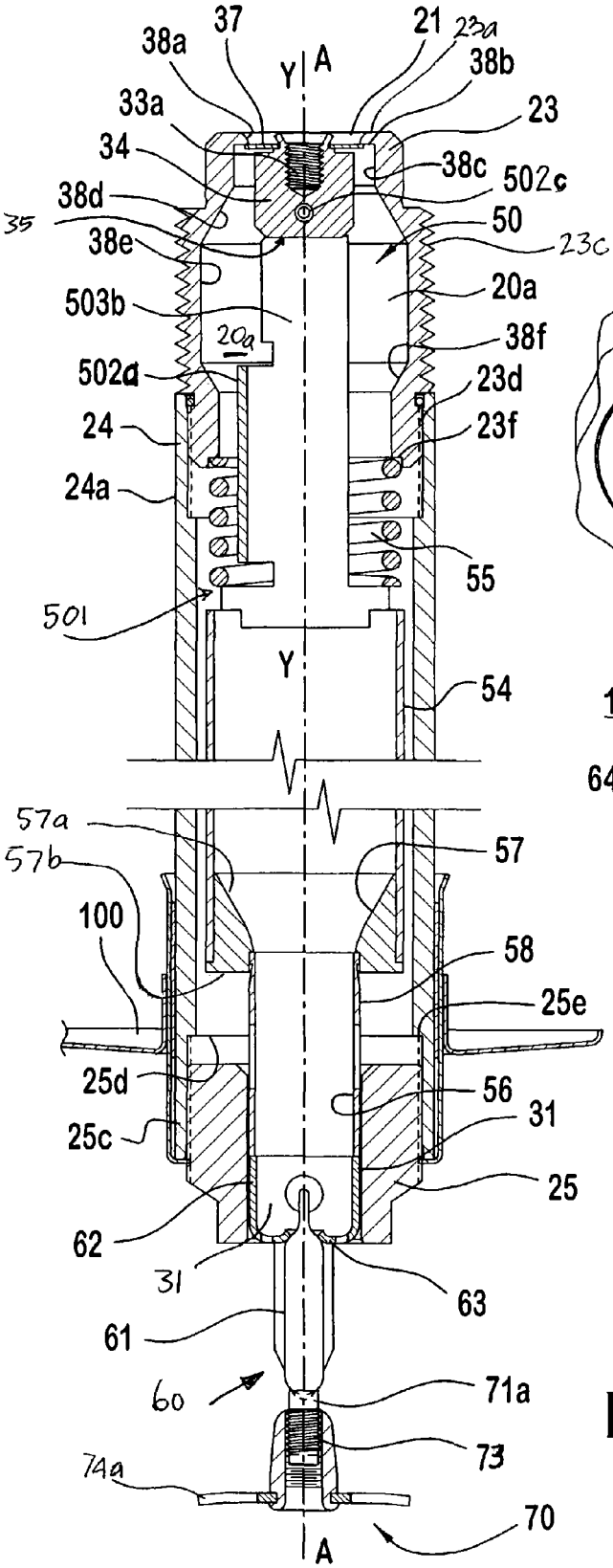
FIGS. 1A-1D illustrate a first preferred embodiment of the dry sprinkler.

As installed, a sprinkler is coupled to a piping network (not shown), which is supplied with a fire fighting fluid, e.g., a water from a pressurized supply source. The preferred embodiments include dry sprinklers that are suitable for use such as, for example, with a dry pipe system (e.g. that is the entire system is exposed to freezing temperatures in an unheated portion of a building) or a wet pipe system (e.g. the sprinkler extends into an unheated portion of a building). Pipe systems may be installed in accordance with National Fire Protection Association Standard for the Installation of Sprinkler Systems, NFPA 13 (2002 edition), which is hereby incorporated by reference herein in its entirety.

FIGS. 1-23 illustrate preferred embodiments of a dry sprinkler 10. Each of the preferred embodiments is described with reference to the corresponding figure number with appropriate alphanumeric identifiers so that a description of one component with the same reference numeral in one preferred embodiment is applicable to another component with the same reference numeral in another preferred embodiment. For example, referring to any one of FIGS. 1-23 with the alphanumeric suffix "A", the dry sprinkler 10 includes an outer structure assembly 20, outlet frame (25,251,252), locator 50, trigger assembly 60, and fluid deflecting structure 70. The locator 50 includes a closure assembly 30 and an inner assembly 501. The sprinkler 10 can be mounted through a holder or escutcheon 100 as shown in a perspective view of FIG. 1D. The outer structure assembly 20 defines a passageway 20*a* that extends along a longitudinal axis A-A between an inlet 21 and an outlet 22. The longitudinal axis A-A can be a central axis of the geometric center of the outer structure with a generally constant cross-sectional area over an axial length along the longitudinal axis of the structure.

The casing tube 24 can be coupled to inlet fitting 23 and outlet frame (25,251,252) by any suitable technique, such as, for example, thread connections, crimping, bonding, welding, or by a pin and groove. The inlet fitting 23 has an outer inlet fitting surface 23*a* and an inner inlet fitting surface 23*b*. The surface 23*a* cinctures part of the passageway 20*a* to define an entrance surface 38*a* and inlet sealing surface 38*b*. In one preferred embodiment, the entrance surface 38*a* can include a convex profile that forms a convergently curved surface intersecting a generally planar surface of the inlet sealing surface 38*b*.

According to one configuration of the inlet, the outer inlet fitting surface 23*a* has fitting threads 23*c* formed near the inlet 21, and the inner inlet fitting surface 23*b* has first coupling threads 23*d* formed proximate the other end of the inlet fitting 23. The fitting threads 23*c* are used for coupling the dry sprinkler to the piping network, and the inlet fitting 23 has an inlet opening 38*a*. The inlet fitting 23*a* can be provided with at least one of ¾ inch, 1 inch, 1.25 inch NPT and 7-1 ISO (Metric) threads formed thereon.

The inlet fitting 23 can have four different internal surface configurations proximate the entrance surface 38*a*, however, any suitable configuration may be employed. Each of the configurations of the inlet can be utilized in each of the preferred embodiments of the dry sprinkler. In the first internal surface configuration, as exemplified in FIG. 1A, the entrance surface 38*a* intersects the sealing surface 38*b*. The entrance surface 38*a* can be a frustoconical surface disposed about the longitudinal axis that has, in a cross-sectional view, a linear profile converging towards the longitudinal axis A-A. Alternatively, the entrance surface 38*a* can be a surface disposed about the longitudinal axis that has, in a cross-sectional view, a curved profile converging towards the longitudinal axis A-A. The sealing surface 38*b* intersects a surface 38*c* extending generally parallel to the longitudinal axis A-A. The surface 38*c* intersects a surface 38*d* diverging away from the longitudinal axis A-A. The diverging surface 38*d* intersects a cylindrical surface 38*e*, which intersects a surface 38*f* converging towards the longitudinal axis. The surface 38*f* intersects surface 38*g* extending generally parallel to the longitudinal axis. In the second internal surface configuration, as exemplified in FIG. 2A, the entrance surface 38*a* forms a bell mouth surface that intersects a sealing surface 38*b*. Sealing surface 38*b* intersects surface 38*c* which, in this configuration, diverges away from the longitudinal axis A-A instead of extending parallel therefrom as is the case for surface 38*c* of FIG. 1A. Diverging surface 38*c* intersects surface 38*d* which, in this configuration, extends generally parallel to the longitudinal axis instead of diverging away therefrom as is the case for surface 38*d* of FIG. 1A.

The outer structure assembly 20 includes the inlet fitting 23 coupled to a casing tube 24, and an outlet frame (25,251,252) coupled to the casing tube 24. As illustrated in a cross-sectional view of FIG. 3A, the entrance surface 38*a* forms a convex profile that intersects a sealing surface 38*b*. Similar to the second internal surface configuration, sealing surface 38*b* intersects surface 38*c*, which, in this configuration, diverges away from the longitudinal axis A-A. Diverging surface 38*c*, however, intersects a generally planar surface 38*d* instead of a diverging or parallel surface 38*d* as in the prior two configurations. In the fourth internal surface configuration, as exemplified in FIG. 3A, the sealing surface 38*b* intersects a diverging surface 38*c* that intersects a generally planar surface 38*d*. Planar surface 38*d* intersects a generally cylindrical inner surface 38*e*.

Three connecting configurations of the inlet fitting 23 can be provided, however, other suitable configurations may be utilized. Each of the connecting configurations can be utilized with any of the preferred embodiments of the dry sprinkler. The first connecting configuration (FIG. 1A) has a coil spring seat 23*f* extending along the longitudinal axis A-A whereas the second configuration (FIG. 1B) or third configuration (FIG. 2A or 3A) provides a coil spring seat 23*f* that encloses the coil spring over a longer axial extension along the longitudinal axis A-A. The first connecting configuration provides for a stop surface being formed by a planar surface on the threaded portion 23*c* whereas the second connecting configuration provides for a stop surface being formed by, a boss portion separate from the threaded portion 23*c*. The third configuration can include a stop member formed by an end surface of a sleeve 42 (FIG. 3A).

The casing tube 24 has an outer casing tube surface 24*a* and an inner casing tube surface 24*b*, both of which cincture part of the passageway 20*a*. According to the first preferred embodiment, the outer casing tube surface 24*a* has second coupling threads 24*c* formed at one end that cooperatively engage the first coupling threads 23*d* of the inlet fitting 23. The inner casing tube surface 24*b* has third coupling threads 24*d* formed proximate the other end of the casing tube 24. The threads 24*d* terminate at an interior portion 24*e* of the casing tube 24.

According to another configuration of the inlet fitting 23, the casing tube 24, and the outlet frame (25,251,252), at least one of the inlet fitting 23 and the outlet frame (25,251,252) may include a radially projecting boss portion 28. The boss portion 28 provides a stop that limits relative threaded engagement between, for example, the inlet fitting 23 and the piping network, the inlet fitting 23 and the casing tube 24, or the outlet frame (25,251,252) and the casing tube 24.

According to yet another configuration of the inlet fitting 23, the casing tube 24, and the outlet frame (25,251,252), the outer casing tube surface 24*a* of the casing tube 24 has external threads that can be coupled to the piping network, and the inner casing tube surface 24*b* of the casing tube 24 has internal threads. The external threads on the outer casing tube surface 24*a* may be coupled to the piping network, and the internal threads on the inner casing tube surface 24*b* coupled to inlet fitting 23, which provides the inlet opening 38*a*. Alternatively, the inlet fitting 23 and the casing tube can be formed as a unitary member such that thread portion 24*d* is not utilized. For example, the casing tube 24 can extend as a single tube from the inlet 21 to the outlet 22.

Alternatives to the threaded connection to secure the inlet to the casing can also be utilized such as other mechanical coupling techniques, which can include crimping or bonding. Additionally, either of the respective inner and outer surfaces of the inlet fitting 23, casing tube 24, and outlet frame (25, 251,252) may be threaded so long as the mating part is cooperatively threaded on the opposite surface, i.e., threads on an inner surface cooperate with threads on an outer surface.

Figure 1D:
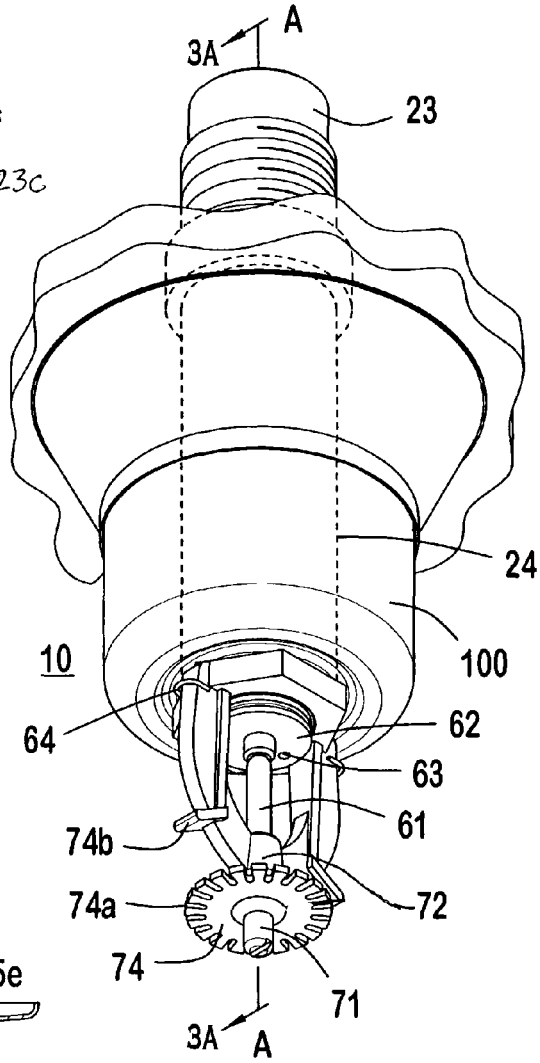
Figure 1B:
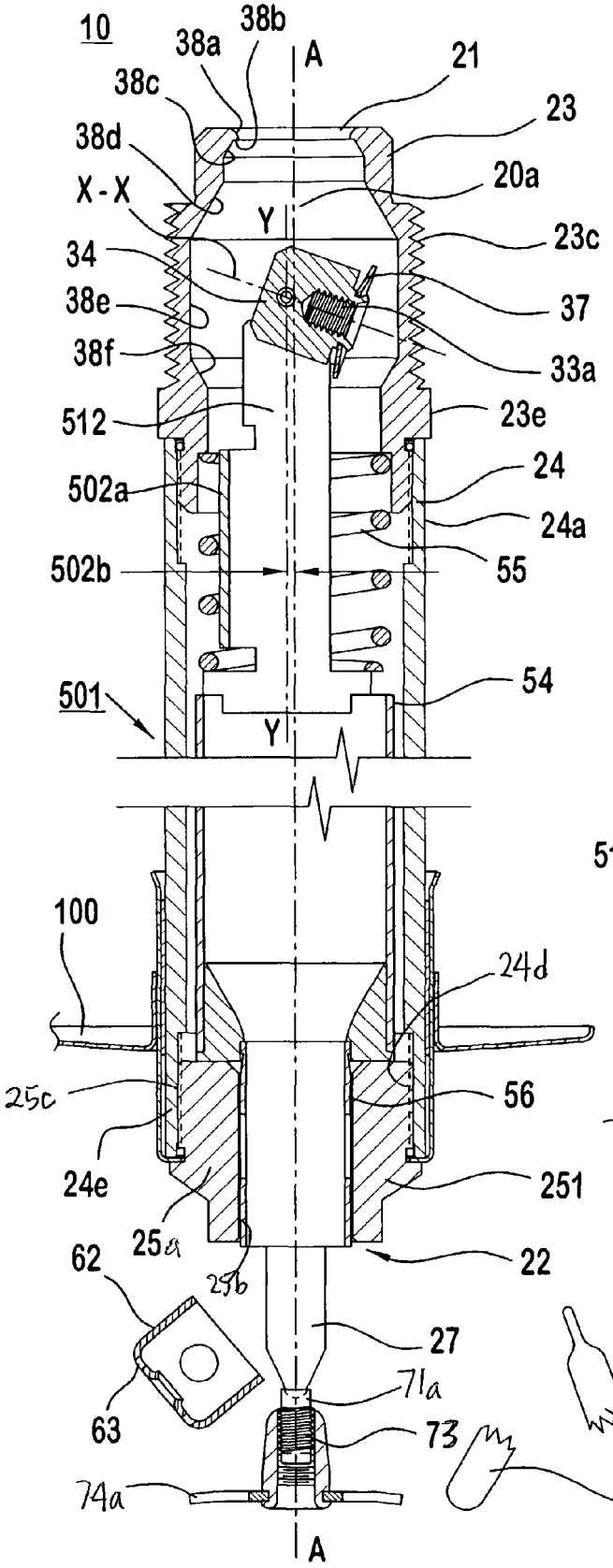

Three different configuration of the outlet frame can be used with the dry sprinklers of the preferred embodiments. Any suitable outlet frame, however, may be used so long as the outlet frame positions a fluid deflecting structure proximate the outlet of the dry sprinkler. A first outlet frame 25 is shown in FIG. 1A. A second outlet frame 251 is shown in FIG. 1B. A third outlet frame 252 is shown in FIG. 2A. The outlet frame (25,251,252) has an outer outlet frame surface 25*a* and an inner outlet frame surface 25*b*, which surfaces cincture part of the passageway 20*a*. The outer outlet frame surface 25*a* has fourth coupling threads 25*c* formed proximate one end of the outlet frame (25,251,252) that cooperatively engage the third coupling threads 24*d*. Proximate the threads 25*c* is a terminal end 25*d* that abuts a complementary surface formed on the interior of the casing 24 at interior portion 24*e*. The outlet frame (25,251,252) has an opening 31 so that an annular member, such as a trigger seat 62, can be mounted therein.

The other end of the outlet frame (25,251,252) can include at least two frame arms 27 that are coupled to the fluid deflecting structure 70. Preferably, the outlet frame (25,251,252) and frame arms 27 are formed as a unitary member. The outlet frame (25,251,252), frame arms 27, and fluid deflecting structure 70 can be made from rough or fine casting, and, if desired, machined.

The thermal trigger assembly 60 is disposed proximate to the outlet 22 of the sprinkler 10. The thermal trigger assembly 60 includes a heat/temperature responsive assembly 61. Preferably, the trigger is a frangible bulb 61 that is interposed between a trigger seat 62 and the fluid deflecting structure 70. Alternatively, the trigger itself can be a solder link, or any other suitable heat responsive arrangement instead of a frangible bulb. Instead of a frangible bulb or a solder link, the heat responsive trigger may be any suitable arrangement of components that reacts to the appropriate condition(s) by actuating the dry sprinkler.

The trigger assembly 60 operates to: (1) maintain the inner tubular assembly proximate the first position over the first range of temperatures between about minus 60 degrees Fahrenheit to about just below a temperature rating of the trigger; and (2) permit the inner tubular assembly to move along the longitudinal axis to the second position over a second range of temperatures at or greater than the temperature rating of the trigger. The temperature rating can be a suitable temperature such as, for example, about 135, 155, 175, 200, or 286 degrees Fahrenheit and plus-or-minus (±) 20% of each of the stated values.

The trigger seat 62 can be an annular member with a nub portion 65 formed at one end of the trigger seat 62. The trigger seat 62 may also include a drain port 63. The nub portion 65 has an interior cavity 65*a* configured to receive a terminal end of the frangible bulb 61. The trigger seat 62 has a biasing spring 64 located in a groove 62*a*. The spring 64 is connected to the frame arms 27 of the fluid deflecting structure 70. A spacer (not shown) can be located between the second guide tube portion 58 and the trigger seat 62. The longitudinal thickness of the spacer would be selected to increase the travel of the locator 50 as it moves from the first position to the second position. In particular, the longitudinal thickness of the spacer would be selected to establish a predetermined travel of the locator 50 before the second end 57*b* of the first guide tube portion 57 comes to rest on the outlet frame 25.

The fluid deflecting structure 70 may include an adjustment screw 71 and a planar surface 74 coupled to the frame arms 27 of the outlet frame (25,251,252). The adjustment screw 71 is provided with external threads 73 that can be used to adjust an axial spacing between the trigger seat 62 and the frangible glass bulb 61. The adjustment screw 71 also has a portion screw seat 71*a* that engages the frangible bulb 61. Although the adjustment screw 71 and the planar surface member 74*a* have been described as separate parts, they can be formed as a unitary member.

A generally planar surface member 74 can be coupled to the adjustment screw 71. The planar surface member 74 can be provided with a plurality of tines 74*a* and a plurality of slots, which are disposed in a predetermined periodic pattern about the longitudinal axis A-A so as to deflect the water flow to form an appropriate spray pattern. Instead of a planar surface 74, other configurations could be employed to provide the desired water deflection pattern. Preferably, the member 74 includes a plurality of tines 74*a* disposed equiangularly about the longitudinal axis A-A that cooperates with deflecting arms 74*b* formed on the frame arm 27 to deflect water over a desired coverage area.

Although all of the preferred embodiments of the dry sprinkler 10 are shown in a pendant configuration, other configurations can be used. For example, the dry sprinkler of the preferred embodiments can be configured as an upright or sidewall dry sprinkler. The dry sprinkler 10 can extend for a predetermined length L from, for example, a ceiling, a wall, or a floor of an enclosed area. The length L can be any value, and preferably, between two to fifty inches depending on the application of the sprinkler 10.

To form a seal with the sealing surface 38*b* of the inlet fitting 23, a metallic disc annulus 36 can be used. The metallic disc annulus 36 is a single monolithic member that has a face 37 with an inner perimeter 37*a* and an outer perimeter 37*b* disposed about a central axis X-X. The central axis X-X defines an axis of the metallic disc annulus 36, and more particularly, an axis of the face 37. The face 37 extends continuously between the inner and outer perimeters over different positions along the central axis X-X. Alternatively, the face 37 may have a radius of curvature about the central axis X-X between the inner and outer perimeters. Preferably, the metallic disc annulus 36 is a resilient metallic member that, in its uncompressed state, may have a frustoconical configuration with a base of the frustum facing the inlet, and in a compressed state, has a generally planar configuration with respect to its central axis X-X. The metallic disc annulus can be formed by a suitable resilient material that provides for an appropriate axial force as the metallic disc annulus changes from a compressed to an uncompressed state. The resilient material for the metallic disc annulus can be, for example, stainless steel or beryllium. A coating may be provided on the metallic disc annulus such as, for example, synthetic rubber, Teflon™, or nylon.

The face 37 of the metallic disc annulus 36, in conjunction with the sealing surface 38*b*, can form a seal against fluid pressure proximate the inlet face 38*b* at any start pressure from approximately zero to approximately 175 psig so that the other side of the metallic disc annulus 36 facing the outlet is generally free of fluid. In particular, a start pressure, i.e., an initial pressure present at the inlet when the dry sprinkler is actuated, can be at various start pressures. Preferably, the start pressure is at least 20 pounds per square inch (psig), and, more particular, greater than 100 psig.

Each of the preferred embodiments has a rated discharge coefficient, or rated K-factor, that is at least 5.6, and, can be 8.0, 11.2, 14.0, 16.8, 22.4 or 25.5. However, any suitable value for the K-factor could be provided for the dry sprinkler of the preferred embodiments. As used herein, the discharge coefficient or K-factor is quantified as a flow of fluid, preferably water, from the outlet 22 of the outer structure assembly 20, e.g., in gallons per minute (GPM), divided by the square root of the pressure of the fluid fed into the outer structure assembly 20, e.g., in pounds per square inch gauge (psig). The rated K-factor, or rated discharge coefficient is a mean value. The rated K-factors are expressed in standard sizes, which have an acceptable range, which is approximately five percent or less deviation from the standard value over the range of pressures. For example, a "rated" K-factor of 11.2 encompasses all measured K-factors between 11.0 and 11.5. The K-factors of the preferred embodiment may decrease as the sprinkler length L increases. For example, when L is 48 inches, the K-factor of the dry sprinkler 10 can be reduced from 11.2 to approximately 10.2.

The K-factor allows for an approximation of flow rate to be expected from the outlet of a sprinkler based on the square root of the pressure of fluid fed into the inlet of the sprinkler. In relation to the preferred embodiments, the dry sprinkler of each of the preferred embodiments has a rated K-factor of at least 5.6. Based on the rated K-factor of the dry sprinkler of the preferred embodiments, each dry sprinkler has an arrangement of components that allows for an actual minimum flow rate in gallons per minute (GPM) through the outlet as a product of the rated K-factor and the square root of the pressure in pounds per square inch gauge (psig) of the fluid fed into an inlet of the dry sprinkler of each preferred embodiment. Specifically, each of the preferred embodiments has an actual minimum flow rate approximately equal to 95% of the magnitude of a rated K-factor times the square root of the pressure of the flow of fluid fed into the inlet of each embodiment. In order to provide the actual flow rate when the dry sprinkler is actuated, different arrangements of components—as exemplified in each of the at least twenty three preferred embodiments—are provided that position the face 37 such that the central axis X-X of the face 37 is skewed with respect to the longitudinal axis A-A and the expected flow rate is achieved from the dry sprinkler. The arrangements provide various means for repositioning—from a first position that prevents flow to a second position that permits flow the inlet—the face 37 of the metallic disc annulus 36 to be skewed to the longitudinal axis A-A so that the actual minimum flow rate approximately equal to 95% of the magnitude of a rated K-factor times the square root of the pressure of the flow of fluid fed into the inlet of each embodiment can be achieved.

Figure 1C:
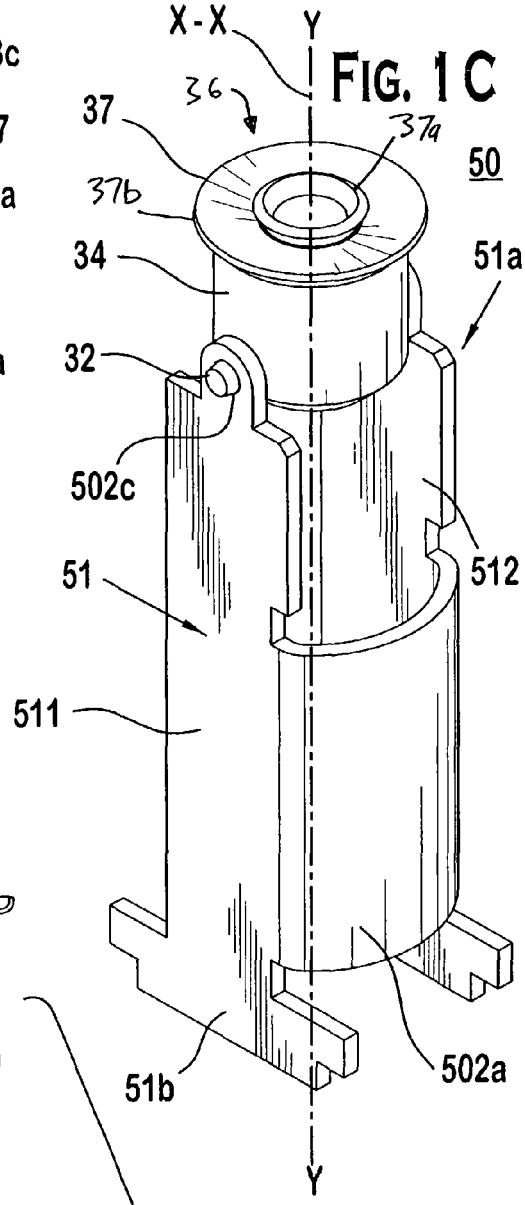

In a first preferred embodiment of the dry sprinkler, as shown in FIGS. 1A-1C, an arrangement of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. Locator 50 includes a closure assembly 30. The closure assembly 30 has a body 34 with a first end 30*a* and second end 30*b*. The first end 30*a* includes a top portion 33 that, preferably, is in the shape of a cone or preferably a truncated cone. The first end 30*a* preferably extends toward the second end 30*b*. A top portion 33 is spaced along the longitudinal axis A-A to the body portion 34. The body portion 34 can be formed with a support surface 35 that, in a preferred embodiment, is generally planar. An opening 33*a* can be formed proximate the top portion 33, which is preferably cylindrical, to allow a tool to engage the closure assembly 30 while assembling the dry sprinkler 10. The face 37 of the metallic disc annulus 36 can be mounted proximate the top portion 33 on an annular seating surface of the closure assembly 30 so as to prevent fluid flow through the passageway 20*a* in a non-actuated or closed position of the dry sprinkler 10.

To minimize the restriction upon the water flowing through outer structure assembly 20 of the dry sprinkler 10, the closure assembly 30 can include a suitable shape that presents as small a frontal area and as small a coefficient of drag as suitable when the closure assembly 30 is rotated to the open position. Preferably, a large frontal surface area is provided by portion 33 and metallic disc annulus 36. And preferably, by virtue of the shape of portions 33 and 34, the body of closure assembly 30 presents a relatively smaller frontal area to the flow of water in an open position as compared to the frontal area of portion 33 and metallic disc annulus 36 of the closure assembly 30 with respect to the water flow in the closed position.

The closure assembly 30 is supported by contacting the support surface 35 against an inner assembly 501 of the locator 50 so that the face 37 of the metallic disc annulus 36, in an unactuated position, engages a sealing surface 38*b* of the inlet 21. During engagement with the sealing surface 38*b*, the face 37 of the metallic disc annulus 36 is preferably compressed against the sealing surface 38*b* such that the central axis X-X of the face is generally coaxial with the longitudinal axis A-A.

The inner assembly 501 of locator 50 can include a solid member of a predetermined cross-section such that fluid flow surrounds the inner assembly 501. The inner assembly 501, preferably, is disposed within the tubular outer structure assembly 20, which includes the casing tube 24. The terms "tube" or "tubular," as they are used herein, denote an elongate member with a suitable cross-sectional shape transverse to the longitudinal axis A-A, such as, for example, circular, oval, or polygonal. Moreover, the cross-sectional profiles of the inner and outer surfaces of a tube may be different.

The inner assembly 501 can include a multi-legged yoke 51, a fluid tube 54, a guide tube 56, and the trigger assembly 60. In the non-actuated configuration, the yoke 51 is coupled to the fluid tube 54, and the fluid tube 54 is coupled to the guide tube 56, and the guide tube 56 is coupled to the trigger seat 62 of the trigger assembly. The multi-legged yoke 51 can locate the closure assembly 30 with respect to the longitudinal axis A-A. The multi-legged yoke 51 has a first yoke support end 51*a* contacting the closure assembly 30 and a second yoke support end 51*b* coupled to the fluid tube 54. The yoke 51 may optionally include a biasing member that in a preferred embodiment includes an assist spring 55 to assist movement of the yoke 51 from its unactuated position (FIG. 1A) to an actuated position (FIG. 1B).

The fluid tube 54 can be formed with a first cross-sectional area $A_1=\pi(d_1/2)^2$ transverse to the longitudinal axis A-A. Preferably, the fluid tube 54 has a generally constant diameter $d_1$ along its length, which is believed to minimize friction loss effects over its length. The guide tube 56 can be formed by two or more portions. Preferably, a first guide tube portion 57 can be a conical portion with a first end 57*a* having a second cross-sectional area $A_2=\pi(d_2/2)^2$ generally equal to the first cross-sectional area $A_1$ and a second end 57*b* having a third cross-sectional area $A_3=\pi(d_3/2)^2$ generally less than the first cross-sectional area $A_1$. A second guide tube portion 58 has a fourth cross-sectional area $A_4=\pi(d_4/2)^2$ generally equal to the third cross-sectional area $A_3$.

Referring to FIG. 1C, the yoke 51 has a central axis Y-Y extending along longitudinal axis A-A. Yoke 51 has two main portions 511 and 512 symmetric about the central axis Y-Y. Each of the main portions has a first end and a second end 51*a* and 51*b*. A connecting portion 502*a* connects the main portions 511 and 512 between a first end 51*a* and a second end 51*b* of each of the main portions 511 and 512. The main portions 511 and 512 are each provided with a pivot connection 502*c* so that the pivot connection 502*c* forms a pivot axis P-P transversely intersecting the yoke axis Y-Y. The closure assembly 30 is mounted by a pivot pin 32 to pivot connection 502*c* of the yoke 51. The pivot pin 32 allows for rotation of the closure assembly 32 about the pivot axis P-P in the actuated or activated configuration of the dry sprinkler.

As shown in FIG. 1C, the connecting portion 502*a* can be a single arcuate member connecting the main portions 511 and 512 on one side of the yoke axis Y-Y to form an elongate member having an arcuate channel extending between the ends of the main portions 511 and 512. Yoke 51 has some freedom of movement relative to the fluid tube 54 such that the yoke axis Y-Y is movable relative to the longitudinal axis A-A.

By connecting a closure assembly 30 to the pivot connection 502*c*, the closure assembly 30 can pivot about the pivot axis P-P in an actuated (i.e., open) position of the dry sprinkler. Moreover, the pivot connection 502*c* allows for the compression of the face 37 into a generally planar surface against the sealing surface 38*b* so that the dry sprinkler of the preferred embodiment can be assembled. In lieu of the pivot pin 32 of the preferred embodiment, the closure assembly 30 can be pivoted by a bolt and nut, screw, two pins, a protrusion cooperating with a recess, or any suitable arrangement that allows the closure assembly 30 to pivot about pivot axis P-P and also allows for compression of the face 37 against the sealing surface 38*b* in a closed position of the dry sprinkler.

Due to the alignment of the closure assembly 30 with the sealing surface 38*b* of the inlet fitting 23 in the closed position (FIG. 1A), yoke 51 can have its axis Y-Y generally coaxial with the longitudinal axis A-A in the closed position. Due to the assist spring 55 acting against the asymmetric connecting portion 502*a*, yoke 51 can have its axis Y-Y offset over an offset distance 502*b* relative to the longitudinal axis A-A in the open position of the dry sprinkler (FIG. 1B). The offset 502*b* can be at least 0.016 inches so that, when the dry sprinkler is actuated to an open position, the closure assembly 30 has its pivot axis P-P offset to the longitudinal axis A-A. Because the pivot axis P-P is offset to the longitudinal axis A-A, a portion of the closure assembly 30 is offset to the longitudinal axis A-A, which is believed to allow a moment force to be generated as a function of the pressure of the flowing water acting over the offset distance. This moment force is believed to assist in rotating the closure assembly 30 so that the sealing surface is located on one side of the longitudinal axis A-A when the yoke 51 is traveling towards or at the second position to permit fluid to flow through the inlet to the outlet.

The dry sprinkler 10 can be assembled in the following manner. The body 34 of the closure assembly and the metallic disc annulus 36, including the face 37, are placed in the inlet fitting 23 so that the outer perimeter or a portion of the face 37 contacts a sealing surface 38*b* of the inlet fitting 23. Depending on whether an assist spring is desired, a biasing member in the form of a assist spring 55 is placed into the interior surface 23*b* of the inlet fitting 23, as shown in FIG. 1A.

The second support end 51*d* of the multi-legged yoke 51 is inserted into the fluid tube 54 so that the multi-legged yoke is coupled to the fluid tube 54. The fluid tube 54 is coupled to the guide tube 56 to form an inner assembly 501. The casing tube 24 is coupled by threads to the inlet fitting 23 and the inner assembly 501 can be inserted through the casing tube 24. As the inner assembly 501 is inserted through the casing tube 24, the first yoke support end 51*a* positions the face 37 of the metallic disc annulus 36 against the sealing surface 38*b* of the inlet fitting 23 so that the components described above form a partially assembled dry sprinkler.

The trigger assembly 60 can be assembled separately by mounting the trigger seat 62 to the frame arm opening 31, placing a terminal end of the frangible bulb 61 into the interior cavity 65*a* of the nub portion 65, threading the adjustment screw 71 to the frame arms 27 so that the screw seat 71*a* engages another end of the frangible bulb 61. The ejection spring 64 is placed in the groove 62*a* of the trigger seat 62 and connected to both frame arms (FIG. 1D).

The trigger assembly 60 is coupled to the partially assembled dry sprinkler by preferably threading the frame (25,251,252) to the casing tube 24 until the boss portion 28 and the casing tube 24 capture the holder or escutcheon 100 between these two components. The frame (25,251,252) is preferably threaded at a desired torque until a terminal end 25*d* of the frame (25,251,252) engages a complementary terminal surface 24*e* of the casing tube 24. Next, the adjustment screw 71 is adjusted to a sufficiently high torque value that in the final assembled position, the screw 71 in conjunction with the frame (25,251,252) will cause the outer perimeter or a portion of the face 37 to be compressed against the sealing surface 38*b* and maintain all components at their intended position without damaging the frangible bulb 61. This provides the locator 50 for the dry sprinkler 10.

In operation, the face 37 separates from the sealing surface 38*b* as the closure assembly 30 translates along with the inner assembly 501 during an actuation of the sprinkler 10. The axial force provided by the metallic disc annulus 36 assists in translating the closure assembly 30 from the inlet fitting 23. The translating of the face 37 can also include moving the face 37 or a portion of the face 37 to a side of the longitudinal axis A-A such that a central axis X-X of the face 37 is skewed with respect to the longitudinal axis A-A. That is, in the second position of the inner assembly 501, the central axis X-X of the sealing member is arranged so that the central axis is skewed, i.e., not co-planar with the longitudinal axis A-A. And, the translating of the sealing surface can also include moving the locator 50 for a predetermined distance within outer structure assembly 20 while retaining a portion of the locator 50 within outer structure assembly 20, between the fluid deflecting structure 70 and the inlet 21, which movement can be assisted by using the assist spring 55.

Figure 2B:
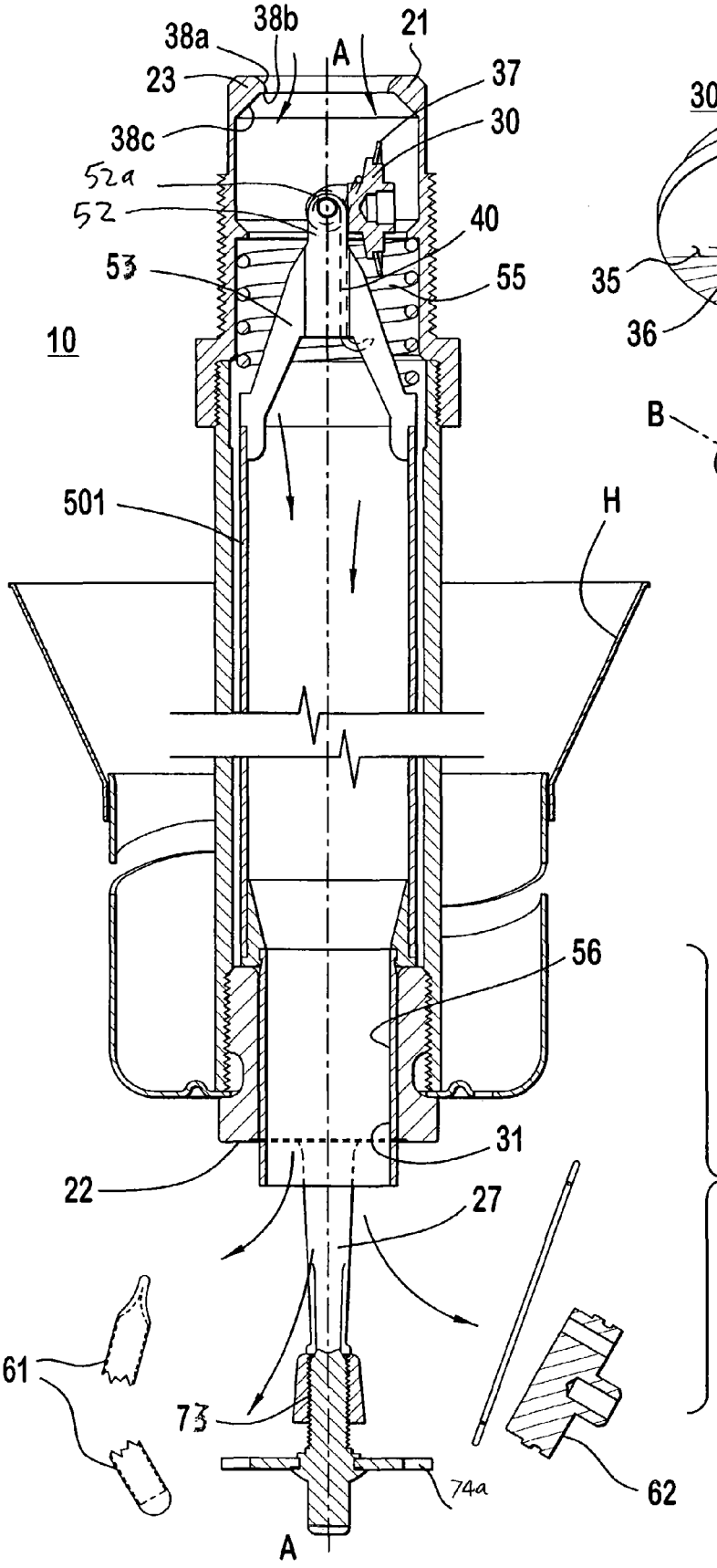
Figure 2D:
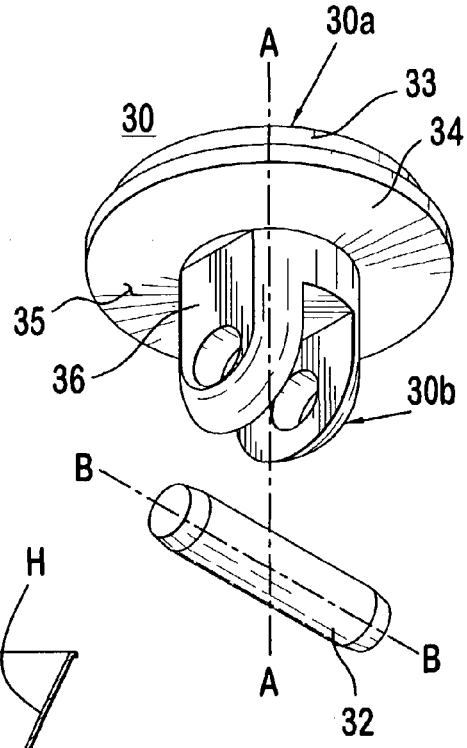

In a second preferred embodiment of the dry sprinkler, as shown in FIGS. 2A-2D, a second arrangement of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, while the closure assembly 30 is similar to that of the first embodiment, the inner assembly 501 includes a multi-legged yoke 51 that extends along a yoke axis Y-Y and coupled to a fluid tube 54 and guide tube 56. The yoke 51 provides a mounting point for pin 32 to intersect, generally transverse to the longitudinal axis A-A so that the closure assembly 30 can be mounted to the yoke 51 via legs 36 (FIG. 2D). The yoke 51 has a first support end 51*a* coupled to the closure assembly 30 through pin 32 and a second support end 51*b* coupled to the fluid tube 54. The first yoke support end 51*a* has at least one elongate member 52 from which extends at least two and preferably four support legs to form the second yoke support end 51*b*. The first yoke support end 51*a* is provided with eyelets 52*a* formed so that the pin 32 can be inserted therethrough to mount the closure assembly 30. The yoke 51 can be formed as a cast, machined or stamped piece. Preferably, the yoke 51 is formed by mating two stamped sheet metal members via a plurality of tack welds. Each of the stamped sheet metal members has a central portion extending along the longitudinal axis A-A and two projections diverging away from the longitudinal axis A-A at a suitable angle. When the central portion of each of the two members is joined together, four projections are formed to define four legs 53, e.g., a quad-pod. Legs 53 of the quad-pod are coupled to the fluid tube 54 and can include a boss portion 51*c* that can be used as a seat for an assist spring 55.

The assist spring 55 acts along the longitudinal axis A-A to assist the locator 50 in translating to a second or open position of the dry sprinkler. Preferably, the helper 55 is a coil spring with a first end contiguous to inner boss portion 23*f* and a second end contiguous to seat surface 51*c* of the yoke 51.

A suitable contact member 40 can be a resilient member that provides a moment force. For example, a torsion spring, helical spring, or a leaf spring can be used to generate a moment force on the closure assembly 30. Alternatively, the contact member 40 can be a suitable mechanism that provides a moment force to the closure body 30. For example, a motion interference projection, linkage or lost motion mechanism can provide a moment force about pin 32 to rotate the closure assembly 30 about pivot axis P-P.

Preferably, as illustrated in FIG. 2C, the contact member 40 is a torsion spring 420 with a first end 42*a*, main body 420*h* and second end 42*b*. The main body 420*h* can be entwined to pin 32. One end 42*a* can be in engagement with a portion of the closure assembly 30. The other end 42*b* can be coupled, e.g., fixed with a hooked end to the yoke 51 such that the two ends describe an obtuse angle of about 120 degrees in a non-actuated condition of the dry sprinkler and describe an obtuse angle of greater than 120 degrees in an actuated condition of the dry sprinkler 10.

In this preferred embodiment, the torsion spring 420 is a single wire spring wound to form main section 420*h* with at least two coils spaced apart along the pin axis P-P, and legs (forming the second end 42*b*) extending from a main section 420*h*. Also preferably, the torsion spring has a spring force of about 0.15 pound-force per degree of rotation, which is believed to be the minimum spring force needed to rotate closure assembly 30 about pivot axis P-P when a dry sprinkler of the preferred embodiments is provided with a rated K-factor of about 8.0.

The dry sprinkler 10 can be assembled in the following manner. The face 37 and closure body 30 are mounted to yoke 51 with the torsion spring 420 and pin 32 extending through the respective eyelets of the closure body and yoke. A biasing member in the form of an assist spring 55 is placed into the interior surface 23*b* of the inlet fitting 23, as shown in FIG. 2A.

The second support end 51*b* of the multi-legged yoke 51 is pressed into the fluid tube 54 so that the multi-legged yoke is coupled to the fluid tube 54. The fluid tube 54 is coupled to the guide tube 56 to form an inner assembly 501. The casing tube 24 is coupled by threads to the inlet fitting 23 and the inner assembly 501 can be inserted through the casing tube 24. This subassembly is placed in the inlet fitting 23 so that the outer perimeter or a portion of the face 37 contacts a sealing surface 38*b* of the inlet fitting 23 so that the components described above form a partially assembled dry sprinkler.

The trigger assembly 60 can be assembled separately by mounting the trigger seat 62 to the frame arm opening 31, placing a terminal end of the frangible bulb 61 into the interior cavity 65*a* of the nub portion 65, threading the adjustment screw 71 to the frame arms 27 so that the screw seat 71*a* engages another end of the frangible bulb 61. The ejection spring 64 is placed in the groove 62*a* of the trigger seat 62 and connected to both frame arms (FIG. 2A).

As described above with respect to the first embodiment, the trigger assembly 60 can be assembled together with the partially assembled dry sprinkler to form a dry sprinkler of the preferred embodiment.

In operation, when the dry sprinkler is actuated so that the locator 50 is translated from the first position to the second position, it is believed that this spring force of the contact member, along with the inflowing force of water, rotates the closure assembly 30 about pivot axis P-P so that the central axis X-X of the face 37 is skewed with respect to the longitudinal axis A-A and the expected flow rate is achieved from the dry sprinkler.

In a third preferred embodiment of the dry sprinkler, as shown in FIGS. 3A-3F, an arrangement of the locator is provided for repositioning of the face 37 so that the central axis X-X of the face 37 is skewed to the longitudinal axis A-A in an actuated condition of the dry sprinkler 10 and the expected flow rate is provided from the dry sprinkler. In particular, it is noted that the closure assembly 30 is different from the previous embodiments in that the closure assembly 30 is no longer pinned to a yoke. Referring to FIGS. 3A and 3B, the contact member 40 is a projection 410 having a free end 410*a* that extends generally orthogonal to the longitudinal axis A-A. The projection 410 can be coupled to the inner inlet fitting surface 23*b*. Further, the projection 410 can be a separate member coupled to a sleeve 42 press-fitted within the inlet fitting 23. The projection 410 can be coupled to the sleeve 42 through a projection opening 43. The sleeve 42 can be press-fitted in the surface 23*b* to form the contact assembly 40. In an alternative configuration, the projection 410 is a unitary member 410*b* of the sleeve 42 that can be formed by cutting a portion of the wall surface of the sleeve 42 and bending that portion towards the longitudinal axis A-A to form a free end 410*c* (FIG. 3E).

The dry sprinkler 10 of this preferred embodiment can be assembled in the following manner. The metallic disc annulus 36 is placed in the inlet fitting 23 so that the outer perimeter or a portion of the face 37 contacts a sealing surface 38*b* of the inlet 21. The sleeve 42 is press-fitted in the interior surface 23*b* of the inlet fitting 23. Depending on whether an assist spring is desired, a biasing member in the form of a assist spring 55 is placed into the interior surface 23*b* of the inlet fitting 23, as shown in FIG. 3F.

The second support end 51*b* of the multi-legged yoke 51 is pressed into the fluid tube 54 so that the multi-legged yoke is coupled to the fluid tube 54. The fluid tube 54 is coupled to the guide tube 56 to form an inner assembly 501. The casing tube 24 is coupled by threads to the inlet fitting 23 and the inner assembly 501 can be inserted through the casing tube 24. As the inner assembly 501 is inserted through the casing tube 24, the first yoke support end 51*a* contacts the closure assembly 30 via contact with the generally planar support surface 35 to place the face 37 of the metallic disc annulus 36 against the sealing surface 38*b* of the inlet fitting 23 so that the components described above form a partially assembled dry sprinkler.

As described above with respect to the first embodiment, the trigger assembly 60 can be assembled together with the partially assembled dry sprinkler to form a dry sprinkler of the preferred embodiment.

In operation, when the dry sprinkler is actuated, the inner assembly 501 is translated along the longitudinal axis ALA, thereby causing the closure assembly 30 to also translate along axis A-A. The closure assembly 30, along with the pressure of the water thereon, a rotating moment about an axis, which is coupled with contact of the support surface 35 against a free end of the projection 41, causes the closure assembly to pivot about the free end of the projection 41. Thus, closure assembly 30 is generally moved or flipped to one side of and along the longitudinal axis A-A such that the central axis X-X of the face 37 is skewed with respect to the longitudinal axis A-A and the expected flow rate is achieved from the dry sprinkler.

Referring to the fourth preferred embodiment, as shown in FIGS. 4A-4E, yet another arrangement of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, referring to FIGS. 4B and 4D, the contact member 40 is a tubular bar 411 having a contact surface 411*a* that extends generally orthogonal to the longitudinal axis A-A (FIG. 4A). The tubular bar 411 can be coupled to the inner inlet fitting surface 23*b*. Further, the tubular bar 411 is a separate generally linear member coupled to a sleeve 42 such that the tubular bar 411 is offset relative to the longitudinal axis A-A. The tubular bar 411 can be coupled to the sleeve 42 through two projection openings 413 disposed on the inner surface 42*a* of the sleeve 42. The sleeve 42 can be press-fitted in the surface 23*b* to form the contact assembly 40. Alternatively, the openings 413 can be formed by drilling through the sleeve starting at one position on the exterior surface 42*b* through the interior surface 420*e* at the one position and through a second position on the interior surface 420*e* to the exterior surface 42*b*. A tubular stock can be inserted through the openings 413 with its ends projecting from the exterior surface 42*b* can be sheared or grinded flush with the exterior surface 42*b*.

The fourth preferred embodiment can be assembled in a similar manner as described above in relation to the third embodiment.

In operation, when the dry sprinkler is actuated so that the locator 50 is translated from the first position to the second position, the closure assembly 30 is generally moved or flipped to one side of and along the longitudinal axis A-A to permit water to flow through the inlet and from the outlet at the expected flow rate.

Figure 5C:
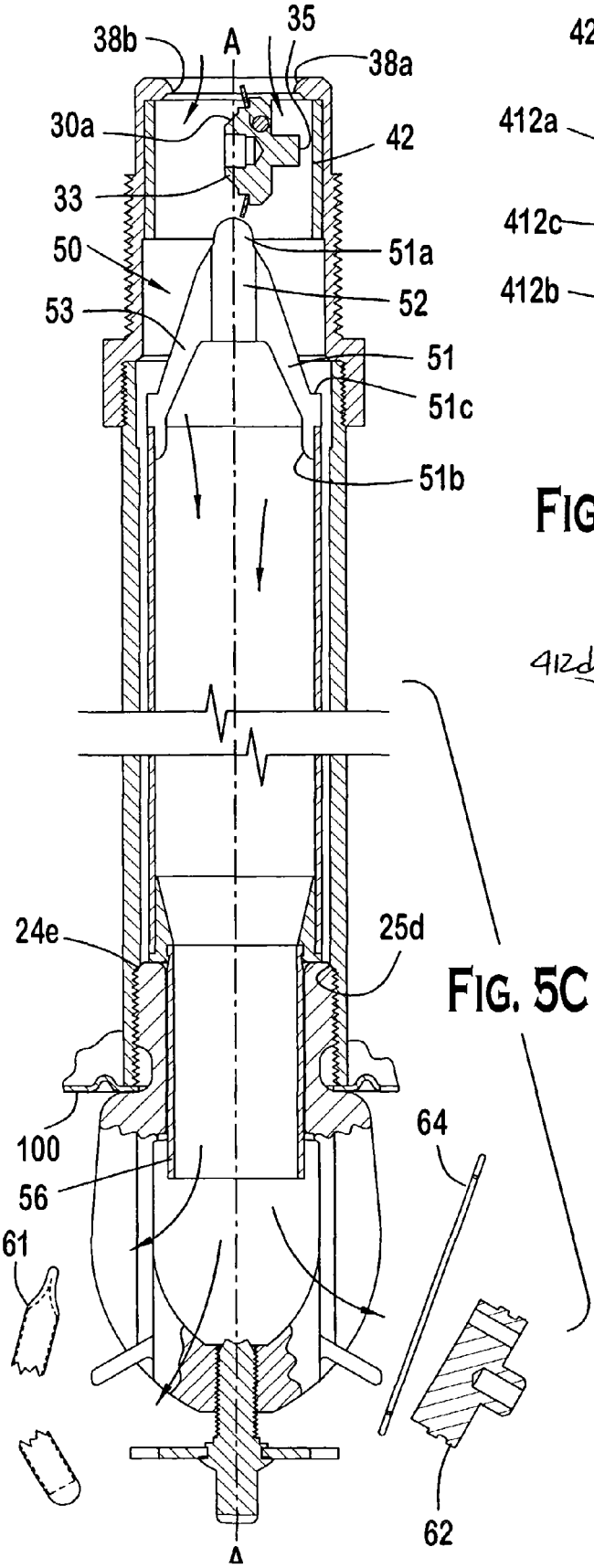
Figure 5D:
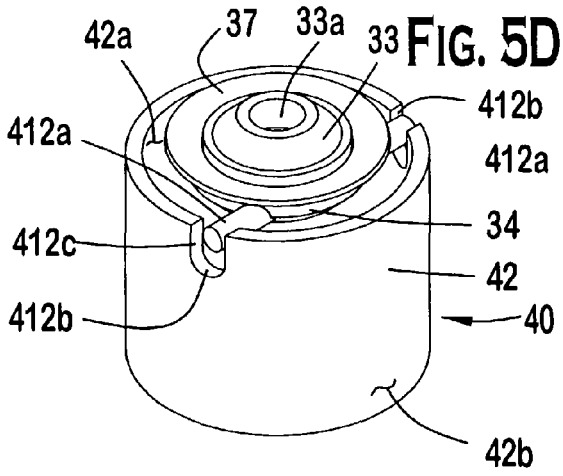
Figure 5E:
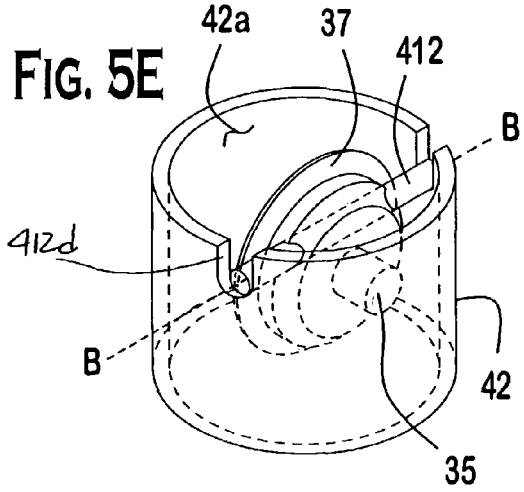
Figure 5F:
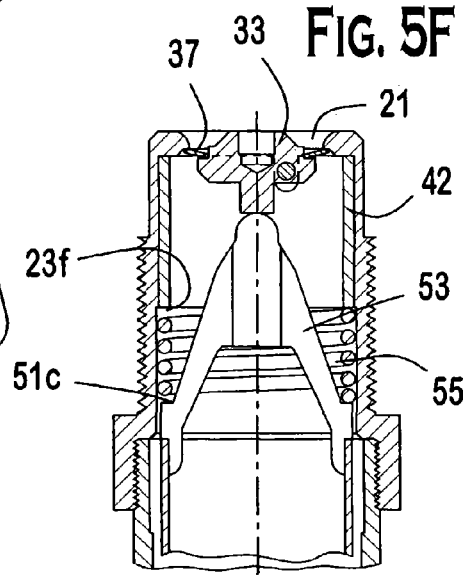

Referring to the fifth preferred embodiment, as shown in FIGS. 5A-5F, yet another arrangement of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. With reference to FIGS. 5B and 5D, the contact member 40 is a tubular bar 412 offset relative to the longitudinal axis A-A, and the tubular bar has a contact surface 412*a* that extends generally orthogonal to the longitudinal axis A-A. The tubular bar 412 can be supported by the inner inlet fitting surface 23*b* via bearings 412*b* that permit the tubular bar 412 to translate the closure assembly 30 about 90 degrees. This permits the closure assembly 30 to be moved to a side of the longitudinal axis A-A when the inner tube assembly moves from the first position towards the second position so as to permit a minimally restricted flow through the passageway between the inlet 21 and outlet 22. Each bearings 412*b* has two surfaces aligned proximate the longitudinal axis A-A, and a third surface connects the two parallel surfaces. The connecting surface can be of a suitable surface that permits the tubular bar 412 to rotate, such as, for example, flat, arcuate, V-shaped or diagonal. In a preferred embodiment, the connecting surface is arcuate. Preferably, the bearings 412*b* are U-shaped openings formed on a sleeve 42. The bearings 412*b* are positioned offset relative to the longitudinal axis A-A. In particular, the bearings 412*b* are configured such that each bearing is larger than the diameter of the tubular bar 412. Each of the bearings 412*b* has a radiused surface 412*c* that extends towards the inlet 21 so as to provide for an open gap 412*d*. The open gaps 412*d* allow the tubular bar 412 to drop into the bearings 43 while the radiused surfaces 412*c* allow the tubular bar 412 to rotate about its axis B-B. Preferably, the sleeve 42 can be press-fitted in the surface 23*b* such that the tubular bar 412 and bearings 412*b* form the contact assembly 40.

The dry sprinkler of this preferred embodiment can be assembled by placing the closure body 30 into the inlet fitting 23 so that the outer perimeter or a portion of the face 37 contacts the sealing surface 38*b*. The length of the each bearing surface along the longitudinal axis A-A allows relative freedom of movement so that the outer perimeter or a portion of the face 37 can be compressed against the sealing surface 37 and a suitable seal can be provided therein. The sleeve 42 is pressed in with the bearings surface 412*c* aligned with the ends of the bar 412. Thereafter the assist spring 55 is inserted, if desired, along with yoke 51, fluid tube 54, guide tube 56, frame (25,251,252) and trigger assembly 60 in a similar manner of assembly as described with reference to the second preferred embodiment.

In operation, when the dry sprinkler is actuated so that the locator 50 is translated from the first position to the second position, the closure assembly 30 is initially dropped into bearings 412*b*. As the shaft 412 impacts the bearings 412*b*, closure assembly 30 is rotated so that the central axis X-X of the face 37 is skewed with respect to the longitudinal axis A-A to permit water to flow through the inlet and from the outlet at the expected flow rate.

Figure 6C:
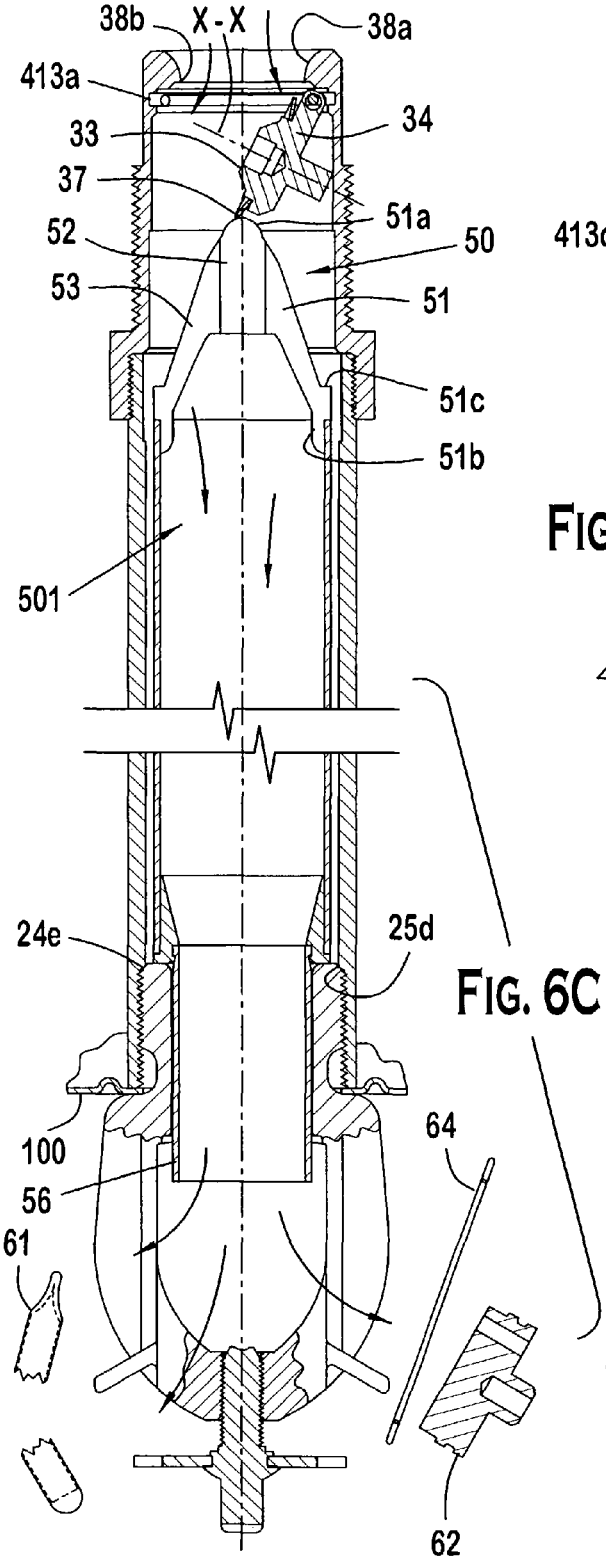
Figure 6D:
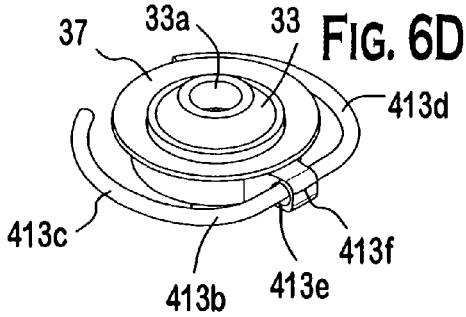

Referring to the sixth preferred embodiment, as shown in FIGS. 6A-6F, a different configuration of the components of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. The closure assembly 30 in this embodiment has first portion 33, second portion 34 with a support surface 35 that, in a preferred embodiment, is generally planar. A boss 413*f* can be formed at a circumferential portion of the second portion 34. The boss 413*f* is provided with an opening 413*e* that extends through the boss 413*f* along an axis generally orthogonal to the longitudinal axis A-A. With reference to FIGS. 6B and 6D, the contact member 40 includes a circumferential groove 413*a* formed on an inner surface of the inlet fitting 23. The groove 413*a* allows a C-clip 413*b* to be retained in the groove 413*a*. The C-clip 413*b* preferably has two legs 413*c* and 413*d* extending in an arcuate fashion about the longitudinal axis A-A so that the terminal ends of the legs face each other, as shown in FIG. 3. The clip 413*b* is retained in the groove 413*a* via the legs 413*c* and 413*d*. The C-clip 413*b* allows the closure assembly 30 to be loosely connected to the C-clip 413*b* via opening 413*e* formed through boss 413*f* of the closure assembly 30 so as to provide two degrees of freedom to the closure assembly 30 (i.e., sliding and rotating about the clip) so that the face 37 can be aligned and the outer perimeter or a portion of the face 37 is compressed against sealing surface 38*b*. The opening 413*e* has an internal diameter greater than the outer dimension of the C-clip 413*b* so that the opening 413*e* preferably does not contact the outer surface of the C-clip 413*b* when the closure assembly 30 is installed in the dry sprinkler 10.

The dry sprinkler 10 of this embodiment can be assembled as described above in relation to the second preferred embodiment and further in the following manner with regard to the C-clip 413*b*. The C-clip 413*b* is inserted through the opening 413*e* of the closure assembly 30, which opening 413*e* has a larger inner diameter than the outer diameter of the C-clip to allow relative movement (i.e., two-degrees of freedom) therebetween so that the outer perimeter or a portion of the face 37 can be compressed against sealing surface 38*b*. The C-clip 413*b* is compressed radially with respect the longitudinal axis A-A so that each leg 413*c*, 413*d* can be mounted in the groove 413*a*. Depending on whether an assist spring is desired, a biasing member in the form of a assist spring 55 is thereafter placed into the interior surface 23*b* of the inlet fitting 23, as shown in FIG. 6F. Thus, a partially assembled dry sprinkler is provided at this point. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

Figure 6E:
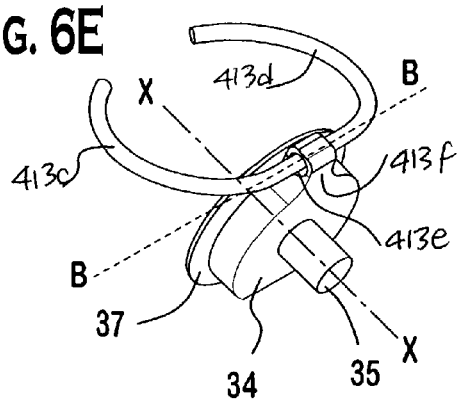
Figure 6F:
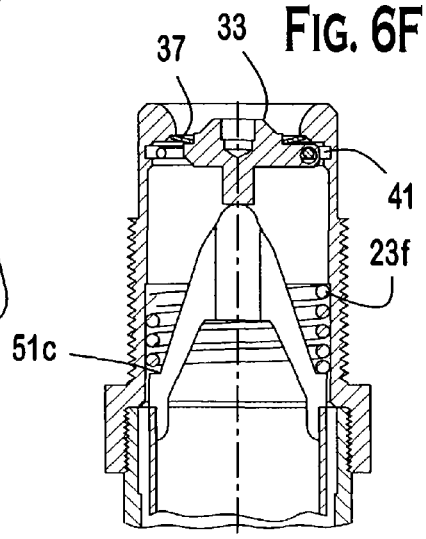

In operation, when the dry sprinkler is actuated so that the locator 50 is translated from the first position to the second position, the clip 413*b* provides a pivot axis B-B offset from the longitudinal axis A-A for the boss 413*f* so that the closure assembly 30 can generally rotate about this pivot axis B-B (FIG. 6E). By virtue of the pivot axis B-B, the face 37 is skewed with respect to the longitudinal axis A-A and the expected flow rate is achieved from the dry sprinkler to permit water to flow through the inlet and from the outlet at the expected flow rate.

Referring to the seventh preferred embodiment, as shown in FIGS. 7A-7E, another configuration of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, as shown in FIG. 7D, the first yoke support end 51*a* of yoke 51 (of the inner assembly 501) has a generally planar surface 51*c* extending preferably in an oblique direction relative to the longitudinal axis A-A such that the planar surface 51*c* intersects another generally planar surface 49*b* to form a generally linear edge 51*e*. The linear edge 51*e* extends preferably along an axis B-B generally orthogonal and offset to the longitudinal axis A-A. The linear edge 51*e* contiguously engages a generally planar surface 35 of the closure assembly 30. Preferably, the linear edge 51*e* is formed by two co-extensive planar surfaces 51*c* and 49*b*. Each of the members 52*a* and 52*b* has central portion and two projections at appropriate angles that diverge from the longitudinal axis A-A.

In this preferred embodiment, the linear edge 51*e* should contact the support surface 35 of the closure assembly 30 at a location of about 0.05 inches radially offset relative to the longitudinal axis A-A. A ratio of the distance of the outer perimeter of the face 37 relative to the radially offset distance can be established so that the proportion of the offset should be maintained with various rated K-factors of the preferred embodiments. Preferably, the ratio of the diameter of the face 37 relative to the offset distance is about 15:1 such that a proportional offset distance is maintained should the dry sprinkler be enlarged in size. The engagement of the linear edge 51*e* places the outer perimeter or a portion of the face 37 against the inlet sealing surface 38*b* of the inlet fitting 23. Because the face 37 is essentially fixed with respect to the inlet sealing surface 38*b*, any side loading being imposed by the linear edge 51*e* is negligible when the face 37 is compressed against inlet sealing surface 38*b* in a fully assembled state. As mounted in the first position of the inner assembly 501 in the dry sprinkler 10, the linear edge 51*e* forms a line contact support with the generally planar surface 35 of the closure assembly 30.

The dry sprinkler of this preferred embodiment can be assembled by placing the closure body 30 into the inlet fitting 23 so that the outer perimeter or a portion of the face 37 contacts the sealing surface 38*b*. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

In operation, when the dry sprinkler is actuated so that the locator 50 is translated from the first position to the second position, the closure assembly 30 is forced to translate due to and the flow of water impacting against the closure assembly 30 on the linear edge 51*e*. That is, due to water flowing against the surface of the closure assembly, the closure assembly 30 is unbalanced on the linear edge 51*e*. Thus, the central axis X-X of the face 37 is skewed with respect to the longitudinal axis A-A and the expected flow rate is achieved from the dry sprinkler as the locator 50 is moved from proximate the first position (FIG. 7A) to the second position (FIG. 7C).

Figure 8C:
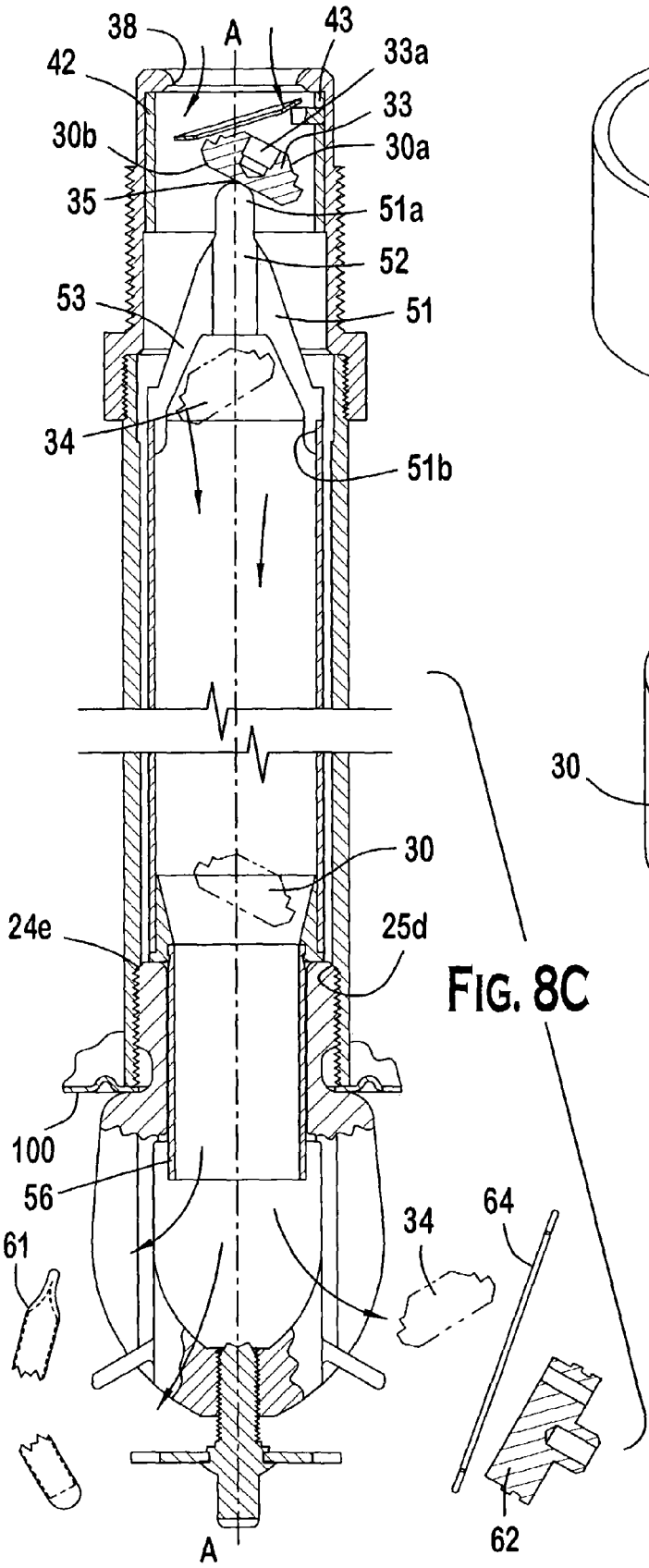
Figure 8D:
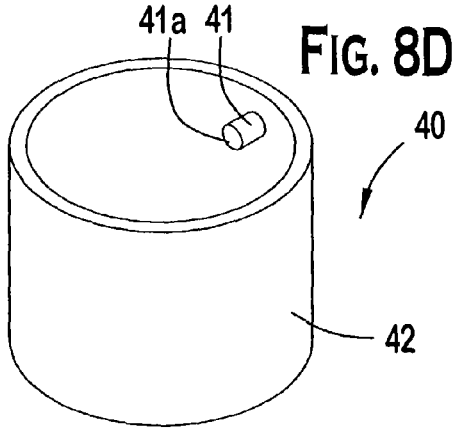

Referring to the eighth preferred embodiment, as shown in FIGS. 8A-8F, another arrangement of components of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, referring to FIGS. 8A and 8C, the closure assembly 30 includes a body 34 with a top portion 33. The face 37 is preferably fitted to the top portion 33 in a slide-fitted—as opposed to a press-fitted—configuration so that the face 37 is separable from the top portion 33, and in contrast to previous preferred embodiments, the closure assembly 30 is not pinned to the inner assembly 501 in this embodiment. A suitable contact member, such as, for example, a boss portion, projection or pin can be provided in the passageway 20*a* so that the contact member can contact the closure assembly 30 during actuation of the dry sprinkler 10. Preferably, as illustrated in FIG. 8D, the contact member is a projection 41 having a free end 41*a* that extends generally orthogonal to the longitudinal axis A-A. The projection 41 can be coupled to the inner inlet fitting surface 23*b*. In a preferred embodiment, the projection 41 is a separate member coupled to the sleeve 42.

Figure 8E:
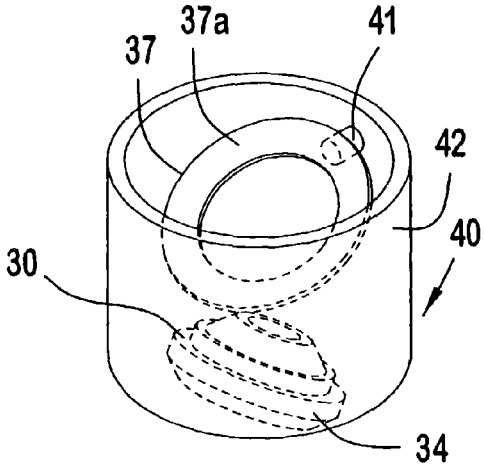
Figure 8F:
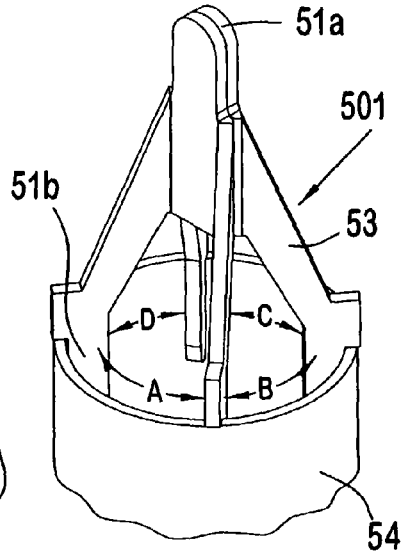
Figure 10C:
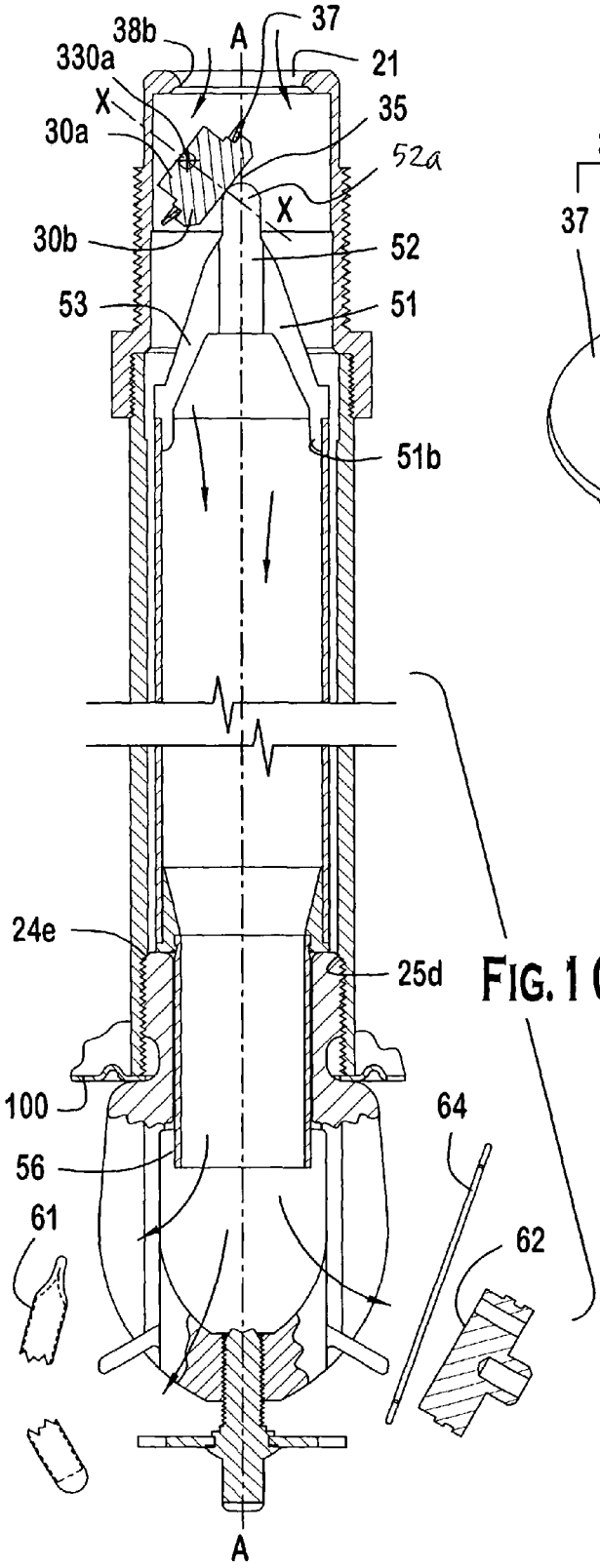
Figure 10D:
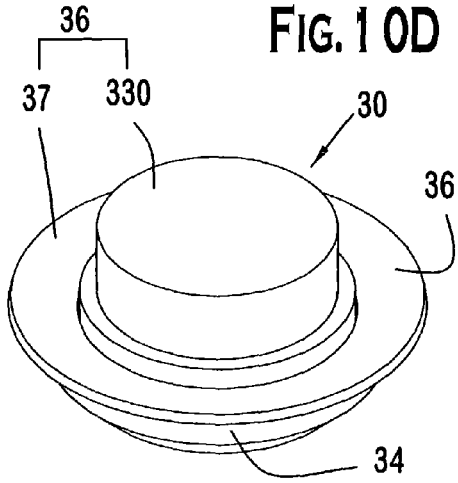
Figure 10E:
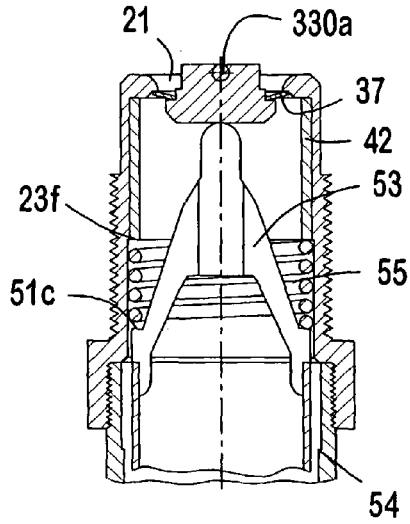
Figure 11C:
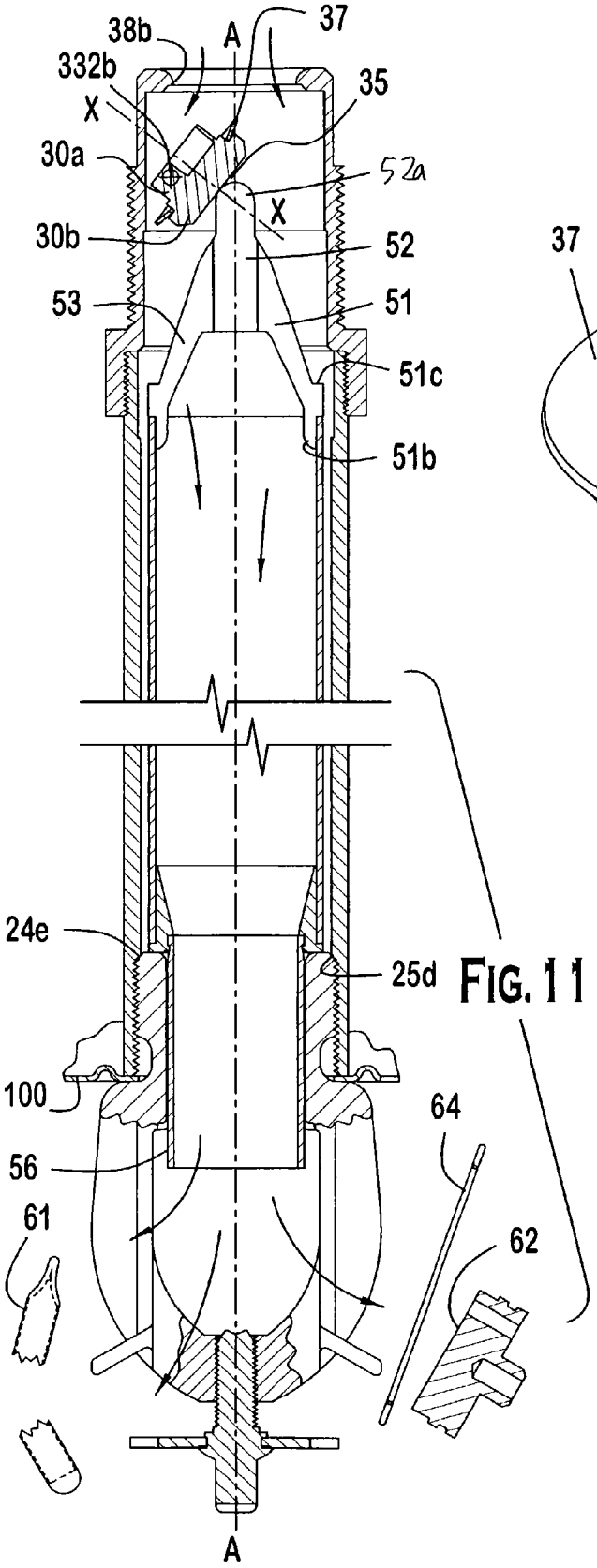
Figure 11D:
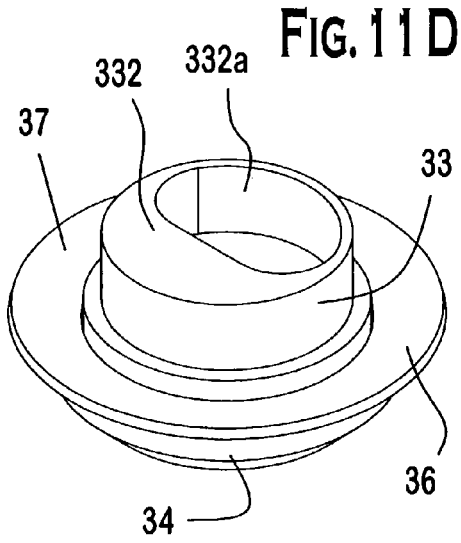
Figure 11E:
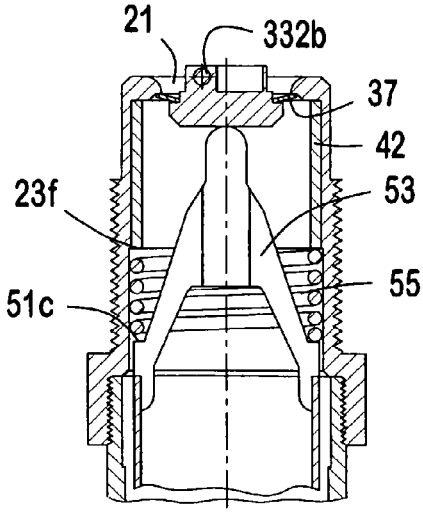

Although the yoke 51 was described above, an explanation of the additional details of the yoke 51 is appropriate here. With respect to this embodiment, the first yoke support end 51*a* has a generally arcuate surface and has at least one elongate member 52 that is coupled to at least two support legs 53 that provide the second yoke support end 51*b*. The first yoke end 51*a* can contact the generally planar surface 35 of the closure assembly 30. The second yoke end 51*b* can be coupled to a portion of the inner assembly 501, and preferably, the water tube 24. Each of the members 52*a* and 52*b* has central portion and two projections at appropriate angles that diverge from the longitudinal axis A-A. Preferably, a projection of one stamped metal member is adjacent the projection of another sheet member such that an obtuse angle is formed therebetween as viewed from the inlet 21. The projections of respective stamped metal members 52*a* and 52*b* are configured such that they form four sectors about the longitudinal axis A-A, where a pair of diametrical sectors of generally equal first arcuate distance is interposed by a pair of diametrical sectors of generally equal second arcuate distance, and where the first arcuate distance is greater than the second. For example, as shown in FIG. 8F, a first arcuate sector A has an arcuate distance greater than the second arcuate section B, a third arcuate section C diametrically opposite the first arcuate sector A has generally the same arcuate distance as the first arcuate sector A, and a fourth arcuate sector D diametrically opposite the second arcuate sector B has generally the same arcuate distance as the second arcuate sector B. This arrangement of arcuate sectors may be sized to permit the closure body 30 to fall through the yoke 51 and out of the dry sprinkler such that substantially all other components of the locator remain with the dry sprinkler.

The dry sprinkler of this preferred embodiment can be assembled by placing the closure body 30 into the inlet fitting 23 so that the outer perimeter or a portion of the face 37 contacts the sealing surface 38*b*. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

In operation, when the dry sprinkler is actuated so that the locator 50 is translated along axis A-A, the outer perimeter or a portion of the face 37 contacts the free end 41*a* of projection 41. This contact between the outer perimeter or a portion of the face 37 and the projection 41 causes the face 37 to separate from the body portion 34 of the closure assembly 30, as shown in FIG. 8E so that the central axis X-X of the face 37 is skewed from the longitudinal axis A-A. Due to the position of the projection member 41 over one of the larger arcuate sectors A and C defined by the multi-legged yoke 51, shown in FIG. 8F, the body portion 34 of the closure assembly may fall through one of the two arcuate sectors A and C, and through the inner assembly 501 as the locator 50 is moved from proximate the first position (FIG. 8A) to the second position (FIG. 8C). It is noted that the inner assembly 501 is moved for a predetermined distance within the structure 20, and substantially all portions of the inner assembly 501 are retained within the outer perimeter of the structure 20.

Referring to the ninth preferred embodiment, as shown in FIGS. 9A-9E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, with reference to FIG. 9D, a closure assembly 30 with an extension 400 is provided. The extension 400 has a radius of curvature that can be formed on the support surface 35 and positioned anywhere on the support surface 35. In a preferred embodiment, the extension 400 in the form of a spheroidal member 400 can be formed on the support surface 35 proximate the longitudinal axis A-A. The closure assembly 30 is supported by engagement of the extension 400 against a generally planar or arcuate surface 551*a* (FIG. 9C) or 551*b* (FIG. 9D) of yoke 51 so that the face 37, in an unactuated position, is preferably compressed against the inlet sealing surface 38*b*. Preferably, the spheroidal member 400 has a diameter that is about ¼ of the outer perimeter of the face 37 in its fully compressed form.

The dry sprinkler of this preferred embodiment can be assembled by placing the closure body 30 into the inlet fitting 23 so that the outer perimeter or a portion of the face 37 contacts the sealing surface 38*b*. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

In operation, when the dry sprinkler is actuated so that the locator 50 is translated along axis A-A, the face 37 separates from the sealing surface 38*b*. Once the outer perimeter or a portion of the face 37 is no longer in contact with inlet sealing surface 38*b*, the closure assembly 30 is free to roll on either surface 551*a* or 551*b* of yoke support 51*a* about a moving center of rotation such that the closure assembly 30 may fall off the yoke support 51*a* into, for example, arcuate sector A or C (FIG. 9D). Due to the preferred configuration of extension 400, the extension 400 allows the face 37 to be skewed with respect to the longitudinal axis A-A and the expected flow rate is provided by the dry sprinkler.

Referring to the tenth preferred embodiment as shown in FIGS. 10A-10E, another configuration of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, a closure assembly 30 with an extended top portion 330 is provided. The top portion 330 can be in the shape of a cone or preferably right angle cylinder. The first end 30*a* preferably extends toward the second end 30*b*. The body portion 34 can be formed with a support surface 35 that, in a preferred embodiment, is generally planar. The body portion 34 can also support a metallic disc annulus 36 such that the outer perimeter or a portion of the face 37 of the metallic disc annulus can form a seal with the inlet 21. The body portion 34 of closure assembly 30 is formed such that a majority of the mass of the closure assembly 30 is preferably located proximate top portion 330 proximate the first end 30*a* between the sealing surface 38*b* and the inlet 21. This allows for the center of gravity 330*a* of the closure assembly 30 to be spaced at a predetermined distance from the yoke 51 and generally coincident along the longitudinal axis A-A.

The dry sprinkler of this preferred embodiment can be assembled by placing the closure body 30 into the inlet fitting 23 so that the outer perimeter or a portion of the face 37 contacts the sealing surface 38*b*. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

In operation, when the dry sprinkler is actuated so that the locator 50 is translated from the first position to the second position, the face 37 separates from the sealing surface 38*b*. Because the center of gravity 331 located proximate the top portion 330, the center of gravity is believed to cause the closure assembly to roll on the generally arcuate surface of the elongate member 52 such that the closure assembly falls off the yoke support 51*a*. Thus, closure assembly 30 is generally moved to one side of and along the longitudinal axis A-A as the locator 50 is moved from proximate the first position (FIG. 10A) to the second position (FIG. 10C) so that the central axis X-X of the face 37 is skewed with respect to the longitudinal axis and the expected flow rate is provided by the dry sprinkler.

Referring to the eleventh preferred embodiment as shown in FIGS. 11A-11E, another arrangement of components of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the locator 50 includes a closure assembly 30 with an extended top portion 332 and a recessed chamber 332*a*. The closure assembly 30 includes a body 34 with a first end 30*a* and second end 30*b*. The first end 30*a* includes a top portion 332 that can be in the shape of a cone or, preferably, a right angle cylinder. The first end 30*a* preferably extends toward the second end 30*b*. The body portion 34 can be formed with a support surface 35 that, in a preferred embodiment, is generally planar. A recessed chamber 332*a* can be formed proximate the top portion 332. The recessed chamber 332*a* can be disposed symmetric to the longitudinal axis A-A. The chamber 332*a*, however, is disposed in an offset manner relative to the longitudinal axis A-A. The metallic disc annulus 36 is disposed on the closure assembly 30 so that the outer perimeter or a portion of the face 37 forms a seal with respect to the inlet 21. The face 37 is configured so as to surround the top portion 332. The body of closure assembly 30 is formed such that a majority of the mass of the closure assembly 30 is preferably located proximate top portion 332 proximate the first end 30*a* between the sealing surface 38*b* and the inlet 21 and offset to the longitudinal axis A-A. This allows for the center of gravity 332*b* of the closure assembly 30 to be spaced at a predetermined distance from the yoke 51 and offset along the longitudinal axis A-A.

The dry sprinkler of the preferred embodiment can be assembled in a similar manner as the previous embodiment.

In operation, when the dry sprinkler is actuated so that the locator 50 is translated from the first position to the second position, the face 37 separates from the sealing surface 38*b*. Because the center of gravity 332*b* located proximate the top portion 332, the center of gravity 332*b* is believed to cause the closure assembly 30 to roll on the generally arcuate surface 51*a* of yoke 51 such that the closure assembly may fall off the yoke surface 51*a*. Thus, closure assembly 30 is generally moved to one side of and along the longitudinal axis A-A as the locator 50 is moved from proximate the first position (FIG. 11A) to the second position (FIG. 11C) 37 so that the central axis X-X of the face 37 is skewed to the longitudinal axis A-A and the expected flow rate is provided from the dry sprinkler.

Referring to the twelfth preferred embodiment, as shown in FIGS. 12A-12E, another arrangement of components of a locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, a closure assembly 30 with a tether is provided with a suitable tether assembly 414*a*, such as, for example, a cord, a wire, a chain, or a link. The tether assembly 414*a* can provide a restraining force that locates the closure assembly 30 on one side of the longitudinal axis A-A.

Preferably, as illustrated in FIGS. 12A-12D, the tether assembly 414*a* includes a cord 414*b* connected to a tether mount 414*c* by a first attachment device 414*d*. The cord 414*b* is also connected to the closure assembly 30 by a second attachment device 414*e*. The second attachment device 414*e* is located proximate the peripheral edge of the outlet facing surface 34*a* of the closure assembly 30 so that the second attachment device 414*e* is offset from the longitudinal axis A-A. The attachment devices 414*d*, 414*e* can be solder joints, rivets, or, preferably, screws. The tether mount 414*d* or 414*e* can be secured to the respective component by a press fit, an adhesive, a tack weld, or other suitable securement.

Figure 12C:
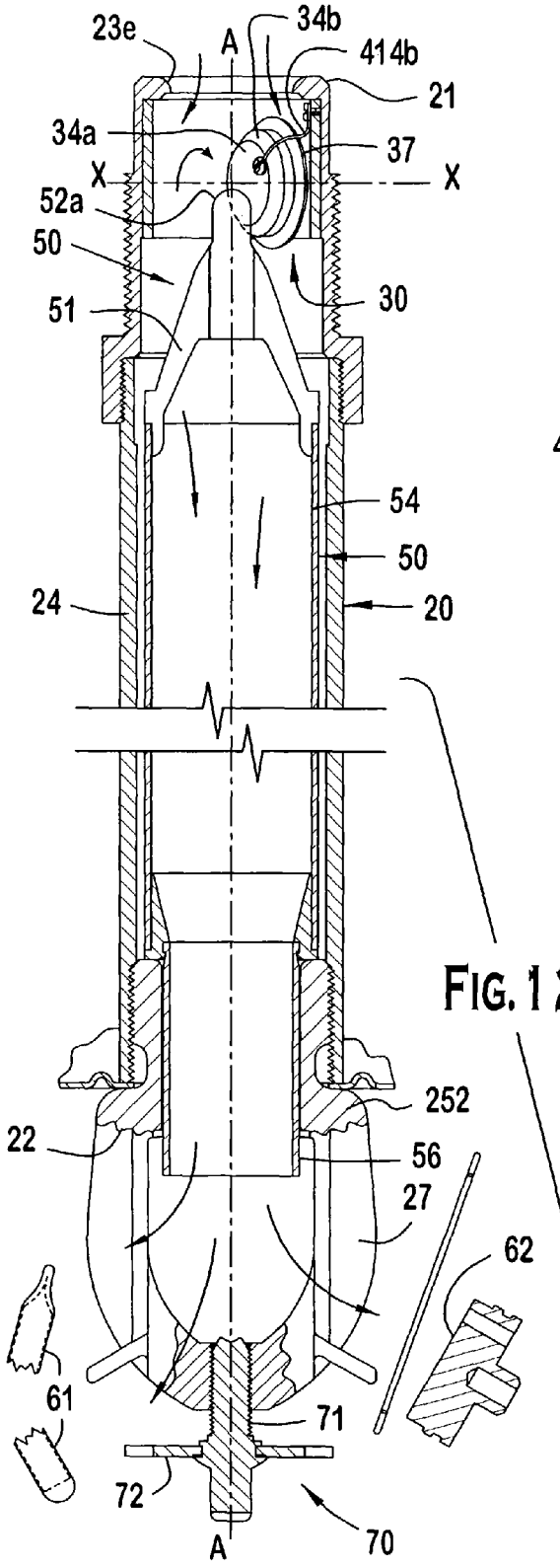
Figure 12D:
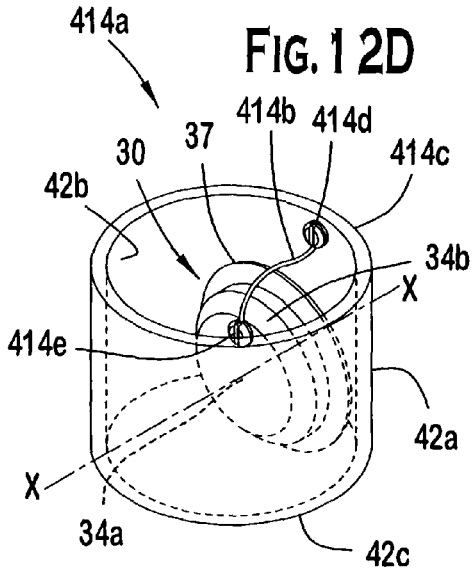
Figure 12E:
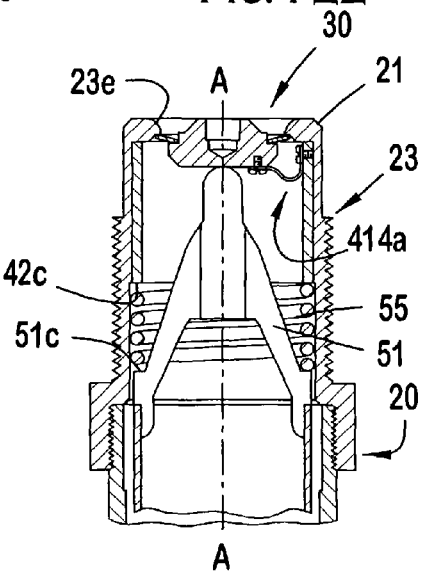

The dry sprinkler 10 of this embodiment can be assembled as described above in relation to the third preferred embodiment of the dry sprinkler and further in the following manner with regard to the tether assembly 414*a*. The closure assembly 30 is placed in the inlet 21 so that the outer perimeter or a portion of the face 37 contacts a sealing surface 38*b* of the inlet 21. A tether mount 414*d* is then connected to the inlet. The cord 414*b* is then coupled to closure assembly 30 at surface 34*a* by the second attachment device 414*e*. If an assist spring is desired, a biasing member 55, in the form of a coil spring, is thereafter placed into the interior surface 23*b* of the inlet fitting 23, as shown in FIG. 12E. Thus, a partially assembled dry sprinkler is provided 51 and trigger assembly 60 can be mounted to the partially assembled dry sprinkler to provide a complete dry sprinkler as described earlier.

In operation, when the dry sprinkler is actuated so that the locator 50 is translated from the first position to the second position, the face 37 separates from the sealing surface 38*b* and the closure assembly 30 begins to fall towards the outlet. However, the length of the cord 414*b* is less than the distance between the first position and the second position of the inner assembly 501 along the longitudinal axis A-A. As the closure assembly 30 moves along axis A-A, any slack in the cord 414*b* is taken up and the closure assembly 30 also begins to move along the arcuate surface 52*a* of the elongate member 52. Due in part to the restraining force of the cord 414*a* on the closure assembly 30 and the relative movement between the closure assembly 30 and the elongate member 52, the closure assembly 30 is sufficiently tipped to cause the center of mass of the closure assembly 30 to be offset relative to the longitudinal axis A-A, as shown in FIG. 4. Thus, closure assembly 30 is generally moved to be on one side of and along the longitudinal axis A-A as the inner assembly 501 is moved from proximate the first position (FIG. 12A) to the second position (FIG. 12C) so that the central axis X-X of the face 37 is skewed from the longitudinal axis A-A and the expected flow rated is provided by the dry sprinkler.

Referring to the thirteenth preferred embodiment, as shown in FIGS. 13A-13E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, as shown in FIGS. 13A, 13C, and 13D, closure assembly 30 has a first end 30*a* and second end 30*b*. A first portion 33 is adjacent a second portion 34. The second portion 34 is formed with a surface 34*a* facing the outlet end 22 and a beveled surface 34*b* abutting the peripheral edge of the outlet facing surface 34*a*. A spring retainer 34*c* is located proximate the peripheral edge of the outlet facing surface 34*a* so that the spring retainer 34*c* is offset from the longitudinal axis A-A. The spring retainer 34*c* can be a recess, as shown in the preferred embodiment of FIGS. 13A-13E. The spring retainer 34*c* allows one end 416*a* of a compression spring 416 to be disposed therein. Preferably, the compression spring 416 is a coil spring. A first end 416*a* of the compression spring 416 is supported on a yoke 51 of the inner assembly 501 via a post 59. A first end 416*a* of the compression spring 416 is in releasable engagement with the spring retainer 34*c* provided on the body of the closure assembly 30. Also preferably, the compression spring 416 has a spring force of approximately 5 to 8 pounds force.

The dry sprinkler 10 of this embodiment can be assembled as described above in relation to the third preferred embodiment of the dry sprinkler and further in the following manner with regard to the compression spring 416. The surface 36, which includes the first portion 33 and the face 37, is placed in the inlet 21 so that the outer perimeter or a portion of the face 37 contacts a sealing surface 38*b* of the inlet 21. Depending on whether an assist spring is desired, a spring spacer or sleeve 42 is inserted in the inlet fitting 23 and a biasing member 55, in the form of a coil spring, is thereafter placed into the interior surface 23*b* of the inlet fitting 23, as shown in FIG. 13E.

The second support end 51*b* of the multi-legged yoke 51 is pressed into the fluid tube 54 so that the multi-legged yoke 51 is coupled to the fluid tube 54. The second end 418*b* of compression spring 416 is then coupled to the multi-legged yoke 51 on post 59 so that the compression spring 416 rests on boss 53*a*. The fluid tube 54 is coupled to the guide tube 56 to form an inner assembly 501. The casing tube 24 is coupled by threads to the inlet fitting 23 and the inner assembly 501 can be inserted through the casing tube 24. As the inner assembly 501 is inserted through the casing tube 24, the first yoke support end 51*a* supports the closure assembly 30 to place the resilient face 37 of the metallic disc annulus 36 against the sealing surface 38*b* of the inlet fitting 23. The first end 416*a* of compression spring 416 contacts the closure assembly 30 at spring retainer 34*c*. Thus, a partially assembled dry sprinkler is provided at this point. Thereafter, the yoke 51 and trigger assembly 60 can be mounted to the partially assembled dry sprinkler to provide a complete dry sprinkler.

In operation, when the dry sprinkler is actuated so that the locator 50 is translated from the first position to the second position, the compression spring 416 expands along the post 59 and the first end 416*a* of the compression spring 416 pushes on the body of the closure assembly 30 along the longitudinal axis A-A. The closure assembly 30 is therefore sufficiently tipped to one side of the longitudinal axis A-A to cause the center of mass of the closure assembly 30 to be offset relative to the longitudinal axis A-A, as shown in FIG. 13C, due in part by the spring force provided by the compression spring 416. Thus, closure assembly 30 is generally pushed by the compression spring 416 so that the central axis X-X of the face 37 is skewed to the longitudinal axis A-A and the expected flow rate is provided by the dry sprinkler.

Referring to the fourteenth preferred embodiment, as shown in FIGS. 14A-14E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, as shown in FIGS. 14A, 14C, and 14D, closure assembly 30 includes a body with a first end 30*a* and second end 30*b*. A first portion 33 is adjacent a second portion 34. The second portion 34 is formed with a surface 34*a* facing the outlet end 22 and a beveled surface 34*b* abutting the peripheral edge of the outlet facing surface 34*a*. A spring retainer 34*c* is located proximate the peripheral edge of the outlet facing surface 34*a* so that the spring retainer 34*c* is offset from the longitudinal axis A-A. The tension spring 418 is a coil spring. A second end 418*b* of the tension spring 418 is connected to a yoke 51 of the inner assembly 501. A first end 418*a* of the tension spring 418 is connected to the body of the closure assembly 30. Also preferably, the tension spring 418 has a spring force of approximately 5 to 8 pounds force, which is believed to be the minimum spring force required for operation of the preferred embodiment.

The tension spring 418 can be connected to the closure member 30 and the yoke 51 by screws, rivets, hook ends, or other suitable securement. Preferably, the second end 418*b* of the tension spring 418 includes a hook that passes through a hole 53*a* provided in the yoke and a screw 43 can connect the first end 418*a* of the tension spring 418 to the body of the closure assembly 30. The spring retainer 34*c* can be a screw that extends through a loop provided at the second end 418*b* of the tension spring 418 and is fastened to the body of the closure assembly 30 proximate the peripheral edge of the outlet facing surface 34*a*, FIG. 14D.

The dry sprinkler 10 of this embodiment can be assembled as described above in relation to the thirteenth preferred embodiment of the dry sprinkler and further in the following manner with regard to the tension spring 418. The surface 36, which includes the first portion 33 and the face 37, is placed in the inlet 21 so that the resilient sealing member contacts a sealing surface 38*b* of the inlet 21. Depending on whether an assist spring is desired, a spring spacer 28 is inserted in the inlet fitting 23 and a biasing member 55, in the form of a coil spring, is thereafter placed into the interior surface 23*b* of the inlet fitting 23.

The second support end 51*b* of the multi-legged yoke 51 is pressed into the fluid tube 54 so that the multi-legged yoke 51 is coupled to the fluid tube 54. The second end 418*b* of tension spring 418 is then coupled to the multi-legged yoke 51. The fluid tube 54 is coupled to the guide tube 56 to form the inner assembly 501. The casing tube 24 can be coupled by threads to the inlet fitting 23 and the inner assembly 501 can be inserted through the casing tube 24. As the inner assembly 501 is inserted through the casing tube 24, the first yoke support end 51*a* supports the closure assembly 30 to place the resilient face 37 of the metallic disc annulus 36 against the sealing surface 38*b* of the inlet fitting 23. The first end 418*a* of tension spring 418 is then attached to surface 34*a*, at spring retainer 34*c*, preferably with a screw 53. Thus, a partially assembled dry sprinkler is provided at this point. Thereafter, the yoke 51 and trigger assembly 60 can be mounted to the partially assembled dry sprinkler to provide a complete dry sprinkler as described earlier.

In operation, when the dry sprinkler is actuated so that the locator 50 is translated from the first position to the second position, the tension spring 418 contracts along the longitudinal axis A-A and the first end 418*a* of the tension spring 418 pulls on the body of the closure assembly 30 along the longitudinal axis A-A. Further contraction by the tension spring 418 moves the closure assembly 30 along the arcuate surface 52*a* of the elongate member 52. Thereafter, the closure assembly 30 is sufficiently tipped to one side of the longitudinal axis A-A to cause the center of mass of the closure assembly 30 to be offset relative to the longitudinal axis A-A, as shown in FIG. 13C, due in part by the spring force provided by the tension spring 418. Thus, closure assembly 30 is generally pulled by the tension spring 418 to be one side of and along the longitudinal axis A-A so that the central axis X-X of the face 37 is skewed from the longitudinal axis A-A and the expected flow rate is provided by the dry sprinkler.

Referring to the fifteenth preferred embodiment, as shown in FIGS. 15A-15E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the closure assembly 30 includes a first portion 33 is adjacent a second portion 34. The second portion 34 is formed with a surface 34*a* facing the outlet end 22 and a beveled surface 34*b* abutting the peripheral edge of the outlet facing surface 34*a*. A first pivot 420*a* and a second pivot 420*b* extend from the outlet facing surface 34*a*. The first pivot 420*a* and the second pivot 420*b* each have a pivot axis that is transverse to the longitudinal axis A-A. Preferably, the transverse axes of the first pivot 420*a* and the second pivot 420*b* are approximately equidistantly spaced from the longitudinal axis A-A when the closure assembly 30 is in the non-actuated position. The closure-assembly 30 is also connected to a strap assembly 422 that includes a first strap 422*a* and a second strap 424*a*. The second strap 424*a* is longer than the first strap 422*a*. First ends 422*b*, 424*b* of the straps 422*a*, 424*a*, respectively, are connected to the closure assembly 30, FIG. 15D. Second ends 422*c*, 424*c* of the straps 422*a*, 424*a*, respectively, are connected to a biasing member 55 (FIG. 15D). The first strap 422*a* and the second strap 424*a* cooperate to move the closure assembly 30 to the side of the longitudinal axis A-A and rotated 90 degrees to minimize the flow area, FIG. 15C. The first strap 422*a* and the second strap 424*a* can be made from a plastic material, a metallic material or other material that will provide sufficient rigidity so that the straps 422*a* and 424*a*, at most, minimally flexes when the closure assembly 30 is in either of the closed position or (FIG. 15A) the open position (FIG. 15C). As illustrated in FIGS. 15A, 15D and 15E, each ends of the straps 422*a*, 424*a* includes a loop for connecting the straps to the closure assembly 30 and to the biasing member 55. The loops of the first ends 422*b*, 424*b* are coupled to a respective one of the pivots 420*a*, 420*b*. The loops of the second ends 422*c*, 424*c* are coupled to respective first and second coil 55A and 55B.

The inner assembly 501 includes a truncated yoke 151 connected to the fluid tube 54 and guide tube 56. The truncated yoke 151 has preferably four legs 53 arrayed about the longitudinal axis A-A from a central portion 52. The truncated yoke 151 does not contact the closure assembly 30 in this embodiment.

In operation, when the dry sprinkler is actuated so that the locator 50 is translated along the longitudinal axis A-A from proximate the first position (FIG. 15A) to the second position (FIG. 15C), the second coil 55*b* of the biasing member 55 and the second end 420*c* of the second strap 424*a* translate along the longitudinal axis A-A while the first coil 55*a* of the biasing member 55 and the second end 422*c* of the first strap 422*a* remain proximate the edge 128*a* of the spring spacer 128. As the second end 55*b* of the biasing member 55 translates along the longitudinal axis A-A, the second strap 424*a* pulls the closure assembly 30 along the longitudinal axis A-A and pivots the first strap 422*a* about the first coil 55*a* at pivot 427. The first strap 422*a* pushes the closure assembly toward a side of the longitudinal axis A-A as the first strap 422*a* pivots about the first coil 55*a* at pivot 427. In turn, the closure assembly 30 pivots about both of the pivots 420*a*, 420*b* to locate the sealing surface on a side of the longitudinal axis A-A, FIG. 15D. The sealing surface 37 is pivoted about the transverse axes by the pulling the transverse axes of the second pivot 420*b* a first side of the longitudinal axis A-A and by the pushing the transverse axes of the first pivot 420*a* to the first side of the longitudinal axis A-A from a second side of the longitudinal axis A-A that is opposite to the first side. Thus, relative motion between the second end 422*c* of the first strap 422*a* and the second end 424*c* of the second strap 424*a* pivots the closure assembly 30 about the transverse axes of the pivots 420*a*, 420*b* so that the central axis X-X of the face 37 is skewed with respect to the longitudinal axis A-A and the expected flow rate is provided by the dry sprinkler.

Referring to the sixteenth preferred embodiment, as shown in FIGS. 16A-16E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the closure assembly 30 includes a second portion 34 formed with a surface 34*a* facing the outlet end 22 and a beveled surface 34*b* abutting the peripheral edge of the outlet facing surface 34*a*. A pivot 426 extends from the outlet facing surface 34*a*. The pivot 426 has a pivot axis B-B that is transverse to the longitudinal axis A-A. Preferably, the transverse axis B-B of the pivot 426 is offset from the longitudinal axis A-A when the closure assembly 30 is in the non-actuated position, FIG. 16A. A face 37 of a metallic disc annulus disc 36 is mounted so as to surround the first portion 33.

Preferably, as illustrated in FIGS. 16A, 16B, and 16D, a strap 428 includes a first end 428*a* connected to the closure assembly 30 and a second end 428*b* connected to a biasing member 55. The strap 428 moves the sealing surface 37 of the closure assembly 30 to the side of the longitudinal axis A-A, FIG. 16E. The strap 428 can be made from a plastic material, a metallic material or other material that will provide sufficient rigidity so that the strap 428 does not flex when the closure assembly 30 is in either of the closed position or (FIG. 16B) the open position (FIG. 16C). In the preferred embodiment as illustrated in FIGS. 16A-16E, each end 428*a*, 428*b* of the strap 428 includes a loop for connecting the strap 428 to the closure assembly 30 and to the biasing member 55. The loop of the first end 428*a* is coupled to the pivot 426. The biasing member 55 can include a coil spring. The loop of the second end 428*b* of the strap 428 is pivotally coupled to a first coil 55*a* at pivot 427.

In operation, when the dry sprinkler is actuated, the closure assembly 30 moves along the longitudinal axis A-A from proximate the first position (FIGS. 16A and 16D) to the second position (FIGS. 16C and 16E), the strap 428 pivots from a first strap position (FIGS. 16A and 16D)—where the strap 428 is spaced from the elongate member 52 of the yoke 51—to a second strap position (FIGS. 16C and 16E)—where the strap 428 engages the elongate member 52 to move the sealing surface of the closure assembly 30 about the transverse axes of the pivots 426 and 427—so that the face 37 of the metallic disc 36 is located on one side of the longitudinal axis A-A.

The coil 55*a* of the biasing member 55 and the second end 428*b* of the strap 428 remain proximate the edge 28*a* of the spring spacer as the inner assembly 501 translates along the longitudinal axis A-A. The strap 428 pivots about the coil 55*a* of the biasing member 55 and pushes the closure assembly 30 along the arcuate surface 52*a* of the elongate member 52. The strap 428 has a length sufficient to move the pivot 426, and the transverse axis of the pivot 426, from a first side of the longitudinal axis A-A to the a second side of the longitudinal axis A-A opposite the first side when the strap 428 engages the elongate member 52 of the yoke 51, FIG. 16D. Here, the closure assembly 30 is sufficiently tipped about the transverse axis of the pivot 426 to cause the center of mass of the closure assembly 30 to be offset relative to the longitudinal axis A-A, as shown in FIG. 16E, due in part by the motive force provided by the strap 428. Thus, the closure assembly 30 is generally moved by the strap 428 to be on a side of and along the longitudinal axis A-A as the inner assembly 501 is moved from proximate the first position (FIGS. 16A and 16D) to the second position (FIGS. 16C and 16E) so that the central axis X-X of the face 37 is skewed with respect to the longitudinal axis A-A and the expected flow rate is provided by the dry sprinkler.

Referring to the seventeenth preferred embodiment, as shown in FIGS. 17A-17I, another configuration of the locator 50 is provided for repositioning of the face 37 so that the central axis X-X of the face 37 is skewed to the longitudinal axis A-A in an actuated condition of the dry sprinkler 10 and the expected flow rate to be achieved from the dry sprinkler. A closure assembly 300 includes a main body 300*a* and cap 300*b*. The main body 300*a* includes a first portion 33 that is adjacent to a second portion 34. The second portion 34 cooperates with the cap 300*b* to form a hole 300*c*. The cap 300*b* can be attached to the main body 300*a* by one or more screws 300*d*, or by any other fastener suitable for connecting the main body 300*a* and the cap 300*b*. The closure assembly 300 is mounted via the hole 300*c* for pivoting motion about a pivot axis B-B, which orthogonally intersects the longitudinal axis A-A. The hole 300*c* allows for rotation of the closure assembly 300 in the activated configuration. Alternatively, in lieu of a single hole 300*c*, relative pivoting may be accomplished by a pair of blind holes located on opposite sides of the second portion 34 and aligned along the pivot axis B-B, or any suitable arrangement that provides a shaft with a bearing surface about which the closure assembly 300 pivots. The inner assembly 501 can include a two-legged member 51, a fluid tube 54, and a guide tube 56. The member 51 is coupled to the fluid tube 54, and the fluid tube 54 is coupled to the guide tube 56, and the guide tube 56, is coupled to the trigger seat 62. The inner assembly 501 may optionally include a biasing member 55 (see FIG. 17G).

The two-legged member 51 includes a throw journal 510 located between a first main journal 512 and a second main journal 514, and thus may be shaped similar to a crankshaft. The first main journal 512 is pivotally disposed within a first bearing 542 defined by the fluid tube 54, the second main journal 514 is pivotally disposed within a second bearing 544 defined by the fluid tube 54, and the throw journal 510 is pivotally disposed within the hole 300*c*, which defines a third bearing. The third bearing, i.e., the hole 300*c*, is preferably offset along the longitudinal axis A-A with respect to the first and second bearings 542,544.

Figure 17F:
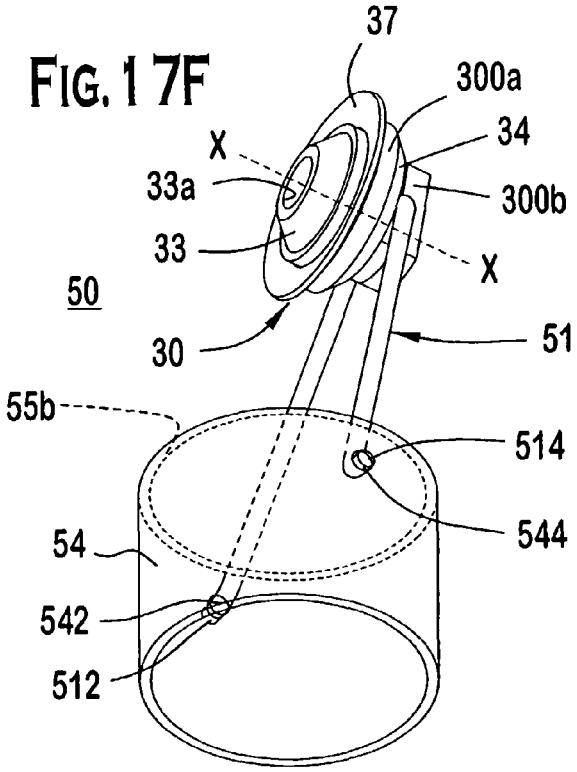
Figure 17G:
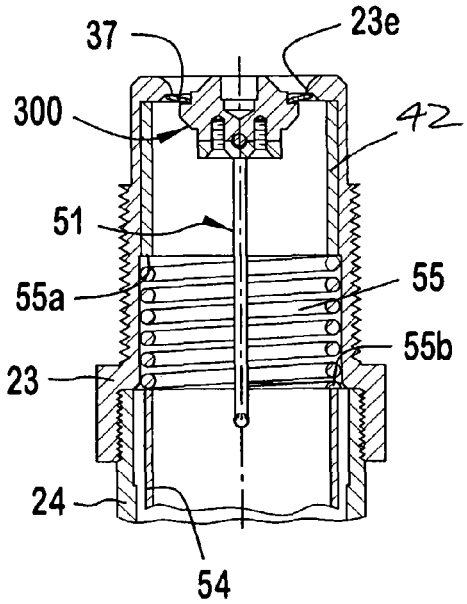

Thus, as seen in FIG. 17G, the two-legged member 51 supports the closure assembly 300 relative to the inner assembly 501 such that, in the closed position of the dry sprinkler 10, the first, second, and third bearings 542,544,300*c* lie in a plane that also includes the longitudinal axis A-A. In the actuated or open position of the dry sprinkler 10, the two-legged member 51 cooperates with the fluid tube 54 and with the closure assembly 300 to move the closure assembly 300 to a side of the longitudinal axis A-A so that the central axis X-X of the face 37 is skewed with respect to the longitudinal axis A-A and the expected flow rate is provided by the dry sprinkler.

Figure 17H:
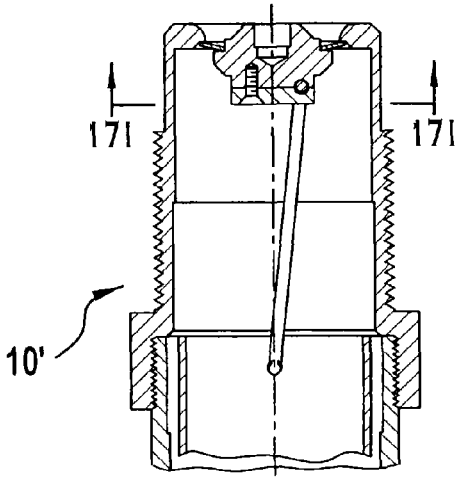
Figure 17I:
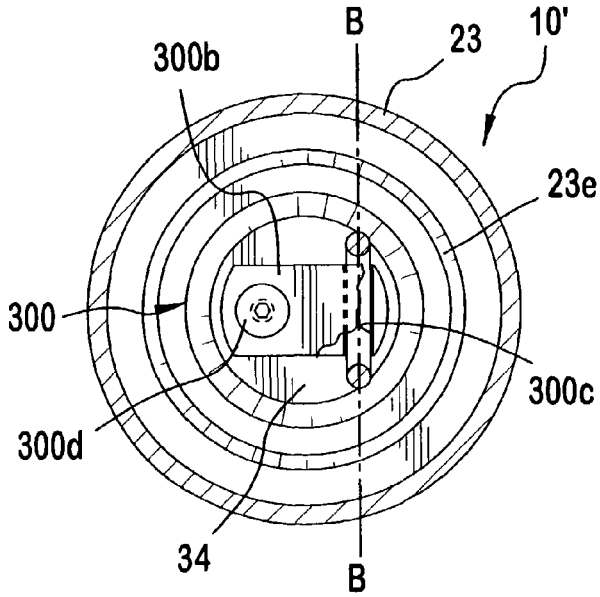

Referring now to FIGS. 17H and 17I, another configuration of the locator 50 is provided for repositioning of the face 37 so that the central axis X-X of the face 37 is skewed to the longitudinal axis A-A in an actuated condition of the dry sprinkler 10 and the expected flow rate to be achieved from the dry sprinkler. Specifically, in the closed position of the dry sprinkler 10', the plane that contains the first, second, and third bearings 542,544,300*c* is obliquely oriented with respect to the longitudinal axis A-A. The amount that the pivot axis B-B is offset from the longitudinal axis A-A is selected so as to minimally affect the engagement of the face 37 with the inlet fitting 23. That is to say, the effect of the asymmetrical support provided by the member 51 should not prevent the face 37 from properly engaging with the inlet fitting 23 so as to occlude the inlet opening 23*e*. By virtue of the pivot axis B-B being offset from the longitudinal axis A-A, the closure assembly 300 cannot avoid pivoting when the inner assembly 501 moves away from the first position.

The dry sprinkler of this embodiment can be assembled as described above in relation to the third preferred embodiment of the dry sprinkler and further in the following manner with regard to the first through third bearings and throw journal. The locator 50, including the closure assembly 30, two-legged member 51, the fluid tube 54, and the guide tube 56, are sub-assembled together, and then the whole subassembly is positioned in the casing tube 24. A guide tool is inserted, in the direction of fluid flow, through the inlet opening 23*e* and is engaged with the opening 33*a* of the closure assembly. The biasing member 55 may optionally be fitted inside the inlet fitting 23 so as to cincture the guide tool. If necessary, a sleeve 42 may also be inserted in the inlet fitting 23 to provide a seat for the biasing member 55. The tool is used to guide the closure assembly 30 the occluding position with respect to the inlet opening 23*e*, and the casing tube 24 and inlet fitting 23 are threadably coupled. While continuing to use the guide tool to maintain the closure assembly 30 in the occluding position, the outlet frame (25,251,252) including the triggering mechanism 60 is threadably coupled to the casing tube 24. Next, the adjustment screw 71 is adjusted to a sufficiently high torque value that in the final assembled position, the screw 71 in conjunction with the outer surface 25*a* will cause the outer perimeter or a portion of the face 37 to be compressed against the inlet sealing surface 38*b* and maintain all components at their intended position without damaging the frangible bulb 61.

The subassembly of the inner assembly 501 can include the following steps. The journal 510 of the two-legged member 51 can be positioned in the portion of the third bearing 300*c* defined by the main body 30*a*. The cap 30*b* is then coupled to main body 30*a* by one or more screws 30*d*, whereby the second portion 34 and cap 30*b* define the hole 300*c* that receives the throw journal 510. The first and second journals 512,514, of two legged member 51 are then held in an elastically deformed condition, aligned with the corresponding first and second bearings 542,544, and released from the elastically deformed condition so as to be received in the corresponding first and second bearings 542,544. Thus, a partially assembled dry sprinkler is provided at this point. Thereafter, the two-legged yoke 51 and trigger assembly 60 can be mounted to the partially assembled dry sprinkler to provide a complete dry sprinkler as described earlier.

In operation, when the dry sprinkler is actuated so that the locator 50 is translated, the closure assembly 300 is sufficiently rotated to cause the center of mass of the closure assembly 300 to be offset relative to the longitudinal axis A-A, as shown in FIGS. 17D and 17F, due in part to the propensity of the two-legged member 51 to pivot about all three of its journals 510,512,514. Thus, the central axis X-X of the face 37 is skewed with respect to the longitudinal axis A-A and the expected flow rate is achieved from the dry sprinkler as the locator 50 is moved from proximate the first position (FIG. 17A) to the second position (FIG. 17D).

Referring to the eighteenth preferred embodiment as shown in FIGS. 18A-18I, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, closure assembly 30 includes a body with a first end 30*a* and second end 30*b*. The second end 30*b* includes a first contact area 30*c* that faces the outlet end 22. The first contact area 30*c* defines a pivot point that is coincidental with the longitudinal axis A-A. The inner assembly 501 can include a two-legged member 51, a fluid tube 54, and a guide tube 56. The member 51 is coupled to the fluid tube 54, and the fluid tube 54 is coupled to the guide tube 56, and the guide tube 56 is coupled to the trigger seat 62. The locator 50 may optionally include a biasing member 55 (see FIG. 18G). The two-legged member 51 includes a throw journal 510*a* located between a first main journal 512*a* and a second main journal 514*a*, and thus may be shaped similar to a crankshaft. The first main journal 512*a* is pivotally disposed within a first bearing 542*a* defined by the fluid tube 54, the second main journal 514*a* is pivotally disposed within a second bearing 544*a* defined by the fluid tube 54, and the throw journal 510*a* is pivotally received by the recess 30*c*, which defines a partial bearing. The partial bearing, i.e., the recess 30*c*, is offset with respect to the first and second bearings 542*a*,544*a*.

Thus, as best seen in FIG. 18A, the two-legged member 51 supports the closure assembly 30 relative to the inner assembly 501 such that, in the closed position of the dry sprinkler 10, the first, second, and partial bearings 542*a*,544*a*,30*c* lie in a plane that also includes the longitudinal axis A-A. In the open position of the dry sprinkler 10, the two-legged member 51 cooperates with the fluid tube 54 and with the closure assembly 30 to move the closure assembly 30 to a side of the longitudinal axis A-A.

The dry sprinkler 10 of this embodiment can be assembled as described above in relation to the assembly description of the first preferred embodiment and further in the following manner with regard to the main and throw journals. The locator 50, including the closure assembly 30, the two-legged member 51, the fluid tube 54, and the guide tube 56, are sub-assembled together as a subassembly and then the whole subassembly is positioned in the casing tube 24. A guide tool is inserted, in the direction of fluid flow, through the inlet opening 23*e* and is engaged with the opening 33*a* of the closure assembly. The biasing member 55 may optionally be fitted inside the inlet fitting 23 so as to cincture the guide tool. If necessary, a sleeve 42 may also be inserted in the inlet fitting 23 to provide a seat for the biasing member 55. The tool is used to guide the closure assembly 30 the occluding position with respect to the inlet opening 23*e*, and the casing tube 24 and inlet fitting 23 are threadably coupled. While continuing to use the guide tool to maintain the closure assembly 30 in the occluding position, the outlet frame (25,251,252) including the triggering mechanism 60 is threadably coupled to the casing tube 24. Next, the adjustment screw 71 is adjusted to a sufficiently high torque value that in the final assembled position, the screw 71 in conjunction with the outer surface 25*a* will cause the outer perimeter or a portion of the face 37 to be compressed against the inlet sealing surface 38*b* and maintain all components at their intended position without damaging the frangible bulb 61.

The subassembly of the inner assembly 501 can include the following steps. The first and second journals 512*a*,514*a*, of two legged member 51 are held in an elastically deformed condition, aligned with the corresponding first and second bearings 542*a*,544*a*, and released from the elastically deformed condition so as to be received in the corresponding first and second bearings 542*a*,544*a*. The journal 510*a* of the two-legged member 51 can then be positioned in the recess 30*c* defined by the main body 30*a*. Thus, a partially assembled dry sprinkler is provided at this point. Thereafter, the two-legged yoke 51 and trigger assembly 60 can be mounted to the partially assembled dry sprinkler to provide a complete dry sprinkler as described earlier.

Figure 18F:
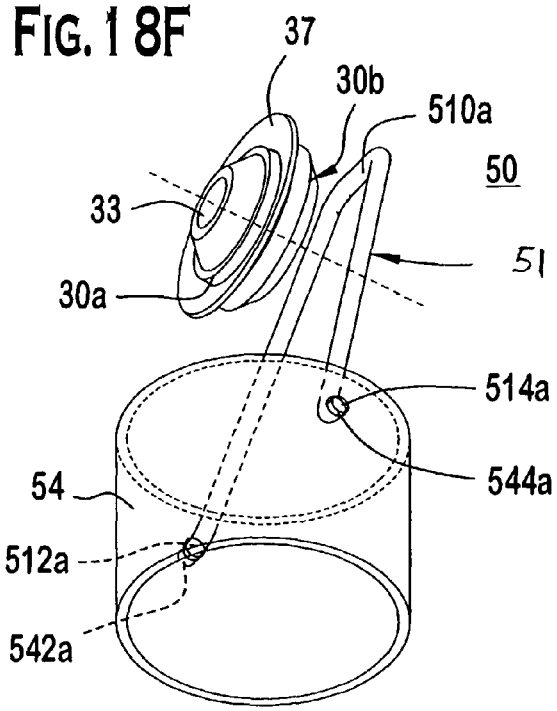
Figure 18G:
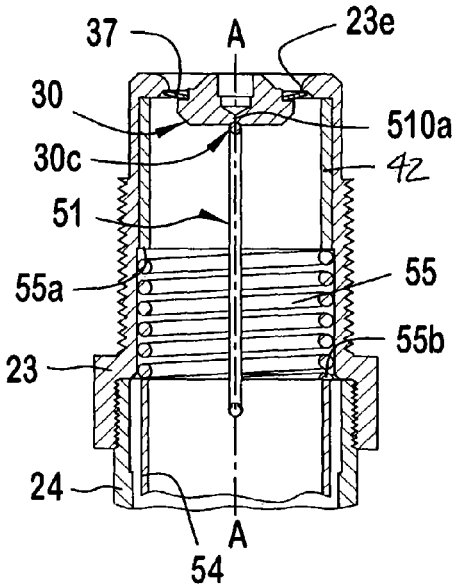
Figure 18H:
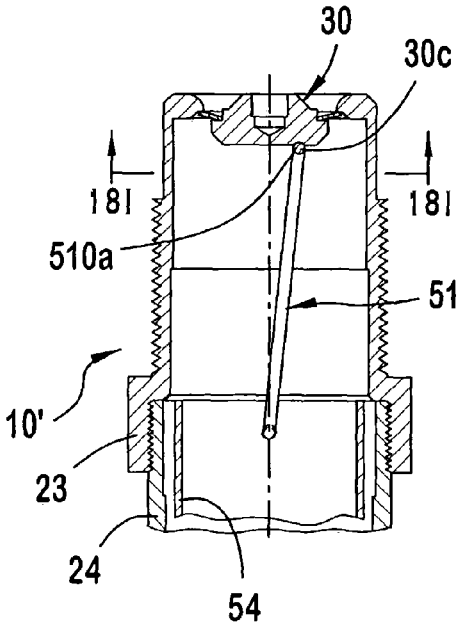
Figure 18I:
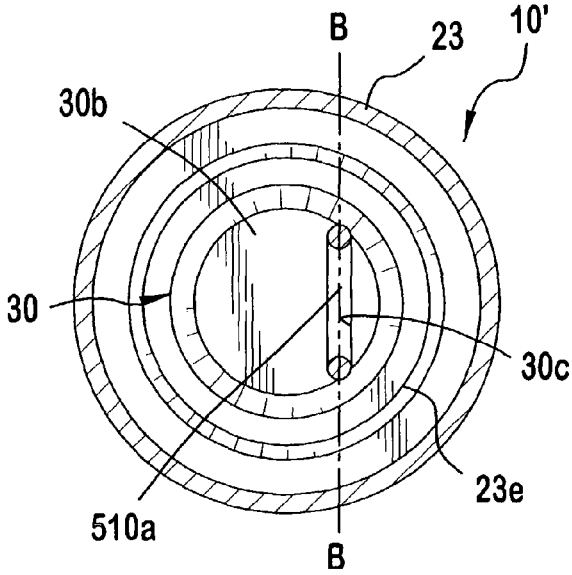
Figures 20C, 20D, 20E, 20F:
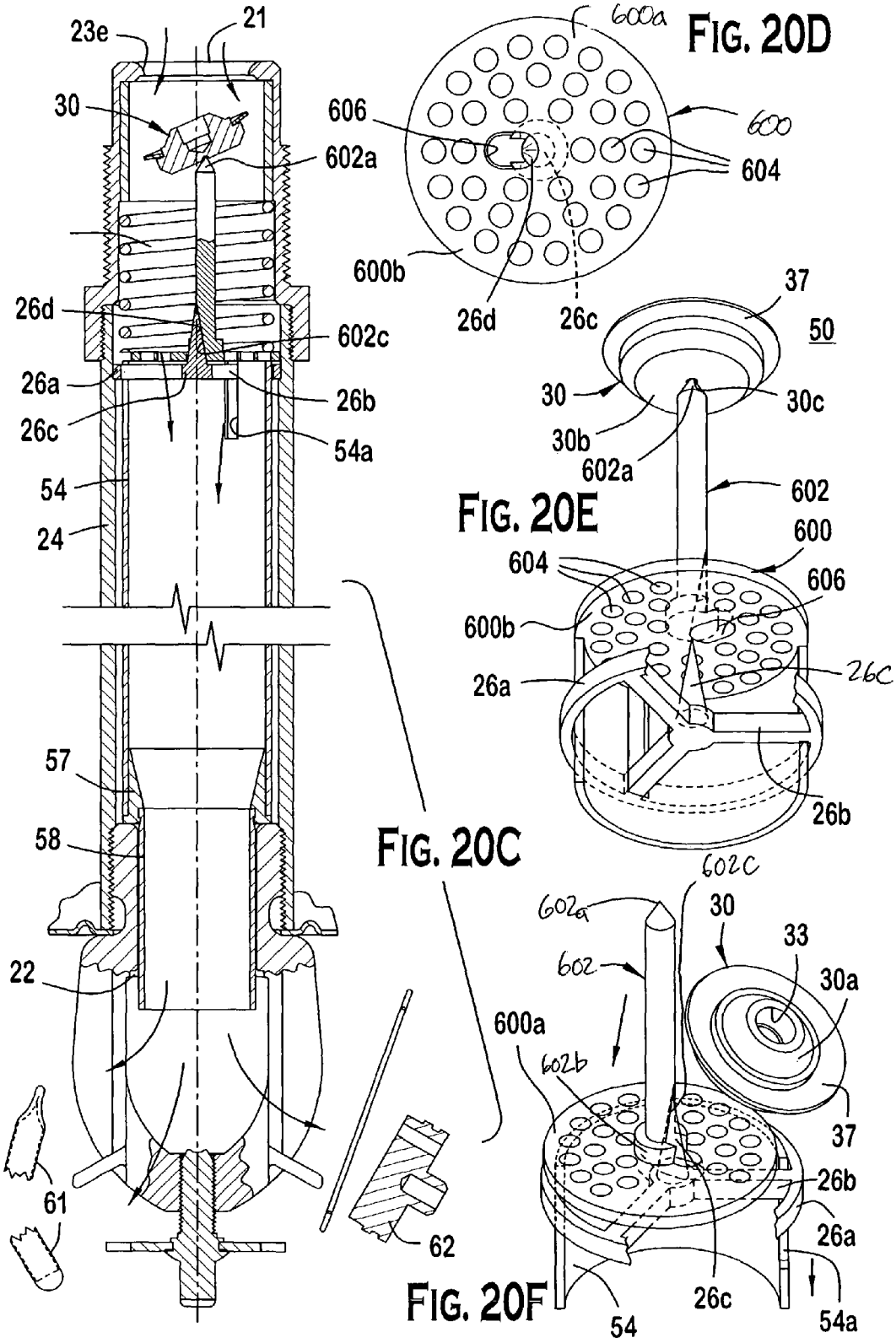
Figure 21F:
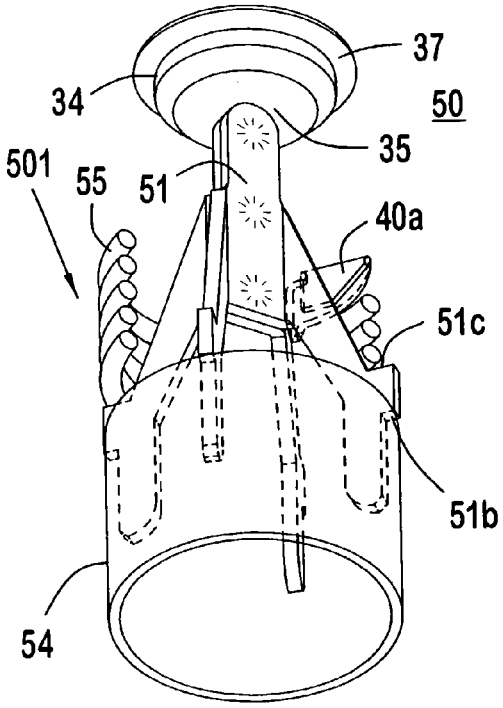
Figure 21G:
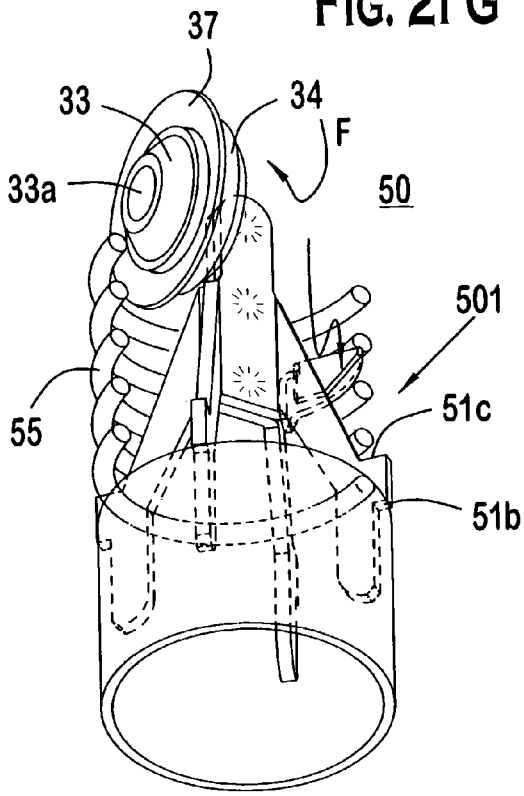
Figure 21H:
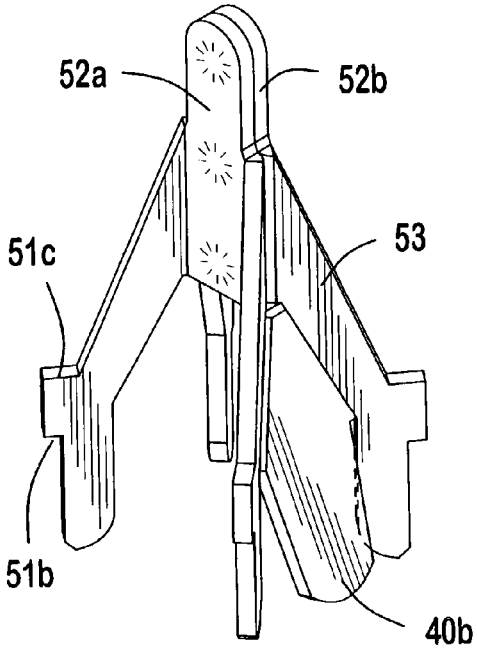
Figure 21I:
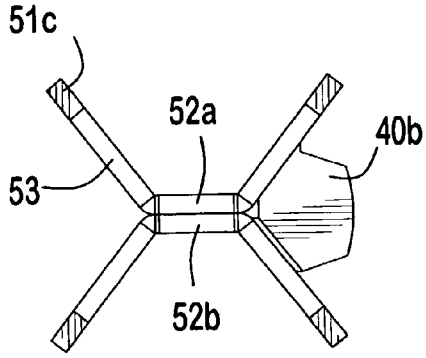

In operation, when the dry sprinkler is actuated so that the locator 50 is translated, the closure assembly 30 is sufficiently pivoted to cause the center of mass of the closure assembly 30 to be offset relative to the longitudinal axis A-A, as shown in FIGS. 18D and 18F, due in part to the propensity of the two-legged member 51 to pivot about all three of its journals 510*a*,512*a*,514*a*, and of the recess 30*a* to release from the two-legged member 51. Thus, closure assembly 30 is released and generally moves to one side of and along the longitudinal axis A-A as the inner assembly 501 is moved from proximate the first position (FIG. 18A) to the second position (FIG. 18D) so that the central axis X-X of the face 37 is skewed with respect to the longitudinal axis A-A and the expected flow rate is provided by the dry sprinkler.

Referring to the nineteenth preferred embodiment as shown in FIGS. 19A-19E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the inner assembly 501 includes a yoke 520, a bar 521, a fluid tube 54, and a guide tube 56. The yoke 520 includes a plurality of apertures 522*b* and a second contact area 522*c*. The plurality of apertures 522*b* each perforates the yoke 520 and is spaced from the longitudinal axis A-A. Preferably, the yoke 520 is in the form of a generally planar support plate that has a thickness measured parallel to the longitudinal axis A-A between a first surface 523*a* and a second surface 523*b*. Thus, each of the plurality of apertures 522*b* connects the first and second surfaces 523*a*, 523*b*. Preferably, the first surface 523*a* of the yoke 520 faces the inlet, and the second surface 523*b* of the yoke 520 faces the outlet.

The second contact area 522*c* is coincident with the longitudinal axis A-A, and has a depth less than the thickness of the yoke 520. Preferably, the second contact area 522*c* is provided on the first surface 523*a* of the yoke 520. The bar 521 extends along the longitudinal axis A-A between a first end 521*a* and a second end 521*b*. The first end 521*a* is cooperatively received in the first contact area 30*c* of the closure assembly 30, and the second end 521*b* is cooperatively received in the second contact area 522*c* of the yoke 520.

The dry sprinkler 10 of this embodiment can be assembled as described above in relation to the assembly description of the first preferred embodiment and further in the following manner with regard to the pivoting bar 521 and yoke, 520. The locator 50, including the closure assembly 30, yoke 51, the fluid tube 54, and the guide tube 56, are sub-assembled together, and then the whole subassembly is positioned in the casing tube 24. A guide tool is inserted, in the direction of fluid flow, through the inlet opening 23*e* and is engaged with the opening 33*a* of the closure assembly. A temporary fixture is used to position the bar 521 within the inlet fitting 23 such that the first end 521*a* is cooperatively received in the first contact area 30*c* of the closure assembly 30. The biasing member 55 may optionally be fitted inside the inlet fitting 23 so as to cincture the guide tool. If necessary, a sleeve 42 may also be inserted in the inlet fitting 23 to provide a seat for the biasing member 55. The tool is used to guide and maintain the closure assembly 30 in the occluding position with respect to the inlet opening 23*e* while the casing tube 24 with the inner assembly 501 therein is threadably coupled to the inlet fitting 23. At the same time, the second end 521*b* of the bar 521 is cooperatively received in the second contact area 522*c* of the yoke 51. While continuing to use the guide tool to maintain the closure assembly 30 in the occluding position, the outlet frame (25,251,252) including the triggering mechanism 60 is threadably coupled to the casing tube 24. Next, the adjustment screw 71 is adjusted to a sufficiently high torque value that in the final assembled position, the screw 71 in conjunction with the outlet frame will cause the outer perimeter or a portion of the face 37 to be compressed against the inlet sealing surface 38*b* and maintain all components at their intended position without damaging the frangible bulb 61.

In operation, when the inner assembly 501 (the yoke 520, bar 521, fluid tube 54, and guide tube 56) is translated along axis A-A due to actuation of the dry sprinkler, the face 37 separates from the sealing surface 38*b*, and the support at the two pivot points becomes unstable due to the absence of the bar 521 supporting the closure assembly 30 with respect to the yoke 520. In particular, relative pivoting motion occurs at the interface between the first contact area 30*c* and the first end 521*a* of the bar 521, or between the second contact area 522*c* and the second end 521*b* of the bar 521, or both. As the closure assembly 30 translates along axis A-A, and by virtue of the bar 521 being longer than the inside diameter of the outer structure 20, the bar 521 falls to an inclined position relative to the longitudinal axis A-A. Consequently, the face 37 is also tipped so as be obliquely oriented with respect to the longitudinal axis A-A. Thus, C closure assembly 30 is generally moved to one side of and along the longitudinal axis A-A as the locator 50 is moved from proximate the first position (FIG. 19A) to the second position (FIG. 19C) so that the central axis X-X of the face 37 is skewed with respect to the longitudinal axis A-A and the expected flow rate is provided by the dry sprinkler.

Referring to the twentieth preferred embodiment as shown in FIGS. 20A-20F, an arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In this embodiment, the structure 20 includes a dislodgment member 26 supported by the casing tube 24. The dislodgment member 26 includes a base 26*a* that is secured with respect the casing tube 24. At least one radially inward extending arm 26*b* connects the base 26*a* to a kicker 26*c*. Preferably, the kicker 26*c* projects along the longitudinal axis A-A toward the inlet end 21. The kicker 26*c* includes a first oblique surface 26*d* relative to the longitudinal axis A-A. The inner assembly 501 can include a yoke 600, a post 602, a fluid tube 54, and a guide tube 56. In the non-actuated configuration, the yoke 600 is coupled to the fluid tube 54, and the fluid tube 54 is coupled to the guide tube 56, and the guide tube 56 is coupled to the trigger seat 62. The yoke 600 includes a plurality of fluid flow apertures 604 and a dislodgment aperture 606. The pluralities of fluid flow apertures 604 each perforates the yoke 600 and are spaced from the longitudinal axis A-A. Preferably, the yoke 600 is in the form of a generally planar support plate that has a thickness measured parallel to the longitudinal axis A-A between a first surface 600*a* and a second surface 600*b*. Thus, each of the plurality of fluid flow apertures 604 connects the first and second surfaces 600*a*, 600*b*. Preferably, the first surface 600*a* of the yoke 600 faces the inlet 21, and the second surface 600*b* of the yoke 600 faces the outlet end 22.

Preferably, the second surface 600*b* includes a support surface that is spaced from the longitudinal axis A-A and contacts the fluid tube 54 to support the yoke 600. And the second surface 660*b* includes a contact surface that is coincident with the longitudinal axis A-A. Each of the first and second surfaces 600*a*, 600*b* having a surface area that is less than the cross-sectional area, generally perpendicular to the longitudinal axis A-A, of the passageway 20*a*.

The dislodgment aperture 606 includes an elongated hole that extends radially with respect to the longitudinal axis A-A. The plurality of fluid flow apertures 604 and the dislodgment aperture 606 connect the first and second surfaces 600*a*, 600*b* of the yoke 600.

The post 602 extends along the longitudinal axis A-A between a first end 602*a* and a second end 602*b*. The first end 602*a* is cooperatively received in the first recess 30*c* of the closure assembly 30, and the second end 602*b* sits on the first surface 600*a* of the yoke 600. Proximate the second end 602*b* of the post 602, there is a second oblique surface 602*c* relative to the longitudinal axis A-A. Preferably, the first and second oblique surfaces 26*d*,602*c* have the same angle of inclination with respect to the longitudinal axis A-A.

The dry sprinkler 10 of this embodiment can be assembled as described above in relation to the previous embodiment of the dry sprinkler and further in the following manner with regard to the sliding bar and dislodgment member. The inlet fitting 23 is positioned such that the inlet opening 23*e* is on the bottom. A guide tool is inserted, in the direction of fluid flow, through the inlet opening 23*e* and is engaged with the opening 33 of the closure assembly. A temporary fixture is used to position the post 602 within the inlet fitting 23 such that the first end 602*a* is cooperatively received in the first recess 30*c* of the closure assembly 30. The biasing member 55 may optionally be fitted inside the inlet fitting 23 so as to cincture the post 602. The yoke 600 is engaged with the second end 602*b* of the post 602. The inner assembly 501, including the fluid tube 54 and the guide tube 56, are sub-assembled together, and then the inner assembly 501 is positioned in the casing tube 24 such that the slots 54*a* slidably receive a corresponding one of the radially inward extending arms 26*b* of the dislodgment member 26. The tool is used to guide and maintain the closure assembly 30 in the occluding position with respect to the inlet opening 23*e* while the casing tube 24 with the inner assembly 501 therein is threadably coupled to the inlet fitting 23. While continuing to use the guide tool to maintain the closure assembly 30 in the occluding position, the outlet frame (25,251,252) including the triggering mechanism 60 is threadably coupled to the casing tube 24. Next, the adjustment screw 71 is adjusted to a sufficiently high torque value that in the final assembled position, the screw 71 in conjunction with the outer surface 25*a* will cause the outer perimeter or a portion of the face 37 to be compressed against the inlet sealing surface 38*b* and maintain all components at their intended position without damaging the frangible bulb 61.

In operation, when the dry sprinkler is actuated, the closure assembly 30 and inner assembly 501 (the yoke 600, post 602, fluid tube 54, and guide tube 56) are translated along axis A-A. The radially inward extending arm(s) 26*b* slide within the slots 54*a* of the fluid tube 54, and the kicker 26*c* penetrates the dislodgment aperture 606 of the yoke 600. The first oblique surface 26*d* engages the second oblique surface 602*c* so as to laterally displace the post 602 relative to the longitudinal axis A-A. In the absence of the post 602 supporting the closure assembly 30 with respect to the yoke 600, the face 37 separates from the sealing surface 38*b*. In particular, relative pivoting motion occurs at the interface between the first recess 30*c* and the first end 602*a* of the post 602 as the second end 602*b* of the post 602 slides across the second surface 600*b* of the yoke 600.

As the closure assembly 30 translates along axis A-A, and by virtue of the post 602 either remaining upright, i.e., parallel to the longitudinal axis A-A, and by virtue of the post 602 being laterally displaced by the kicker 26*c*, the face 37 is tipped so as be obliquely oriented with respect to the longitudinal axis A-A. Thus, closure assembly 30 is generally moved to one side of and along the longitudinal axis A-A so that the central axis X-X of the face 37 is skewed with respect to the longitudinal axis A-A and the expected flow rate is provided by the dry sprinkler.

Referring to the twenty-first preferred embodiment, as shown in FIGS. 21A-21I, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. As described generally above, the multi-legged yoke 51 includes a single member first yoke end 51*a* and a four-legged second yoke end 51*b*. The yoke 51 has two stamped metal members 52*a* and 52*b* joined via a plurality of tack welds. Each of the members has central portion and two projections at appropriate angles that diverge from the longitudinal axis A-A. The projections 53 of respective stamped metal members 52*a* and 52*b* are configured such that they form four sectors about the longitudinal axis, where a pair of diametrical sectors (A and C in FIG. 21D) of generally equal first arcuate distance is interposed by a pair of diametrical sectors (B and D in FIG. 21D) of generally equal second arcuate distance, and where the first arcuate distance is greater than the second. Provided between two legs 53 that preferably form a smaller arcuate sector than an adjacent arcuate sector is a flow obstructing member 40*a*. The flow obstructing member 40*a* can be formed integrally with one of the leg 53. Preferably, the flow obstructing member 40*a* is a separate member that is fixed to the two adjacent legs 53 by respective tack welds 41. In one preferred embodiment, the flow obstructing member can obstruct flow generally through approximately the flow area defined by the two legs and the inner surface 23*b* of the inlet fitting 23, as shown by member 40*a* in FIGS. 21D and 21E. Alternatively, in another preferred embodiment, the flow obstructing member can obstruct flow partially through approximately the flow area defined by the two legs and the inner surface 23*b* of the inlet fitting 23, as shown by member 40*b* in FIGS. 21H and 21I. The flow obstructing member 40*a* or 40*b* causes fire-extinguishing fluid F flowing through an actuated dry sprinkler 10 (FIG. 21C) to be obstructed through the arcuate sector C (FIG. 21D) such that the fluid F is forced to divert to other arcuate sectors about the longitudinal axis A-A. The diversion of fluid flow F tends to cause the closure assembly 30 to be moved off its support on surface 51*a* of the yoke 51 as the dry sprinkler is being actuated.

The assembly of this embodiment can be performed in a similar manner as the third preferred embodiment.

In operation, as the dry sprinkler is actuated, the closure assembly 30 and inner assembly 501 (the yoke 51, fluid tube 54, and guide tube 56) are translated along axis A-A so as to separate the face 37 from the sealing surface 38*b*. Once the outer perimeter or a portion of the face 37 is no longer in contact with sealing surface 38*b*, the closure assembly 30 can pivot off the first support end 51*a* of the yoke 51. It is noted that under one circumstance, the closure member assembly 30 may be moved off its support on the support surface 51*a* of the yoke due to movement of the locator and water pressure to permit water to flow at approximately rated flow rate. However, under other circumstances, the closure assembly 30 may nutate (i.e., wobble about the longitudinal axis A-A) such that the closure assembly 30 presents a flow obstruction to the inlet thereby allowing only a partial flow through the outlet. Under the latter circumstance, the partial flow encounters another flow obstruction in the form of either member 40*a* or 40*b* that forces fluid F to flow around the obstruction. The redirecting of flow around the flow obstruction may cause the closure assembly 30 to be further unbalanced while it is nutating about the first support end 51*a*, thereby tending to move the closure assembly off the yoke 51 such that the face 37 is skewed with respect to the longitudinal axis A-A and the expected flow rate is achieved from the dry sprinkler. Because the central axis X-X of the face 37 is skewed relative to the longitudinal axis A-A, fluid can flow at approximately 95% of the expected flow rate through the passageway 20*a*.

Referring to the twenty-second preferred embodiment, as shown in FIGS. 22A-22E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the casing tube 24 has an outer casing tube surface 24*a* and an inner casing tube surface 24*b*, which surfaces cincture part of the passageway 20*a*. The casing tube 24 can be asymmetrically formed over a portion 440 located between the inlet 21 and the outlet 22. The casing tube 24 can also be formed such that the asymmetrical portion 440 can be formed between symmetrical portions 440*a* and 440*b*. The portion 440 of the casing tube 24 can be formed such that, when viewed from the inlet end on the longitudinal axis A-A, the portion 440 defines a chord 41*a* between transverse axis B-B, which has a larger magnitude than a chord 41*b* of the symmetrical portion 440*a* or 440*b* between transverse axis B-B. The casing tube 24 including the asymmetrical portion 440 can be formed by a suitable technique such as, for example, deep drawing or hydro-forming.

Figure 22C:
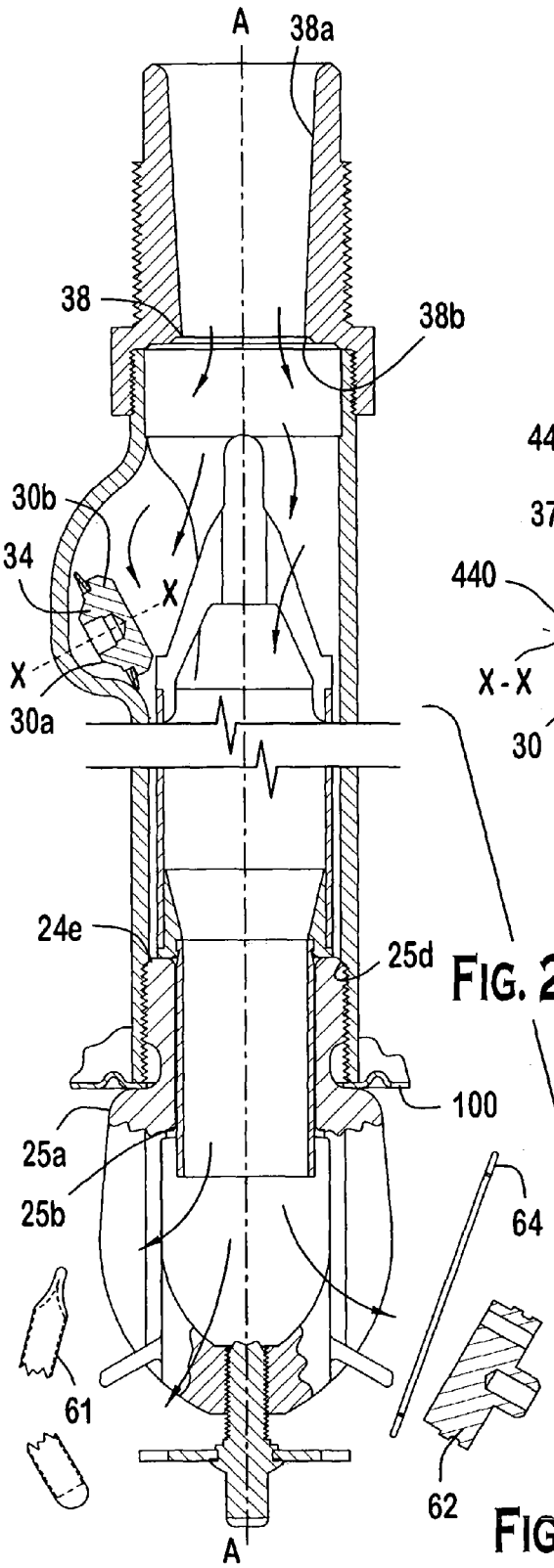
Figure 22D:
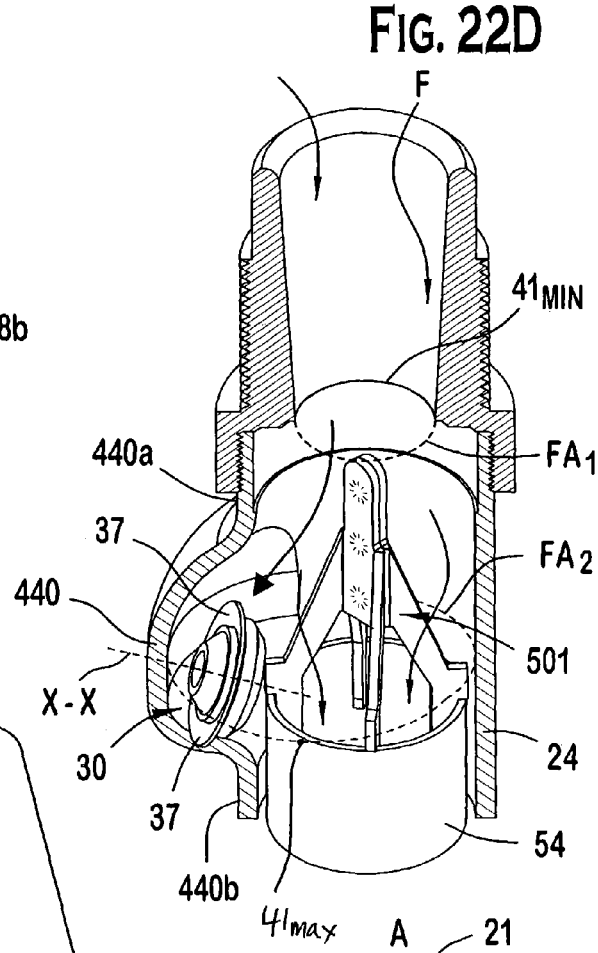
Figure 22E:
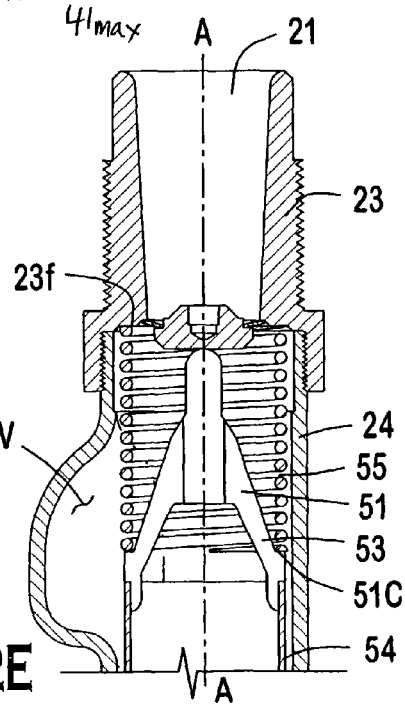

The inlet opening 23*e* extends about a plane generally transverse to and about the longitudinal axis A-A so as to define a first flow area FA1. The casing tube 24 can be formed so as to define a second flow area through asymmetrical portion 440 such as, for example, by providing the asymmetrical portion without a gradual increase in the flow area. The casing tube 24 can be formed so as to provide a plurality of flow areas along the longitudinal axis A-A. The plurality of flow areas allows for a gradual increase in flow area and a gradual decrease in flow area through the asymmetrical portion 440. As shown in FIG. 22D, the minimum flow area $\mathbf{41}_{MIN}$ through asymmetrical portion 440 is generally equal to a flow area of the symmetrical portion 440*a* of the casing tube 24 and the maximum flow area $\mathbf{41}_{MAX}$ through the asymmetrical portion 440 is generally much greater than the minimum flow area $\mathbf{41}_{MIN}$, and the maximum flow area is greater than the first flow area FA1.

The assembly of this embodiment can be performed in a similar manner as the third preferred embodiment.

In operation, when the dry sprinkler is actuated, the inner assembly 501 (the yoke 51, fluid tube 54, and guide tube 56) is translated along axis A-A so as to separate the face 37 from the inlet sealing surface 38*b*. Once the outer perimeter or a portion of the face 37 is no longer in contact with inlet sealing surface 38*b*, the closure assembly 30 can separate from the first support end 51*a* of the yoke 51. It is noted that under one circumstance, the closure member assembly 30 may be moved off its support on the support surface 51*a* of the yoke due to movement of the locator and water pressure to permit water to flow at approximately rated flow rate. However, under another circumstances, the closure assembly 30 may nutate (i.e., wobble about the longitudinal axis A-A) such that the closure member 30 presents a flow obstruction to the inlet thereby allowing only a partial flow through the outlet. Under the latter circumstance, the partial flow encounters a pressure differential due to the difference in flow area FA1 and flow area FA2 that forces fluid F to flow onto a side of the longitudinal axis A-A. The redirecting of flow around due to the pressure differential may cause the closure assembly 30 to be further unbalanced while it is nutating about the first support end 51*a* such that the central axis X-X of the face 37 is skewed with respect to the longitudinal axis A-A and the expected flow rate is achieved from the dry sprinkler, thereby tending to move the closure assembly off the yoke 51 into the volume V defined by the asymmetrical portion 440 of the casing tube 24, and allowing approximately expected flow rate through the passageway 20*a*.

Referring to the twenty-third preferred embodiment, as shown in FIGS. 21A-21I, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the inner assembly 501 includes the yoke 721, a water tube 54, and a guide tube 56. In the non-actuated configuration, the yoke 721 is coupled to the guide tube 56, and the guide tube 56 is coupled to the water tube 54, and the water tube 54, is coupled to the trigger seat 62. The locator 50 may optionally include a biasing member that in a preferred embodiment includes an assist spring 55

Figure 23F:
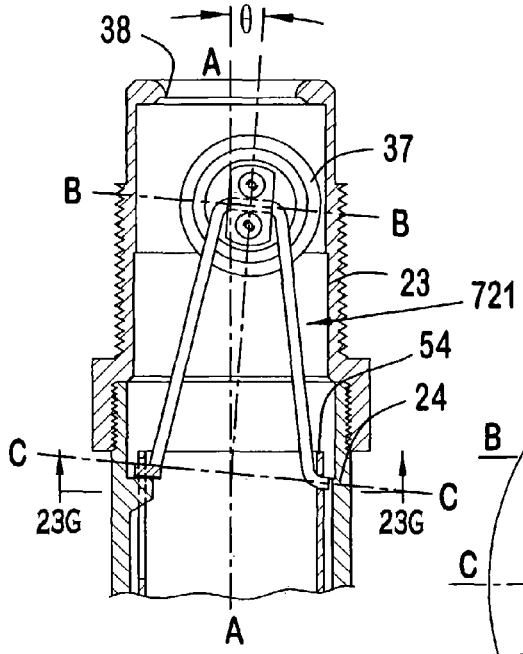
Figure 23G:
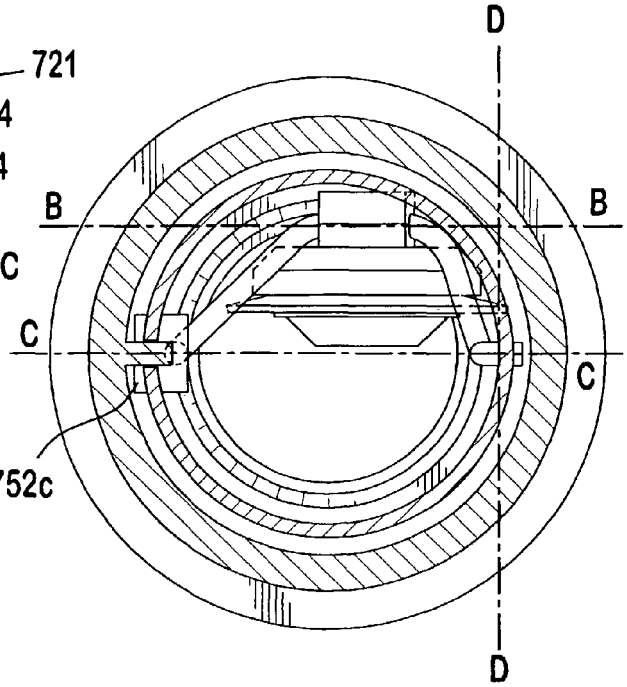
Figure 23H:
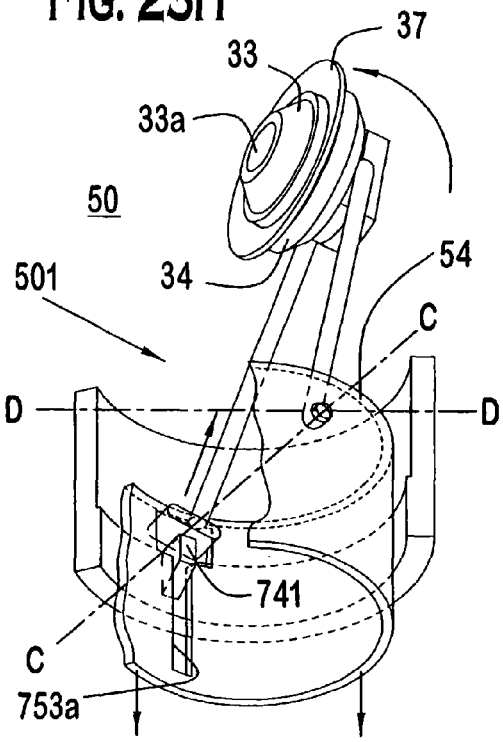

(FIG. 23I) to assist movement of the locator from its unactuated position (FIG. 23A) to an actuated position (FIG. 23E).

The yoke 721 locates the closure assembly 30 with respect to the longitudinal axis A-A. The yoke 721 has a central journal 720 coupled to the closure assembly 30 by a bearing surface 35 of the closure assembly 30 via an end cap 35*a*, and a main journal 722 coupled to the inner assembly 501 via another bearing surface 724. The main journal 722 is rotatable in bearing surface 724 about an axis B-B orthogonal to the longitudinal axis A-A. The central journal 720 has a tubular configuration that is connected to two elongate members 721*a* and 721*b*. The first leg 721*a* is preferably connected to the main journal 722 as a unitary member. The main journal 722 is preferably coupled to the water tube 54 by the main bearing surface 724. The main journal 722 is also rotatable about an axis C-C generally parallel to axis B-B of the central journal 720. The main journal 722 is also rotatable about an axis D-D transverse to the axis C-C so that the leg 721*a* has two-degree of freedom about main bearing 724. The second leg 721*b* is preferably coupled to an impact pad 752*c*. The impact pad 752*c* can be mounted to an open-ended pocket 753 formed through the inner and outer surfaces of the water tube 54. The open ended pocket 753 can be provided with a groove 753*a* extending along the longitudinal axis A-A so that a projection 741 (formed as part of casing tube 24) can project through the groove 753*a* so as to guide the water tube 54 along the longitudinal axis A-A and to generally constrain the water tube 54 against angular (i.e., radial) movements about the longitudinal axis A-A.

The dry sprinkler 10 of this embodiment can be assembled as described above in relation to the eighteenth preferred embodiment of the dry sprinkler and further in the following manner with regard to the crank arm end and impact pad. The face 37 is connected to the member 721 via the closure assembly 30 with an end cap 35*a*. The main journal 722 is inserted into the main bearing 724 of the fluid tube 54. The impact pad 752*c* is placed into the pocket 753. The water tube 54 is coupled to the guide tube 56. These components form a locator subassembly that is preferably inserted into the inlet fitting 23.

The locator subassembly described above can be coupled to the casing tube 24. Casing tube 24 is preferably configured so that its inner diameter is generally greater than the outer diameter of the water tube 54. The water tube 54 is preferably inserted into the casing tube 24 such that a longitudinal axis of the water tube 54 is offset to the longitudinal axis of the casing tube 24 so that enough clearance is provided between the projection 741 and a solid portion of the water tube 54 before the projection 741 is fitted into the groove 753*a* as the water tube 54 is slid upward axially.

Figure 23I:
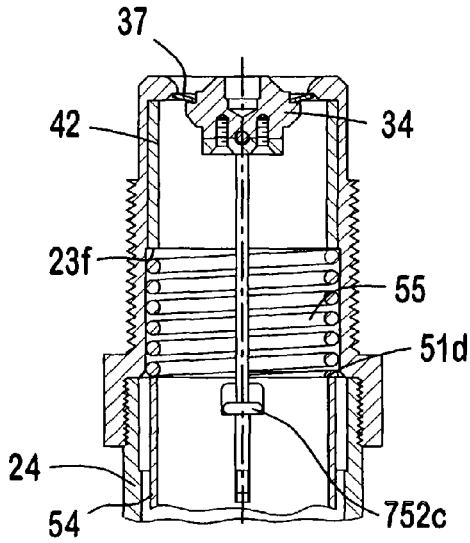

A suitable tool is inserted into opening 33*a* so as to maintain the resilient sealing member 37 in a generally transverse configuration as the locator subassembly is coupled or preferably threaded to the inlet fitting 23. The closure assembly 30 is oriented in the inlet 21 so that the resilient sealing member 37 contacts an inlet sealing surface 38*b* of the inlet 21. In another preferred embodiments, a sleeve 42 is inserted in the inlet fitting 23 and a biasing member in the form of a assist spring 55 is thereafter placed into the interior surface 23*b* of the inlet fitting 23, as shown in FIG. 23I.

As the casing tube 24 is preferably threaded to the inlet fitting 23, the axial movement of the casing tube 24 relative to the inlet fitting 23 partially compresses the resilient sealing member 37 (i.e. the metallic disc annulus in a preferred embodiment) against the inlet sealing surface 38*b* of the inlet fitting 23 so that the components described above form a partially assembled dry sprinkler. Thereafter, the member 721 and trigger assembly 60 can be mounted to the partially assembled dry sprinkler to provide a complete dry sprinkler as described earlier.

In operation, when the dry sprinkler is actuated, the inner assembly 501 (the yoke 721, water tube 54, and guide tube 56) is translated along axis A-A so as to separate the seal member 37 from the inlet sealing surface 38. As the locator 50 translates towards the second position, the projection 741 impacts against the impact pad 752*c* so as to provide an impulse force on the closure assembly 30. The impulse force tends to cause the yoke 721 to rotate on one of its legs 721*a* about the axis C-C and axis D-D to provide roll about axis C-C and pitch about axis D-D to the leg 721*a*. That is to say, the impulse force caused by the projection 741 on impact shoe 752*c* tends to cause the leg 721*a* to rotate about its bearing on axis C-C for a roll and also to rotate about an axis D-D transverse to the axis C-C for a pitch (FIG. 23G), i.e., a compound motion involving roll and pitch of the leg 721*a*. This two-degree of freedom of movement tends to cause the closure assembly 30 to be unbalanced on its axis B-B, which could cause the closure assembly 30 to rotate or pivot about axis B-B. As the closure assembly 30 pivots about axis B-B, the closure assembly is pivoted over to a side of the longitudinal axis A-A so that the central axis X-X of the face 37 is skewed with respect to the longitudinal axis A-A and the expected flow rate is provided by the dry sprinkler.

As described above, the dry sprinkler of the preferred embodiments is believed to advantageous in that, due to the various arrangements of components within the dry sprinkler that position the central axis X-X of the face 37 (of a metallic disc annulus) skewed with respect to the longitudinal axis A-A, a minimum flow rate of 95% of the rated K-factor times the square root of the pressure of the flow of fluid fed into the inlet can be achieved. Preferably, each of the inlet fitting, means for repositioning the face 37 and bias member 55 can be made of a copper, bronze, galvanized carbon steel, carbon steel, or stainless steel material.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

We claim:

1. A dry sprinkler comprising:

a structure defining a passageway extending along a longitudinal axis between an inlet and an outlet, the structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a metallic disc annulus having a face disposed about a central axis between an inner perimeter and an outer perimeter;

a support member for the metallic disc annulus;

first means for translating the metallic disc annulus along the longitudinal axis between a first position and a second position; and second means for repositioning the central axis of the face skewed to the longitudinal axis within the passageway between the first position and the second position, the second means being located between the first and the second position and longitudinally spaced from the support member for the metallic disc annulus when the annulus is in either one of the first and second positions so that a flow of fluid in gallons per minute from the outlet of the structure is at least 95 percent of the rated K-factor multiplied by the square root of the pressure of the flow of fluid fed into the inlet of the structure in pounds per square inch gauge.

2. The dry sprinkler of claim 1, the first means comprising a locator and the second means further comprising a member that contacts at least one of the locator and the metallic disc annulus to translate the face of the metallic disc annulus to a side of the longitudinal axis when the locator moves from the first position toward the second position.

3. The dry sprinkler of claim 1, the first means comprising a locator and the second means further comprising a projection extending from the inner surface of the structure, the projection having a free end located in the passageway, the free end contacting at least one of the locator and metallic disc annulus to translate the face of the annulus to a side of the longitudinal axis when the locator moves from the first position towards the second position so as to permit a flow of fluid through the passageway between the inlet and outlet.

4. The dry sprinkler of claim 1, the first means comprising a locator and the second means further comprising a member extending across the passageway and connecting to the inner surface of the structure at a plurality of points of the inner surface, the member contacting at least one of the locator, metallic disc annulus, and support member to translate the face of the annulus to a side of the longitudinal axis.

5. The dry sprinkler of claim 1, wherein the first means comprises a closure body having a disc support surface supporting the metallic disc annulus, and wherein the second means further comprises a projection extending from the inner surface of the structure towards the longitudinal axis in the passageway, the projection having a free end located in the passageway, the free end contacting the metallic disc annulus to separate the metallic disc annulus from the closure body such that the closure body falls in the passage proximate the outlet when the first means moves from the first position towards the second position.

6. A dry sprinkler comprising:

a structure defining a passageway extending along a longitudinal axis between an inlet and an outlet, the structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a locator movable along the longitudinal axis between a first position and a second position;

a metallic disc annulus having a face disposed about a central axis between an inner perimeter and an outer perimeter, the outer perimeter contacting the structure so that the face occludes a flow of fluid through the passageway when the locator is proximate the first position, the metallic disc annulus being arranged with the central axis of the face being skewed from the longitudinal axis within the passageway when the locator is proximate the second position so that a flow of fluid in gallons per minute from the outlet of the structure is at least 95 percent of the rated K-factor multiplied by the square root of the pressure of the flow of fluid fed into the inlet of the structure in pounds per square inch gauge; and a member that contacts the metallic disc annulus to translate the face of the metallic disc annulus to a side of the longitudinal axis when the locator moves from the first position toward the second position.

7. The dry sprinkler of claim 6, wherein the inlet comprises a generally cylindrical outer surface having one of ¾ inch, 1 inch, 1.25 inch NPT and 7-1 ISO threads formed thereon.

8. The dry sprinkler of claim 7, wherein the inlet further comprises a planar annulus surface and a truncated conical surface facing the longitudinal axis adjacent the planar annulus surface, the truncated conical surface extending at an angle of about thirty degree with respect to the longitudinal axis.

9. The dry sprinkler of claim 6, wherein the inlet comprises an entrance surface having a first end and a second end disposed along and surrounding the longitudinal axis and a seat surface adjacent the second end of the entrance surface.

10. The dry sprinkler of claim 9, wherein the entrance surface comprise a convex surface surrounding the longitudinal axis and the seat surface comprises a planar annulus surface surrounding the longitudinal axis.

11. The dry sprinkler of claim 10, wherein the inlet further comprises at least a first oblique surface adjacent the planar annulus surface.

12. The dry sprinkler of claim 11, wherein the inlet further comprises at least a second surface oblique to the longitudinal axis surface adjacent the planar annulus surface.

13. The dry sprinkler of claim 12, wherein the face of the disc annulus comprises a generally planar surface contacting the planar annulus surface when the locator is proximate the first position.

14. The dry sprinkler of claim 13, wherein the face of the disc annulus comprises a truncated conical surface extending towards the planar annulus surface when the locator is proximate the second position.

15. The dry sprinkler of claim 14, wherein the locator comprises a seat that supports the metallic disc annulus.

16. The dry sprinkler of claim 15, wherein the locator comprises a closure body coupled to a yoke, the closure body having a top portion and a base portion, the top portion having at least one surface providing a seat for the metallic disc annulus, the yoke having a first wall portion and a second wall portion symmetric about a yoke axis, the first wall portion and the second wall portion being coupled to the surface of the base portion of the closure body.

17. The dry sprinkler of claim 16, wherein the top portion comprises a surface defining a blind hole.

18. The dry sprinkler of claim 17, wherein the structure includes a first tubular portion connected to a second tubular portion, and a third tubular portion spaced from the first tubular portion and connected to the second tubular portion, the first tubular portion having a first set of threads formed on one of inner and outer surfaces of the first tubular portion, the second tubular portion having second and third sets of threads, the second set of threads formed proximate a first end of the second tubular portion on one of outer and inner surfaces, the third set of threads formed proximate a second end of the second tubular portion on one of inner and outer surfaces, and a fourth set of threads formed on one of outer and inner surfaces of the third tubular portion; and wherein the first set of threads engages the second set of threads, and the third set of threads engages the fourth set of threads.

19. The dry sprinkler of claim 18, wherein the structure comprises a length from the inlet to the outlet between two to fifty inches.

20. The dry sprinkler of claim 19, wherein the structure further comprises a coil spring disposed about the longitudinal axis within the tubular outer structure proximate the inlet, the coil biasing the locator along the longitudinal axis towards the outlet.

21. The dry sprinkler of claim 20, wherein the structure comprises a fluid tube connected to a guide tube, each of the fluid and guide tube comprises an outer generally cylindrical wall surface spaced from an inner generally cylindrical wall surface along and about the longitudinal axis so as to define a fluid tube passage, the fluid tube and guide tube being surrounded by the second tubular portion.

22. The dry sprinkler of claim 21, further comprising a trigger assembly and wherein the outer generally cylindrical wall surface of the guide tube comprises a diameter between diametrical wall surfaces of a magnitude less than the diameter between diametrical wall surfaces of the inner generally cylindrical wall surface of the fluid tube, the guide tube comprises a first guide tube portion and a second guide tube portion, the first guide tube portion being fixed to another end of the fluid tube, the second guide tube portion being connected to the trigger assembly.

23. The dry sprinkler of claim 22, wherein the trigger assembly comprises a trigger seat, a trigger and a retention member disposed between the fluid tube and the fluid deflecting structure.

24. The dry sprinkler of claim 18, wherein the third tubular portion comprises at least one frame arm connected to the third tubular portion.

25. The dry sprinkler of claim 24, wherein the trigger seat comprises a generally cylindrical plug having a first plug portion extending in the outlet and second plug portion forming a nub connected to the trigger.

26. The dry sprinkler of claim 25, wherein the retention member comprises an elongate member fixed to the fluid deflecting structure and coupled to the at least one frame arm.

27. The dry sprinkler of claim 26, wherein the trigger comprises a temperature responsive trigger being retained between the seat trigger and the retention member, the temperature responsive trigger being operative to: (1) maintain the inner tubular assembly proximate the first position over the first range of temperatures between minus 60 degrees Fahrenheit to a temperature just below a rated temperature of the trigger; and (2) permit the inner tubular assembly to move along the longitudinal axis to the second position over a second range of temperatures greater than or equal to the rated temperature of the trigger.

28. The dry sprinkler of claim 6, wherein the pressure of the flow fed into the inlet comprises a plurality of start pressures between 0 and 175 psig.

29. The dry sprinkler of claim 28, wherein the plurality of start pressures comprises one of 20 psig and 100 psig.

30. The dry sprinkler of claim 28, wherein the K-factor comprises a K-factor of at least one of about 5.6, 8.0, 11.2, 14.0 and 16.8.

31. A dry sprinkler comprising: a tubular outer structure defining a passageway extending along a longitudinal axis between an inlet and an outlet;

a tubular inner assembly disposed within the tubular outer structure and movable along the longitudinal axis in the passageway between a first position and a second position, the tubular inner assembly including:

a multi-legged yoke, the multi-legged yoke having a first yoke support end and a second yoke support end, the first yoke support end including at least one elongate member, the second yoke support end including at least two support legs extending from the at least one elongate member; and a fluid tube supporting the multi-legged yoke at one end of the fluid tube;

a closure assembly supported by the at least one elongate member of the first yoke support end, the closure assembly including a surface occluding a flow of fluid in the passageway when the tubular inner assembly is proximate the first position;

a projection extending from the tubular outer structure, the projection having a free end located in the passageway, the free end contacting the closure assembly to translate the surface to a side of the longitudinal axis when the inner tubular assembly moves from the first position towards the second position so as to permit a flow of fluid through the passageway between the inlet and outlet;

a temperature responsive trigger assembly proximate the outlet of the tubular outer structure; and a fluid deflecting structure proximate the outlet of the tubular outer structure.

32. The dry sprinkler of claim 31, wherein the tubular outer structure includes a first tubular portion comprising an inlet having an inlet outer surface and inlet inner surface cincturing a sleeve, the sleeve being connected to the projection and a free end of the projection comprises a unitary portion of the sleeve extending generally transverse to the longitudinal axis.

33. The dry sprinkler of claim 32, wherein the sleeve comprises a projection opening extending generally transverse to the longitudinal axis through a wall of the sleeve, the projection being disposed in the projection opening of the sleeve so as to extend generally transverse to the longitudinal axis.

34. A dry sprinkler comprising:

a structure having an inner surface to define a passageway extending along a longitudinal axis between an inlet and an outlet, the structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a member having a first surface secured to the inner surface of the passageway and a second surface disposed in the passageway;

a metallic disc annulus having a first position substantially axially aligned with the longitudinal axis and axially spaced from the member for occluding the passageway, the annulus having a second position skewed from the longitudinal axis so that a fluid can flow from the outlet, the annulus contacting the second surface of the member as the annulus is displaced from the first position to the second position; and a locator being movable along the longitudinal axis to displace the annulus from the first position to the second position.

35. A dry sprinkler comprising:

a structure having an inner surface to define a passageway extending along a longitudinal axis between an inlet and an outlet;

a fluid deflecting structure proximate the outlet;

a member having a first surface engaged with the inner surface of the passageway and a second surface disposed in the passageway;

a closure assembly including a surface, the closure assembly having a first position substantially aligned with the longitudinal axis such that the member occludes communication between the inlet and the outlet, the closure assembly having a second position skewed from the longitudinal axis such that the inlet is in communication with the outlet, at least a portion of the closure assembly engaging the second surface of the member to move from the first position to the second position and the surface of the closure assembly being axially spaced from the second surface of the member in at least one of the first and second positions; and a yoke movable along the longitudinal axis and engaging at least a portion of the closure assembly in at least one of the first and second positions.

36. The dry sprinkler of claim 35 wherein the yoke supports the closure assembly in the first position.

37. The dry sprinkler of claim 35, wherein the yoke engages the surface of the closure assembly.

38. The dry sprinkler of claim 35, wherein the yoke includes a tip for engaging the at least portion of the closure assembly.

39. The dry sprinkler of claim 38, wherein the tip tapers narrowly along the longitudinal axis in the direction from the outlet to the inlet.

40. The dry sprinkler of claim 35, wherein the yoke has a plurality of legs disposed about the longitudinal axis.

41. The dry sprinkler of claim 40, wherein the yoke has two pairs of legs disposed about the longitudinal axis.

42. The dry sprinkler of claim 35, wherein the member engages a recess along the inner surface of the structure.

43. The dry sprinkler of claim 42, wherein the member engages the recess with an interference fit.

44. The dry sprinkler of claim 35, wherein the member is welded to the inner surface of the structure.

45. The dry sprinkler of claim 35, wherein the member defines an elongated axis, the elongated axis being disposed in a plane substantially perpendicular to the longitudinal axis.

46. The dry sprinkler of claim 35, wherein the member has a first end and a second end, the second surface being located between the first and second end.

47. The dry sprinkler of claim 35, wherein the member is substantially circular in cross-section.

48. The dry sprinkler of claim 35, wherein the structure has a rated K-factor and wherein when the closure assembly is in the second position, a flow of fluid in gallons per minute from the outlet of the structure is at least 95 percent of the rated K-factor multiplied by the square root of the pressure of the flow of fluid into the inlet of the structure in pounds per square inch gauge.

49. A dry sprinkler comprising:

a structure defining a passageway extending along a longitudinal axis between an inlet and an outlet, the structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a locator movable along the longitudinal axis between a first position and a second position;

a metallic disc annulus having a face disposed about a central axis between an inner perimeter and an outer perimeter, the outer perimeter contacting the structure so that the face occludes a flow of fluid through the passageway when the locator is proximate the first position, the metallic disc annulus being arranged with the central axis of the face being skewed from the longitudinal axis within the passageway when the locator is proximate the second position so that a flow of fluid in gallons per minute from the outlet of the structure is at least 95 percent of the rated K-factor multiplied by the square root of the pressure of the flow of fluid fed into the inlet of the structure in pounds per square inch gauge; and a projection extending from the inner surface of the structure, the projection having a free end located in the passageway, the free end contacting the metallic disc annulus to translate the face of the annulus to a side of the longitudinal axis when the locator moves from the first position towards the second position so as to permit a flow of fluid through the passageway between the inlet and outlet.

50. A dry sprinkler comprising:

a structure defining a passageway extending along a longitudinal axis between an inlet and an outlet, the structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a metallic disc annulus having a face disposed about a central axis between an inner perimeter and an outer perimeter;

a support member for the metallic disc annulus;

first means for translating the metallic disc annulus along the longitudinal axis between a first position and a second position; and second means for repositioning the central axis of the face skewed to the longitudinal axis within the passageway between the first position and the second position, the second means being located between the first and the second position and longitudinally spaced from the support member for the metallic disc annulus when the annulus is in either one of the first and second positions.

51. A dry sprinkler comprising:

a structure defining a passageway extending along a longitudinal axis between an inlet and an outlet, the structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a locator movable along the longitudinal axis between a first position and a second position;

a metallic disc annulus having a face disposed about a central axis between an inner perimeter and an outer perimeter, the outer perimeter contacting the structure so that the face occludes a flow of fluid through the passageway when the locator is proximate the first position, the metallic disc annulus being arranged with the central axis of the face being skewed from the longitudinal axis within the passageway when the locator is proximate the second position; and a member that contacts the metallic disc annulus to translate the face of the metallic disc annulus to a side of the longitudinal axis when the locator moves from the first position toward the second position.

52. A dry sprinkler comprising:

a structure defining a passageway extending along a longitudinal axis between an inlet and an outlet, the structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a locator movable along the longitudinal axis between a first position and a second position;

a metallic disc annulus having a face disposed about a central axis between an inner perimeter and an outer perimeter, the outer perimeter contacting the structure so that the face occludes a flow of fluid through the passageway when the locator is proximate the first position, the metallic disc annulus being arranged with the central axis of the face being skewed from the longitudinal axis within the passageway when the locator is proximate the second position; and a projection extending from the inner surface of the structure, the projection having a free end located in the passageway, the free end contacting the metallic disc annulus to translate the face of the annulus to a side of the longitudinal axis when the locator moves from the first position towards the second position.

53. A dry sprinkler comprising: a tubular outer structure defining a passageway extending along a longitudinal axis between an inlet and an outlet;

a tubular inner assembly disposed within the tubular outer structure and movable along the longitudinal axis in the passageway between a first position and a second position, the tubular inner assembly including:

a multi-legged yoke, the multi-legged yoke having a first yoke support end and a second yoke support end, the first yoke support end including at least one elongate member, the second yoke support end including at least two support legs extending from the at least one elongate member; and a fluid tube supporting the multi-legged yoke at one end of the fluid tube;

a closure assembly supported by the at least one elongate member of the first yoke support end, the closure assembly occluding a flow of fluid in the passageway when the tubular inner assembly is proximate the first position;

a projection coupled to the tubular outer structure, the projection extending in the passageway toward the longitudinal axis, the projection contacting the closure assembly to translate the closure assembly to a side of the longitudinal axis when the inner tubular assembly moves from the first position towards the second position;

a temperature responsive trigger assembly proximate the outlet of the tubular outer structure; and a fluid deflecting structure proximate the outlet of the tubular outer structure.

54. A sprinkler comprising:

a frame;

a trigger assembly mounted to said frame;

an outer structure assembly including an inlet and an outlet spaced along a longitudinal axis, the outlet being coupled to the frame;

a closure assembly disposed at the inlet of the outer structure assembly; and an inner assembly extending between the trigger assembly and the closure assembly; and a sleeve disposed within the outer structure assembly and including a projection extending toward the longitudinal axis for engaging the closure assembly when the trigger assembly is actuated.

55. The sprinkler of claim 54, wherein the inner assembly comprises a multi-legged member.

* * * * *